US009328647B2

(12) United States Patent
Koyanagi et al.

(10) Patent No.: US 9,328,647 B2
(45) Date of Patent: May 3, 2016

(54) EXHAUST PIPE STRUCTURE FOR INTERNAL COMBUSTION ENGINE

(71) Applicant: HONDA MOTOR CO., LTD., Tokyo (JP)

(72) Inventors: Masashi Koyanagi, Wako (JP); Kazuhiko Tanaka, Wako (JP); Yohei Yajima, Wako (JP); Kenichi Misaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/226,908

(22) Filed: Mar. 27, 2014

(65) Prior Publication Data

US 2014/0290232 A1 Oct. 2, 2014

(30) Foreign Application Priority Data

Mar. 30, 2013 (JP) ..... 2013-075434
Jan. 17, 2014 (JP) ..... 2014-006522

(51) Int. Cl.
*F02B 27/02* (2006.01)
*F01N 13/10* (2010.01)
*F01N 1/00* (2006.01)

(52) U.S. Cl.
CPC *F01N 13/10* (2013.01); *F01N 1/00* (2013.01); *F01N 2260/00* (2013.01); *F01N 2340/00* (2013.01); *F01N 2340/04* (2013.01);
(Continued)

(58) Field of Classification Search
CPC ..... F02B 27/04; F02B 27/06; F02B 61/02; F01N 1/02; F01N 1/166; F01N 1/165; F01N 13/08; F01N 13/10
USPC ..... 60/312, 313, 322, 323
See application file for complete search history.

(56) References Cited

U.S. PATENT DOCUMENTS 4,840,029 A 6/1989 Sakurai et al.
2001/0009208 A1 * 7/2001 Fuhrmann et al. ..... 181/227
2007/0181360 A1 * 8/2007 Nakayama ..... 180/309
(Continued)

FOREIGN PATENT DOCUMENTS

DE 19500781 A1 * 8/1995 ..... F01N 7/08
EP 1031710 A1 * 8/2000 ..... F01N 7/04
(Continued)

OTHER PUBLICATIONS

Machine Translation of DE 19500781, Translated on Mar. 9, 2015.*

*Primary Examiner* — Patrick Maines
(74) *Attorney, Agent, or Firm* — Birch, Stewart, Kolasch & Birch, LLP

(57) ABSTRACT

A vehicle exhaust system structure capable of easily improving output performance in comparison with a two-cylinder internal combustion engine having the same displacement and outputting an appealing and excellent exhaust sound relating to the two-cylinder internal combustion engine, in a four-cylinder internal combustion engine or a three-cylinder internal combustion engine. An exhaust pipe structure for an internal combustion engine is configured such that exhaust pipes are respectively connected to four cylinders of a four-cylinder internal combustion engine, the two exhaust pipes of the exhaust pipes are formed as long exhaust pipes having a long pipe length while the other two exhaust pipes thereof are formed as short exhaust pipes having a short pipe length, and a difference in a pipe length between the long exhaust pipes and the short exhaust pipes is set to 150 mm or more.

8 Claims, 32 Drawing Sheets

(52) U.S. Cl.
CPC ..... *F01N2470/14* (2013.01); *F01N 2470/20* (2013.01); *F01N 2590/04* (2013.01)

(56) References Cited

U.S. PATENT DOCUMENTS

| | | | | |
|---|---|---|---|---|
| 2008/0190685 | A1 | 8/2008 | Nishino | |
| 2010/0192880 | A1 | 8/2010 | Koyanagi et al. | |
| 2014/0345259 | A1 * | 11/2014 | Yoshida et al. | 60/323 |

FOREIGN PATENT DOCUMENTS

| | | | | |
|---|---|---|---|---|
| EP | 1749989 | A1 | 2/2007 | |
| EP | 1772601 | A1 | 4/2007 | |
| EP | 2075424 | A1 | 7/2009 | |
| JP | 09317507 | A * | 12/1997 | F02D 13/02 |
| JP | 2010-174834 | A | 8/2010 | |
| JP | 4653064 | B2 | 3/2011 | |

* cited by examiner

EXHAUST PIPE STRUCTURE FOR INTERNAL COMBUSTION ENGINE

CROSS-REFERENCE TO RELATED APPLICATIONS

The present application claims priority under 35 USC 119 to Japanese Patent Application No. 2013-075434 filed Mar. 30, 2013 and Japanese Patent Application No. 2014-006522 filed Jan. 17, 2014 the entire contents of which are hereby incorporated by reference.

BACKGROUND OF THE INVENTION

1. Field of the Invention

The present invention relates to an exhaust pipe structure for an internal combustion engine. More particularly, to an exhaust pipe structure that focuses attention on an exhaust sound from an internal combustion engine mounted in a saddle-ride type vehicle or the like.

2. Description of Background Art

In a saddle-ride type vehicle disclosed in JP Patent No. 4653064, in the case of a vertical V-shaped four-cylinder internal combustion engine, two exhaust pipes extending rearwardly from two cylinders in one bank of right and left banks are configured to be coupled to a muffler after being collected to a collecting pipe on a rear side. Two exhaust pipes extending from two cylinders in the other bank have the same structure, and a communication pipe directing to a vehicle width direction communicates with right and left collecting pipes.

In the existing exhaust system for the four-cylinder internal combustion engine, in the whole area from a low rotational speed to a high rotational speed of engine speed, there is a frequent emphasis on obtaining target output characteristics. In the same way as that in JP Patent No. 4653064, countermeasures wherein the right and left collecting pipes are further partially allowed to communicate with each other or the like are taken to thereby obtain the required output characteristics by using a pulsation effect.

Recently, even in a vehicle mounted with a V-shaped four-cylinder internal combustion engine such as disclosed in JP Patent No. 4653064, there is a growing need for enjoining an exhaust sound. Technology to improve the exhaust sound has been desired.

Various kinds of internal combustion engines for a saddle-ride type vehicle have respective peculiar exhaust sound characteristics according to the types of the internal combustion engines. It is said that a favorable exhaust sound is typically different according to the types of the internal combustion engines.

For example, it is said that an exhaust sound with pulse feeling is typically favorable in a single cylinder internal combustion engine. In addition, it is said that in an inline four-cylinder internal combustion engine at a crank of 180 degrees, a high-pitched sound at high internal combustion engine speed is excellent because it is emotional.

However, in the inline four-cylinder internal combustion engine, it is necessary to achieve a high internal combustion engine speed in order to output the high-pitched sound. Depending on a rider, he/she may prefer the favorable exhaust sound in a normal area at low/middle rotational speed.

As the favorable exhaust sound at the low/middle rotational speed, an example is an exhaust sound from a large displacement V-shaped two-cylinder internal combustion engine mounted in a cruiser type motorcycle disclosed in JP-A No. 2010-174834. In the two-cylinder internal combustion engine having relatively large displacement, the peculiar thick exhaust sound having the pulse feeling is output.

On the other hand, in the two-cylinder internal combustion engine having the relatively large displacement, the exhaust sound in the normal area is favorable. However, because of properties of the internal combustion engine, output performance is not easily improved in comparison with the four-cylinder internal combustion engine having the same displacement.

SUMMARY AND OBJECTS OF THE INVENTION

The preset invention has been achieved in view of the above-mentioned circumstances. It is an object of an embodiment of the preset invention to provide an exhaust system structure for an internal combustion engine, capable of easily improving output performance in comparison with a two-cylinder internal combustion engine having the same displacement and outputting an appealing and excellent exhaust sound relating to the two-cylinder internal combustion engine, even in a four-cylinder internal combustion engine and a three-cylinder internal combustion engine other than the two-cylinder internal combustion engine.

In order to address the above-mentioned object, according to an embodiment of the preset invention, there is provided an exhaust pipe structure for an internal combustion engine wherein exhaust pipes are respectively connected to four cylinders of a four-cylinder internal combustion engine. The two exhaust pipes are formed as long exhaust pipes having a long pipe length while the other two exhaust pipes thereof are formed as short exhaust pipes having a short pipe length, and a difference in a pipe length between the long exhaust pipes and the short exhaust pipes is set to 150 mm or more.

According to an embodiment of the preset invention, the four-cylinder internal combustion engine is a V-shaped four-cylinder internal combustion engine, the two cylinders are respectively provided in respective banks, the exhaust pipes from the cylinders in the respective banks are collected in order to independently provide exhaust systems in the banks, and one of the two exhaust pipes collected in each exhaust system is formed as the long exhaust pipe while the other exhaust pipe is formed as the short exhaust pipe.

According to an embodiment of the preset invention, the V-shaped four-cylinder internal combustion engine is mounted in a saddle-ride type vehicle in such a manner that a crankshaft of the V-shaped four-cylinder internal combustion engine is arranged along a longitudinal direction of a vehicle, and the respective long exhaust pipes of the exhaust systems are configured to be connected to the cylinders that are arranged on a front side and to have bent portions formed below the V-shaped four-cylinder internal combustion engine.

According to an embodiment of the preset invention, the V-shaped four-cylinder internal combustion engine is mounted in the saddle-ride type vehicle in such a manner that the crankshaft of the V-shaped four-cylinder internal combustion engine is arranged along the longitudinal direction of the vehicle, the respective long exhaust pipes of the exhaust systems are connected to the cylinders that are arranged on a rear side, and the exhaust pipes connected to the cylinders that are arranged on the rear side are configured to extend forward of the exhaust pipes connected to the cylinders that are arranged on the front side, subsequently bent, and extend rearwardly.

According to an embodiment of the preset invention, the V-shaped four-cylinder internal combustion engine is the V-shaped four-cylinder internal combustion engine using a 360-degree crank, the exhaust pipes of the four exhaust pipes respectively connected to the four cylinders, that are connected to the two cylinders, are formed as the short exhaust pipes, the two cylinders being provided in the different exhaust systems and being configured such that a difference between crank angle phases during explosion is set to 270 degrees, and the exhaust pipes connected to the other two cylinders are formed as the long exhaust pipes.

According to an embodiment of the preset invention, the four-cylinder internal combustion engine is the V-shaped four-cylinder internal combustion engine, two cylinders are provided in respective banks, a first exhaust system is configured such that exhaust pipes from the two cylinders coupled to one crankpin are collected, a second exhaust system is configured such that exhaust pipes from the two cylinders coupled to another crankpin are collected, one exhaust pipe of the two exhaust pipes forming the first exhaust system is formed as a long exhaust pipe while another exhaust pipe is formed as a short exhaust pipe, and one exhaust pipe of the two exhaust pipes forming the second exhaust pipe is formed as a long exhaust pipe while another exhaust pipe is formed as a short exhaust pipe.

According to an embodiment of the preset invention, the V-shaped four-cylinder internal combustion engine is the V-shaped four-cylinder internal combustion engine using a 180-degree crank, the two exhaust pipes of the four exhaust pipes respectively connected to the four cylinders, that are connected to the two cylinders, are formed as the short exhaust pipes, the two cylinders being configured such that a difference between crank angle phases at explosion timing is set to 270 degrees, and the other two exhaust pipes are formed as the long exhaust pipes.

According to an embodiment of the preset invention, the V-shaped four-cylinder internal combustion engine is the V-shaped four-cylinder internal combustion engine using the 180-degree crank, the two exhaust pipes of the four exhaust pipes respectively connected to the four cylinders, that are connected to the two cylinders, are formed as the short exhaust pipes, the two cylinders being configured such that the difference between the crank angle phases at the explosion timing is set to 180 degrees, and the other two exhaust pipes are formed as the long exhaust pipes.

According to an embodiment of the preset invention, the four-cylinder internal combustion engine is an inline four-cylinder internal combustion engine using a 180-degree crank, a first exhaust system is configured such that two exhaust pipes connected to two cylinders of four cylinders are collected, the two cylinders being configured such that a difference between crank angle phases at explosion timing is set to 360 degrees, a second exhaust system is configured such that two exhaust pipes connected to the remaining two cylinders are collected, and one of the two exhaust pipes collected in each exhaust system is formed as a short exhaust pipe while the other exhaust pipe is formed as a long exhaust pipe.

According to an embodiment of the preset invention, the four-cylinder internal combustion engine is an inline four-cylinder internal combustion engine using a 90-degree crank, the inline four-cylinder internal combustion engine is provided with cylinders with respective crank angle phases at explosion timing during one cycle set to 0 degrees, 270 degrees, 450 degrees, and 540 degrees, a first exhaust system is configured such that exhaust pipes from the two cylinders of the cylinders are collected, the two cylinders being configured such that a difference between crank angle phases at explosion timing is set to 270 degrees, a second exhaust system is configured such that exhaust pipes from the remaining two cylinders are collected, the two cylinders being configured such that the difference between the crank angle phases at the explosion timing is set to 450 degrees, and one exhaust pipe of the two exhaust pipes collected in each exhaust system is formed as the short exhaust pipe, and the other exhaust pipe is formed as the long exhaust pipe.

According to an embodiment of the preset invention, the difference between the crank angle phases at the explosion timing in the two cylinders connected to the two short exhaust pipes is set to 270 degrees.

According to an embodiment of the preset invention, the inline four-cylinder internal combustion engine using the 90-degree crank is provided with the cylinders with the crank angle phases at the explosion timing during the one cycle set to 0 degrees, 270 degrees, 450 degrees, and 540 degrees, a first exhaust system is configured such that exhaust pipes from the two cylinders of the cylinders are collected, the two cylinders being configured such that the difference between the crank angle phases at the explosion timing is set to 270 degrees, a second exhaust system is configured such that exhaust pipes from the remaining two cylinders are collected, and the two exhaust pipes forming the first exhaust system are formed as the short exhaust pipes while the two exhaust pipes forming the second exhaust system are formed as the long exhaust pipes.

According to an embodiment of the preset invention, in an exhaust pipe structure for an internal combustion engine, exhaust pipes are respectively connected to three cylinders of a three-cylinder internal combustion engine, the two exhaust pipes of the exhaust pipes are formed as short exhaust pipes having a short pipe length while another exhaust pipe is formed as a long exhaust pipe having a long pipe length, and a difference in the pipe length between the long exhaust pipes and the short exhaust pipe is set to 150 mm or more.

According to an embodiment of the preset invention, the three-cylinder internal combustion engine is an inline three-cylinder internal combustion engine using a 120-degree crank, a difference in a crank angle phase between explosion intervals of the three cylinders is 240 degrees, an exhaust system with the two exhaust pipes of the exhaust pipes collected and an exhaust system composed of the remaining one exhaust pipe are respectively independently provided, one exhaust pipe of the two exhaust pipes in the exhaust system with the exhaust pipes collected is the short exhaust pipe while another exhaust pipe is the long exhaust pipe, and the exhaust pipe in the exhaust system composed of the one exhaust pipe is the short exhaust pipe.

According to an embodiment of the preset invention, the difference in the pipe length between the long exhaust pipes and the short exhaust pipe(s) is set to 175 mm or more.

According to an embodiment of the preset invention, the two exhaust pipes of the four exhaust pipes respectively connected to the four cylinders of the four-cylinder internal combustion engine are formed as the long exhaust pipes having the long pipe length while the other two exhaust pipes thereof are formed as the short exhaust pipes having the short pipe length, and the difference in the pipe length between the long exhaust pipes and the short exhaust pipes is set to 150 mm or more. Thereby, an explosion sound from each of the cylinders connected with the long exhaust pipes can be attenuated while being transmitted through the long exhaust pipes, and an amplitude of sound pressure of the explosion sound can be reduced. In an envelope of the exhaust sound for the two cylinders, that is, the cylinder connected with the long exhaust pipe and the cylinder connected with the short exhaust pipe, the sound pressure of the explosion sound from the cylinders connected with the short exhaust pipes creates a crest of the envelop; however, the sound pressure of the explosion sound from the cylinders connected with the long exhaust pipes does not create the crest of the envelop, and a wave cycle of the envelop forms a shape to be a cycle with respect to the sound pressure of the explosion sound from the cylinders connected to the short exhaust pipes. An interval of an exhaust sound felt as the explosion sound can be set to the same interval as an explosion interval of the cylinders connected with the short exhaust pipes, and in comparison with the exhaust pipes having equal length or a difference in pipe length of about 100 mm, a cycle of the explosion sound that can hear with ears is made longer. For this reason, an internal combustion engine speed with the exhaust sound heard as a pulse sound can be made higher than usual, and even in the four-cylinder internal combustion engine, output performance can be easily improved in comparison with the two-cylinder internal combustion engine having the same displacement, and an appealing and excellent exhaust sound relating to the two-cylinder internal combustion engine can be output.

According to an embodiment of the preset invention, the two cylinders are respectively provided in the respective banks of the V-shaped four-cylinder internal combustion engine, and one of the cylinders in each bank is formed as the long exhaust pipe while the other thereof is formed as the short exhaust pipe. Thereby, the exhaust sound with respect to each of the respective two cylinders can be heard as the exhaust sound for the one cylinder, and an explosion sound interval set, for example, in the V-shaped two-cylinder internal combustion engine, can be achieved. For this reason, it becomes possible to achieve both securement of comparatively high internal combustion engine output in the V-shaped four-cylinder internal combustion engine and generation of the appealing exhaust sound with the pulse feeling.

According to an embodiment of the preset invention, the long exhaust pipes are connected to the front cylinders of the vertical V-shaped four-cylinder internal combustion engine, and are formed to have the bent portions below the internal combustion engine. For this reason, it becomes possible to easily ensure the length of the long exhaust pipes and to make the bent portions ensuring the length of the exhaust pipes inconspicuous in consideration of the appearance quality of the saddle-ride type vehicle.

According to an embodiment of the preset invention, the long exhaust pipes are connected to the rear cylinders of the vertical V-shaped four-cylinder internal combustion engine, the length of each of the exhaust pipes extends forward of the exhaust pipes of the front cylinders, and the exhaust pipes are subsequently bent and extend rearwardly. For this reason, the length of each of the long exhaust pipes can be easily ensured.

According to an embodiment of the preset invention, the exhaust pipes connected to the two cylinders configured such that the difference between the crank angle phases during the explosion is set to 270 degrees are formed as the short exhaust pipes, and the exhaust pipes connected to the other two cylinders are formed as the long exhaust pipes. Thereby, a crank angle phase interval felt as the explosion sound is set to 270 degrees, 450 degrees, 270 degree, and the like, an explosion is allowed to hear as if there are explosions at irregular intervals, and the cycle can be made to be the same cycle as the cycle of the explosion sound at the explosion timing in the V-shaped two-cylinder internal combustion engine at a bank angle of 90 degrees. For this reason, in the V-shaped four-cylinder internal combustion engine, the output performance can be easily improved in comparison with the two-cylinder internal combustion engine having the same displacement, and an appealing and harmonious exhaust sound with the excellent pulse feeling relating to the two-cylinder internal combustion engine can be output.

According to an embodiment of the preset invention, in the V-shaped four-cylinder internal combustion engine, the respective exhaust systems are provided with respect to the respective crankpins, and one exhaust pipe in the exhaust systems is formed as the long exhaust pipe while another exhaust pipe is formed as the short exhaust pipe. Thereby, the cycle felt as the explosion sound can be made longer, the output performance can be easily improved in comparison with the two-cylinder internal combustion engine having the same displacement, and the appealing and harmonious exhaust sound with an excellent pulse feeling relating to the two-cylinder internal combustion engine can be output. Further, the exhaust pipes connected to the two cylinders coupled to the same crankpin are formed into one exhaust system. For this reason, the exhaust pipes with respect to each of the exhaust systems can be provided on the same side, and the exhaust pipe structure can be simplified.

According to an embodiment of the preset invention, in the V-shaped four-cylinder internal combustion engine using the 180-degree crank, the two exhaust pipes with the difference between the crank angle phases at the explosion timing set to 270 degrees are formed as the short exhaust pipes, and the other exhaust pipes are formed as the long exhaust pipes. For this reason, the cycle felt as the explosion sound from the V-shaped four-cylinder internal combustion engine using the 180-degree crank can be made to be the same cycle as the explosion cycle of the V-shaped two-cylinder internal combustion engine at the bank angle of 90 degrees.

According to an embodiment of the preset invention, in the V-shaped four-cylinder internal combustion engine using the 180-degree crank, the two exhaust pipes with the difference between the crank angle phases at the explosion timing set to 180 degrees are formed as the short exhaust pipes while the others are formed as the long exhaust pipes. For this reason, the cycle felt as the explosion sound from the V-shaped four-cylinder internal combustion engine using the 180-degree crank can be brought close to the explosion cycle of the V-shaped two-cylinder internal combustion engine at the bank angle of 90 degrees.

According to an embodiment of the preset invention, in the inline four-cylinder internal combustion engine using the 180-degree crank, the exhaust pipes connected to the two cylinders with the difference between the crank angle phases at the explosion timing set to 360 degrees are collected to form the first exhaust system, the exhaust pipes connected to the other two cylinders are collected to form the second exhaust system, one of the exhaust pipes in each exhaust system is formed as the long exhaust pipe, and the other thereof is formed as the short exhaust pipe. Thereby, the interval of the exhaust sound from the cylinders felt as the explosion sound is set to the same interval as the explosion interval of the cylinders connected to the short exhaust pipes. For this reason, in comparison with the exhaust pipes having equal pipe length or the difference in the pipe length of about 100 mm, the cycle of the explosion sound that can hear with ears is made longer, and the internal combustion engine speed with the exhaust sound heard as the pulse sound can be made higher than usual. As a result, in the inline four-cylinder internal combustion engine, the output performance can be easily improved in comparison with the two-cylinder internal combustion engine having the same displacement, and the appealing and harmonious exhaust sound with the excellent pulse feeling relating to the two-cylinder internal combustion engine can be output.

Further, the exhaust sound from the two cylinders on both sides of the inline four-cylinder internal combustion engine at the crank of 180 degrees and from the two cylinders therebetween can be heard as the exhaust sound for the one cylinder. For this reason, the explosion interval set, for example, in a juxtaposed two-cylinder internal combustion engine at the crank of 180 degrees can be achieved. Therefore, it becomes possible to achieve both comparatively high output and the appealing exhaust sound.

According to an embodiment of the preset invention, in the inline four-cylinder internal combustion engine using the 90-degree crank, the exhaust pipes from the two cylinders with the difference between the crank angle phases at the explosion timing set to 270 degrees are collected to form the first exhaust system, the exhaust pipes from the other two cylinders are collected to form the second exhaust system, one exhaust pipe in each exhaust system is formed as the long exhaust pipe, and the other exhaust pipe is formed as the short exhaust pipe. Thereby, the cycle felt as the explosion sound can be lengthened. For this reason, in the inline four-cylinder internal combustion engine using the 90-degree crank, the output performance can be easily improved in comparison with the two-cylinder internal combustion engine having the same displacement, and the appealing and excellent exhaust sound relating to the two-cylinder internal combustion engine can be output.

According to an embodiment of the preset invention, the two cylinders with the difference between the crank angle phases at the explosion timing set to 270 degrees are formed as the short exhaust pipes. Thereby, even in the inline four-cylinder internal combustion engine using the 90-degree crank, the cycle felt as the explosion sound can be made to be the same cycle as the explosion cycle of the V-shaped two-cylinder internal combustion engine at the bank angle of 90 degrees.

According to an embodiment of the preset invention, the exhaust pipes from the two cylinders with the difference between the crank angle phases at the explosion timing set to 270 degrees are collected to form the first exhaust system, these exhaust pipes are formed as the short pipes, and the exhaust pipes in the second exhaust system are formed as the long exhaust pipes. For this reason, even in the inline four-cylinder internal combustion engine at the bank angle of 90 degrees, the cycle felt as the explosion sound can be made to be the same cycle as the explosion cycle of the V-shaped two-cylinder internal combustion engine at the bank angle of 90 degrees.

According to an embodiment of the preset invention, the two exhaust pipes of the three exhaust pipes of the inline three-cylinder internal combustion engine are formed as the short exhaust pipes, another exhaust pipe is formed as the long exhaust pipe, and the difference in the pipe length between the long exhaust pipes and the short exhaust pipe is set to 150 mm or more. Thereby, the cycle felt as the explosion sound can be lengthened. For this reason, in the inline three-cylinder internal combustion engine, the output performance can be easily improved in comparison with the two-cylinder internal combustion engine having the same displacement, and the appealing and excellent exhaust sound with the pulse feeling relating to the two-cylinder internal combustion engine can be output.

According to an embodiment of the preset invention, even in the inline three-cylinder internal combustion engine using the 120-degree crank, the cycle felt as the explosion sound is brought close to the explosion cycle of the V-shaped two-cylinder internal combustion engine at the bank angle of 90 degrees.

According to an embodiment of the preset invention, if the difference in the pipe length between the exhaust pipes is 175 mm or more, the explosion sound from the cylinder connected with the long exhaust pipe is further attenuated. For this reason, the explosion in the two cylinders can be certainly heard as the explosion interval for the one cylinder. Further, the amplitude difference in the exhaust sound pressure is increased, the depth of the sound is increased, and the more appealing exhaust sound can be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a first embodiment applied with the present invention will be described based on FIG. 1 to FIG. 11.

Figure 1:
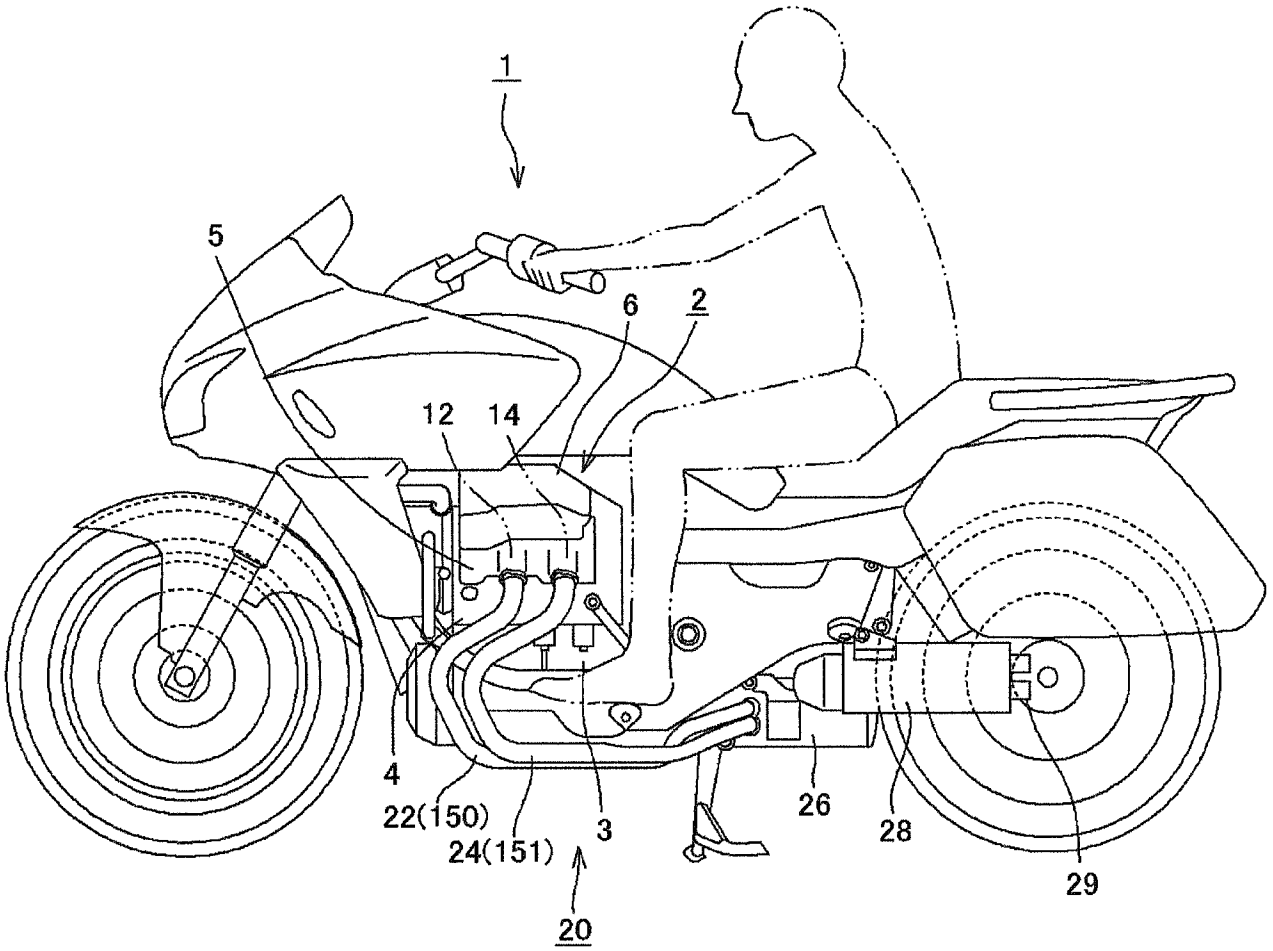
FIG. 1 is a left side view of a motorcycle including an exhaust pipe structure for a V-shaped four-cylinder internal combustion engine according to a first embodiment applied with the present invention.

FIG. 1 shows a left side view of a motorcycle 1 as a saddle-ride type vehicle including an exhaust pipe structure for a four-cylinder internal combustion engine according to the first embodiment. Note that an advance direction of the motorcycle 1 is defined as a forward direction, and back and forth, and right and left, are defined with reference to a posture directed to the forward direction.

The four-cylinder internal combustion engine mounted in the motorcycle 1 is a V-shaped four-cylinder internal combustion engine 2 using a 360-degree crank at a bank angle of 90 degrees, and is mounted such that a crankshaft 7 is arranged along a longitudinal direction of a vehicle. In the V-shaped four-cylinder internal combustion engine 2, a crankcase 3, a cylinder block 4, and a cylinder head 5 are sequentially piled up and integrally fastened to each other, and a head cover 6 is attached to cover the cylinder head 5 from above.

Figure 2:
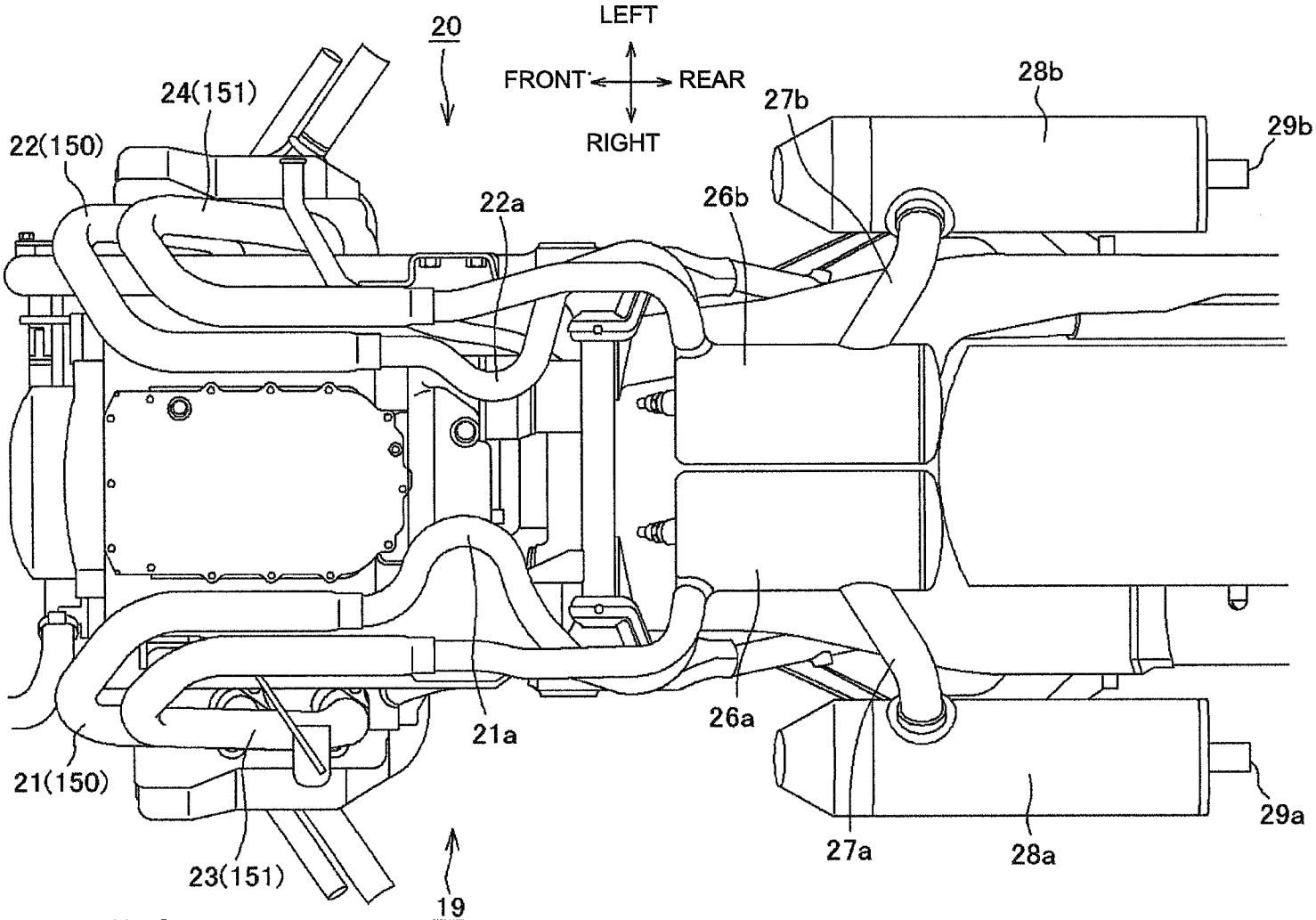
FIG. 2 is a bottom view of main sections in FIG. 1.
Figure 3:
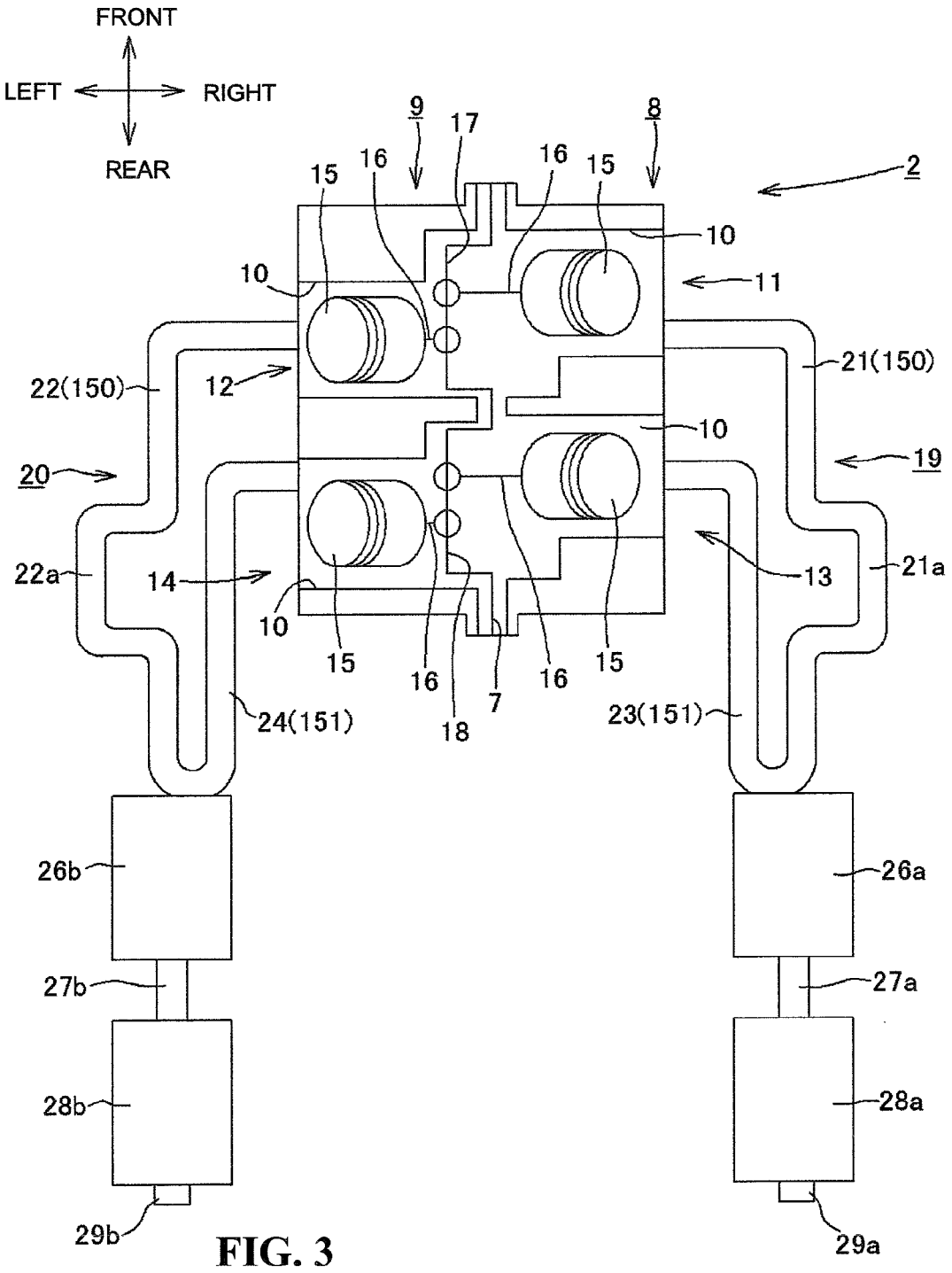
FIG. 3 is a pattern diagram showing the V-shaped four-cylinder internal combustion engine and the exhaust pipe structure for the same in FIG. 1.

FIG. 2 shows a bottom view with the motorcycle 1 viewed from below, and FIG. 3 shows a pattern diagram of the V-shaped four-cylinder internal combustion engine 2 and the exhaust pipe structure for the same according to the embodiment. As shown in FIG. 3, the V-shaped four-cylinder internal combustion engine 2 includes a right bank 8 and a left bank 9 at a bank angle of 90 degrees on right and left sides. Respective two cylinders are provided in the right bank 8 and the left bank 9, that is, a first cylinder 11 is provided on a front side of the right bank 8, a third cylinder 13 is provided on a rear side of the right bank 8, a second cylinder 12 is provided on a front side of the left bank 9, and a fourth cylinder 14 is provided on a rear side of the left bank 9. Connecting rods 16 of the first front cylinder 11 and the second front cylinder 12 are coupled to a first crankpin 17, connecting rods 16 of the third rear cylinder 13 and the fourth rear cylinder 14 are coupled to a second crankpin 18, and a crank angle between the first crankpin 17 and the second crankpin 18 is set to 360 degrees. A first exhaust pipe 21, a second exhaust pipe 22, a third exhaust pipe 23, and a fourth exhaust pipe 24 are respectively connected to the first cylinder 11, the second cylinder 12, the third cylinder 13, and the fourth cylinder 14.

As shown in FIG. 1 to FIG. 3, the first exhaust pipe 21 and the third exhaust pipe 23 that are provided on a right side of the vehicle are curved and extend rearwardly alter directed forward from below, connected to each other so that the first exhaust pipe 21 and the third exhaust pipe 23 are collected to a chamber 26*a* provided in a lower back portion of the vehicle, and connected with a muffler 28*a* through a connecting pipe 27*a* from the chamber 26*a*. A rear portion of the muffler 28*a* is provided with a tailpipe 29*a* from which exhaust gas in the muffler 28*a* is released into the atmosphere. A right exhaust system 19 includes the first exhaust pipe 21, the third exhaust pipe 23, the chamber 26*a*, the connecting pipe 27*a*, the muffler 28*a*, and the tailpipe 29*a*.

The second exhaust pipe 22 and the fourth exhaust pipe 24 that are provided on a left side of the vehicle are curved and extend rearwardly after being directed forward from below, connected to each other so that the second exhaust pipe 22 and the fourth exhaust pipe 24 are collected to a chamber 26*b* provided in the lower back portion of the vehicle, and connected with a muffler 28*b* through a connecting pipe 27*b* from the chamber 26*b*. A rear portion of the muffler 28*b* is provided with a tailpipe 29*b* from which exhaust gas in the muffler 28*b* is released into the atmosphere. A left exhaust system 20 includes the second exhaust pipe 22, the fourth exhaust pipe 24, the chamber 26*b*, the connecting pipe 27*b*, the muffler 28*b*, and the tailpipe 29*b*.

As shown in FIG. 2, the first exhaust pipe 21 connected to the first front cylinder 11 in the right bank 8 and the second exhaust pipe 22 connected to the second front cylinder 12 in the left bank 9 are formed with bent portions 21*a*, 22*a* that are respectively bent toward an inner side of the vehicle, in a lower portion of the vehicle and below the V-shaped four-cylinder internal combustion engine. Since the first exhaust pipe 21 and the second exhaust pipe 22 are formed with the bent portions 21*a*, 21*b*, the first exhaust pipe 21 and the second exhaust pipe 22 are formed as long exhaust pipes 150 large in length, and the third exhaust pipe 23 and the fourth exhaust pipe 24 are formed as short exhaust pipes 151 small in length in comparison with the long exhaust pipes 150.

In the embodiment, a difference in a pipe length between the first exhaust pipe 21 and the third exhaust pipe 23 and a difference in a pipe length between the second exhaust pipe 22 and the fourth exhaust pipe 24, that is, a difference in a pipe length between the long exhaust pipes 150 and the short exhaust pipes 151, is set to be 175 mm. In the same way as that in the embodiment, with regard to the difference in the pipe length between the long exhaust pipes 150 and the short exhaust pipes 151, 175 mm or more is more effective; however, if the difference in the pipe length is 150 mm or more, an effect is seen. Also, it is more favorable if the difference in the pipe length between the long exhaust pipes 150 and the short exhaust pipes 151 is set to about 300 mm.

Hereinafter, technology contents explaining that desired effects of the embodiment exhibit, and an experimental result and an experimental effect attesting that effects exhibit will be described.

An embodiment is to provide an exhaust pipe structure for a four-cylinder internal combustion engine capable of outputting an appealing and harmonious exhaust sound with a pulse feeling relating to a two-cylinder internal combustion engine while easily obtaining output characteristics equivalent to or greater than those in the two-cylinder internal combustion engine having the same displacement, in the four-cylinder internal combustion engine.

How to actually output the exhaust sound from the inline four-cylinder internal combustion engine and a V-shaped two-cylinder internal combustion engine in a normal area at low/middle rotational speed will be described. For example, when cruise traveling is performed while the internal combustion engine is operated at 2,500 rpm, the exhaust sound from the inline four-cylinder internal combustion engine and the exhaust sound from the V-shaped two-cylinder internal combustion engine are separately heard as a continuous sound and a sound having the pulse feeling (discontinuous sound).

When the same sound is played at a certain interval with respect to someone's ears, there is a limit value that can hear respective sounds separately. This is defined as "resolution performance of the cars" (hereinafter, abbreviated to the resolution performance).

The reason why the exhaust sound from the internal combustion engine is differently heard as the continuous sound and the discontinuous sound is caused by the explosion interval of the internal combustion engine and someone's resolution performance. That is, if the explosion interval is short in comparison with the resolution performance, the explosion sounds cannot be differently heard one by one and are heard as the continuous sound, and if the explosion interval is long in comparison with the resolution performance, the explosion sounds can be differently heard one by one and are heard as the discontinuous sound. Since the cylinder explosion interval in the single cylinder internal combustion engine and the V-shaped two-cylinder internal combustion engine is long in comparison with the resolution performance, the explosion sound is felt as the sound having the pulse feeling. That is, in order to output the sound having the pulse feeling, it becomes very important element that the explosion sounds from the internal combustion engine can be differently heard one by one.

The inventors focused attention on the explosion interval of each of the cylinders in a plurality of internal combustion engines having a different number of cylinders and different crank phase angles, and performed experiments on a relationship between engine speed and the explosion interval with respect to various kinds of internal combustion engines. Then, the result shown in FIG. 4 was obtained.

Figure 4:
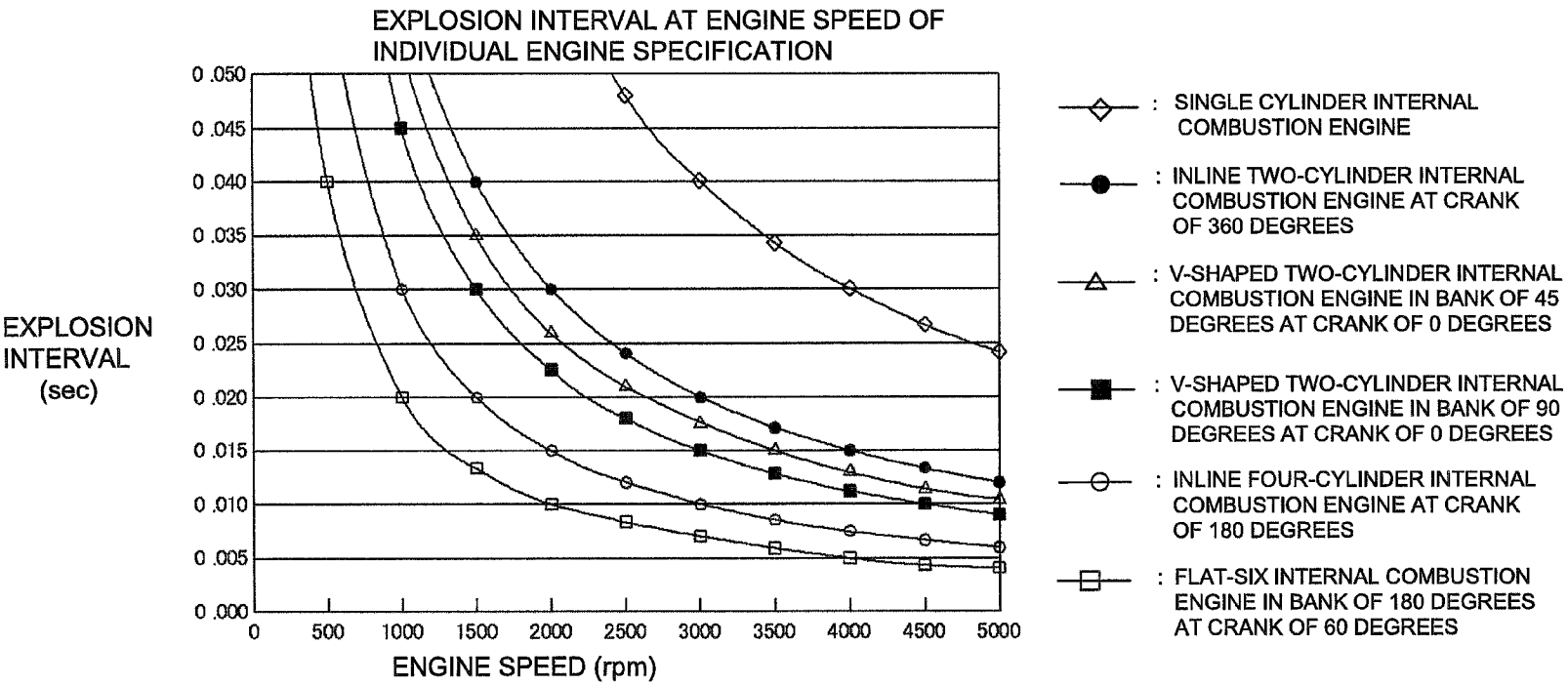
FIG. 4 is a graph showing an explosion interval of the internal combustion engine with respect to engine speed of various kinds of internal combustion engines.

A graph in FIG. 4 shows that the test was conducted on each of the single cylinder internal combustion engine, the inline two-cylinder internal combustion engine at the crank of 360 degrees, the V-shaped two-cylinder internal combustion engine in the bank of 45 degrees and the crank of 0 degrees (VR two-cylinder internal combustion engine), the V-shaped two-cylinder internal combustion engine in the bank of 90 degrees and at the crank of 0 degrees, the inline four-cylinder internal combustion engine at the crank of 180 degrees, and a horizontally opposed six-cylinder internal combustion engine at the crank of 60 degrees (flat-six internal combustion engine in the bank of 180 degrees at the crank of 60 degrees), and time from explosion in a certain cylinder to explosion in a cylinder with explosion performed next is plotted with respect to the engine speed.

In the case of a single cylinder internal combustion engine, a single explosion is performed every time a crank is rotated at 720 degrees. In the case of an inline four-cylinder internal combustion engine using a 180-degree crank, as shown in the schematic view in FIG. 22, the explosion at equal intervals is performed at each of the explosion intervals of 180 degrees. In the case of the internal combustion engine as a multiple cylinder internal combustion engine not performing the explosion at the equal intervals, the explosion interval between the cylinders with the shortest explosion interval is plotted as a representative value.

As a result of the above-mentioned tests, it was found that there is a clear difference in the explosion interval between the inline four-cylinder internal combustion engine and the VR two-cylinder internal combustion engine at 2,500 rpm in the normal area at low/middle rotational speed. That is, it was found that in the engine speed, the explosion interval in the VR two-cylinder internal combustion engine is about 0.021 sec (21 m/sec), the explosion interval in the inline four-cylinder internal combustion engine using the 180-degree crank is about 0.012 sec (12 m/sec), the explosion interval in the VR two-cylinder internal combustion engine is long, and compared with that, the explosion interval in the inline four-cylinder internal combustion engine using the 180-degree crank is short.

Generally, it is said that the resolution performance ranges from about 30 Hz to about 70 Hz. As a result of the study, the inventors found that the resolution performance in the exhaust sound from the internal combustion engine is 15 m/sec (52.5 Hz).

In a first embodiment, the representative engine speed in the normal area of a category of a cruiser is defined as 2,500 rpm, and a target is set such that the exhaust sound heard as the explosion sound at the corresponding engine speed of the internal combustion engine is heard with an interval of 15 msec or more.

In the normal four-cylinder internal combustion engine such as the inline four-cylinder internal combustion engine and the V-shaped four-cylinder internal combustion engine, the explosion interval at the engine speed of 2,500 rpm is below 15 msec, and further, the sound pressures of the explosion sound in all the four cylinders are equal. Therefore, the explosion interval is short in comparison with the resolution performance, and the explosion sound cannot be heard as the exhaust sound having the pulse feeling.

In the exhaust pipe structure for the V-shaped four-cylinder internal combustion engine according to the embodiment, the first exhaust pipe 21 and the third exhaust pipe 23 of the four exhaust pipes 21, 22, 23, 24 connected to the first cylinder 11, the second cylinder 12, the third cylinder 13 and the fourth cylinder 14, are collected to Corm the right exhaust system 19, the second exhaust pipe 22 and the fourth exhaust pipe 24 are collected to form the left exhaust system 20, the first exhaust pipe 21 and the second exhaust pipe 22 as some of the exhaust pipes of the collected two exhaust pipes 21 and 23, and 22 and 24 are formed as the long exhaust pipes 150, and the third exhaust pipe 23 and the fourth exhaust pipe 24 as the other exhaust pipes are formed as the short exhaust pipes 151. Thereby, the explosion sounds from the first cylinder 11 and the second cylinder 12 that are connected to the long exhaust pipes 150 are attenuated in the exhaust pipes, and only the exhaust sounds from the third cylinder 13 and the fourth cylinder 14 that are connected to the short exhaust pipes 151 are made to be heard as the explosion sounds. Thus, it is achieved that the interval of the exhaust sound to be heard is set to the above-described target value of 15 msec or more.

In the exhaust pipe structure for the V-shaped four-cylinder internal combustion engine 2 according to the embodiment, the internal combustion engine speed is set to 2,500 rpm, the second exhaust pipe 22 in the left exhaust system 20 is formed as the long exhaust pipe 150, the fourth exhaust pipe 24 in the left exhaust system 20 is formed as the short exhaust pipe 151, the difference in the pipe length between the long exhaust pipe 150 and the short exhaust pipe 151 is set to 100 mm, 150 mm, 175 mm, and 200 mm, and the sound pressure of the exhaust sound from the tailpipe 29*b* with respect to each difference in the pipe length between the exhaust pipes is measured. FIG. 5, and FIG. 8 to FIG. 10 show the sound pressure higher than the atmospheric pressure of the hourly sound pressure amplitude with respect to each difference in the pipe length between the exhaust pipes. Also, since the sound pressure is a vibration and a value thereof is hourly greatly changed, the envelope for the sound pressure amplitude is illustrated in order to show a slow change of the sound pressure amplitude.

Figure 5:
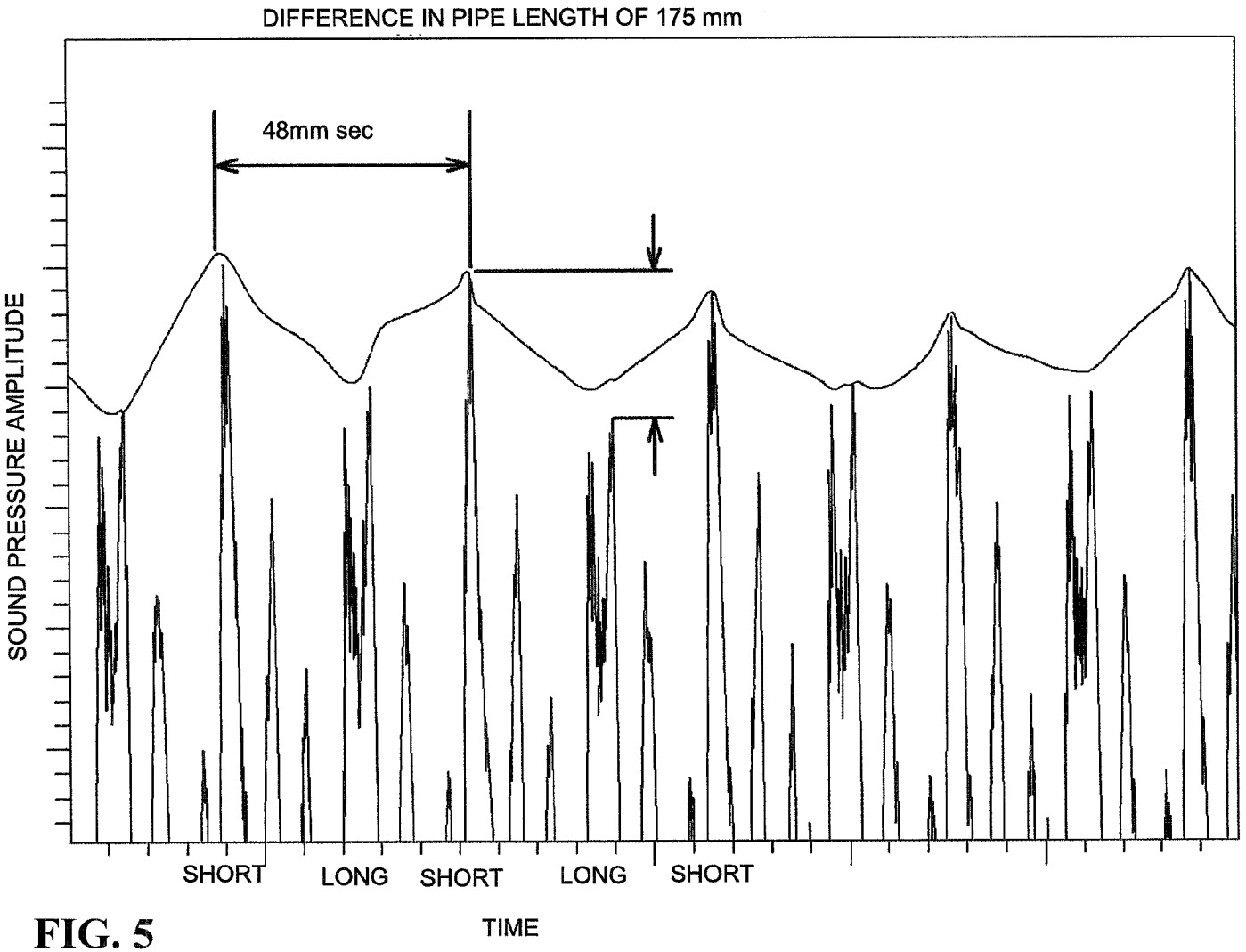
FIG. 5 is a chart showing an hourly sound pressure amplitude and an envelope for the same of a left exhaust system when a difference in a pipe length between long exhaust pipes and short exhaust pipes is 175 mm.

FIG. 5 shows the sound pressure amplitude of the exhaust sound and the envelope thereof in the left exhaust system 20 with the difference in the pipe length between the long exhaust pipes 150 and the short exhaust pipes 151 set to 175 mm shown in the first embodiment. Note that with regard to a sound pressure waveform, a height of a horizontal axis is defined as the atmospheric pressure, and only a positive pressure area is shown. Since the sound pressure of the explosion sound of the second cylinder 12 connected to the long exhaust pipe 150 is not attenuated, the large amplitude of the sound pressure of the explosion sound from the fourth cylinder 14 connected with the fourth exhaust pipe 24 as the short exhaust pipe 151 is kept (a peak represented as short in the chart). On the other hand, the sound pressure of the explosion sound from the second cylinder 12 connected with the second exhaust pipe 22 as the long exhaust pipe 150 is attenuated while being transmitted through the long exhaust pipe, the amplitude thereof is reduced in comparison with the vibration of the fourth cylinder 14 connected with the short exhaust pipe 151 (a peak represented as long in the chart), and the difference in the amplitude therebetween is 23% with respect to the amplitude of the fourth cylinder 14 connected with the short exhaust pipe 151.

Also, when paying attention to the envelop, as described above, since the sound pressure of the fourth cylinder 14 connected with the long exhaust pipe 150 is attenuated by 23%, in the envelop of the sound pressure of the exhaust sound for the two cylinders, the sound pressure of the exhaust sound from the fourth cylinder 14 connected to the short exhaust pipe 151 creates the crest of the envelop. However, the sound pressure of the exhaust sound from the second cylinder 12 connected to the long exhaust pipe 150 does not create the crest of the envelop, and the wave cycle of the envelop forms the shape to be the cycle with respect to the sound pressure of the exhaust sound from the fourth cylinder 14 connected to the short exhaust pipe 151 (the sound pressure of the exhaust sound from the second cylinder 12 connected to the long exhaust pipe 150 is made in the masking state by the sound pressure of the loud exhaust sound from the fourth cylinder 14 connected to the short exhaust pipe 151). Therefore, in most cases, only the explosion sound from the fourth cylinder 14 connected with the short exhaust pipe 151 is felt as the explosion sound. Since the interval of the explosion sound felt as the explosion sound is the same as the interval of the explosion sound from the fourth cylinder 14, the cycle of the explosion sound felt as the explosion sound is longer than the case in the exhaust system with the exhaust pipes having the equal pipe length, and in the embodiment, as to the interval thereof, a value of 48 msec was obtained.

Figure 6:
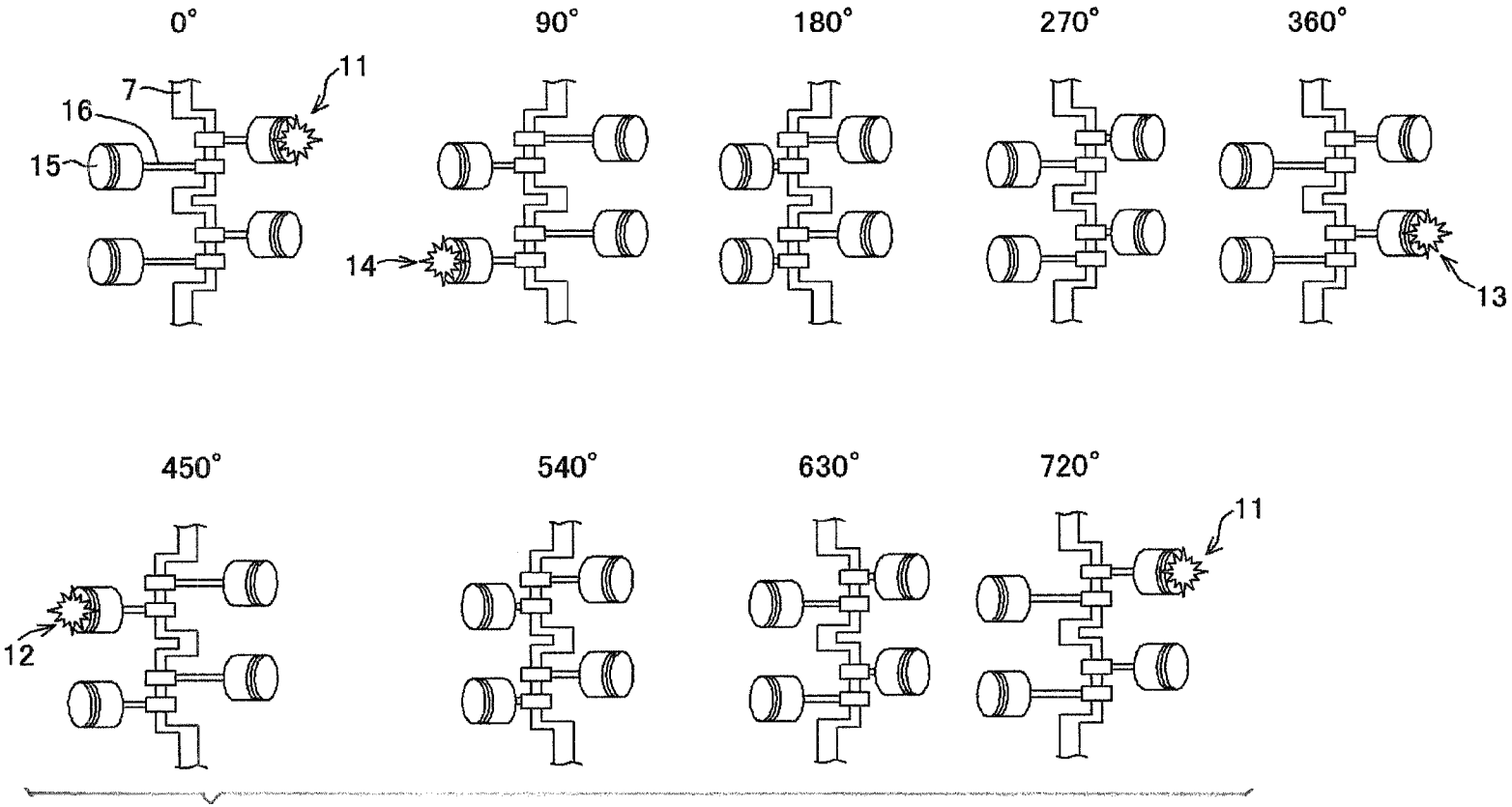
FIG. 6 is a schematic view showing explosion timing in respective cylinders with respect to rotation of a crank of the V-shaped four-cylinder internal combustion engine using a 360-degree crank at a bank angle of 90 degrees.

FIG. 6 shows explosion timing in the respective cylinders with respect to rotation of a crank of the V-shaped four-cylinder internal combustion engine using a 360-degree crank at a bank angle of 90 degrees according to the embodiment. When the explosion timing in the first cylinder 11 is set in the crank angle phase of 0 degrees, in the present V-shaped four-cylinder internal combustion engine 2, the explosion occurs in each of crank phases of 0 degrees, 90 degrees, 360 degrees, and 450 degrees while the crankshaft 7 is rotated by 720 degrees. When there is no difference in pipe length between the long exhaust pipes 150 and the short exhaust pipes 151, the explosion sound is felt in each of the crank phases of 0 degrees, 90 degrees, 360 degrees, and 450 degrees while the crankshaft 7 is rotated by 720 degrees, and the intervals with the explosion sound felt are set to the intervals of 90 degrees, 270 degrees, 90 degrees, and 270 degrees.

Figure 7:
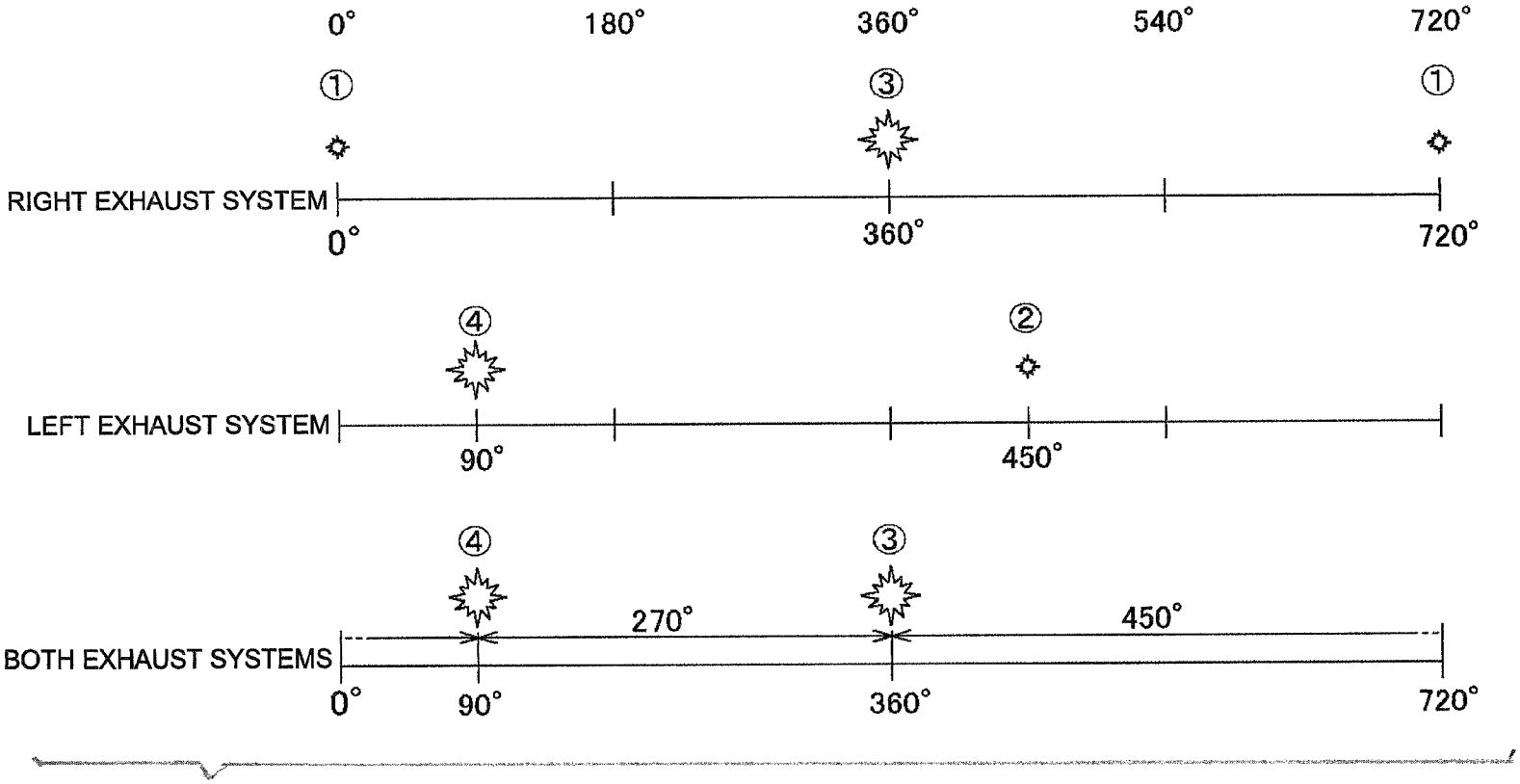
FIG. 7 is a diagram showing timing heard as an explosion sound caused by the exhaust pipe structure for the V-shaped four-cylinder internal combustion engine using the 360-degree crank at the bank angle of 90 degrees.

FIG. 7 illustrates the explosion timing when the explosion timing in the first cylinder 11 is set to the crank angle phase of 0 degrees, in the right exhaust system 19, the left exhaust system 20 and both the exhaust systems in the case where the difference in the pipe length between the long exhaust pipes 150 and the short exhaust pipes 151 set to 175 mm. Note that each explosion timing in the cylinders connected to the long exhaust pipes 150, not felt as the explosion sound, is indicated by a small explosion mark, each explosion timing in the cylinders connected to the short exhaust pipes 151, felt as the explosion sound, is indicated by a large explosion mark, each cylinder number is indicated above each explosion mark, and the crank angle phase of each explosion timing is indicated below each explosion mark (the same shall apply hereinafter in an explosion timing diagram with respect to each exhaust system).

As shown in FIG. 7, in the right exhaust system 19, the explosion in the first cylinder 11 connected to the first exhaust pipe 21 as the long exhaust pipe 150 is not felt as the explosion sound (although the explosion therein is heard as a simple sound, the explosion therein is not heard as the crest (peak) of the exhaust sound having peaks and dips), and the explosion in the third cylinder 13 connected to the third exhaust pipe 23 as the short exhaust pipe 151 is felt as the explosion sound and is felt as the explosion sound only in the crank angle phase of 360 degrees.

In the left exhaust system 20, the explosion in the second cylinder 12 connected to the second exhaust pipe 22 as the long exhaust pipe 150 is not felt as the explosion sound, and the explosion in the forth cylinder 14 connected to the fourth exhaust pipe 24 as the short exhaust pipe 151 is felt as the explosion sound and is felt as the explosion sound only in the crank angle phase of 90 degrees.

When combining both the right exhaust system 19 and the left exhaust system 20 with each other, only the explosion in each of the third cylinder 13 and the fourth cylinder 14 is felt as the explosion sound. Therefore, during rotation of the crankshaft 7 at 720 degrees, the explosion is felt as the explosion sound only when the crank angle phase is 90 degrees and 360 degrees, and the interval felt as the explosion sound is lengthened in comparison with the exhaust system including the exhaust pipes having the equal pipe length. Further, since the interval of the crank angle phase felt as the explosion sound is set to 270 degrees, 450 degree, 270 degrees, and the like, the explosion is heard as if the explosions occur at irregular intervals, and the cycle of the explosion sound becomes the same cycle as the intervals of 270 degrees, 450 degrees, 270 degrees, and the like as the internal of the explosion sound at the explosion timing of the V-shaped two-cylinder internal combustion engine at the bank angle of 90 degrees.

Also, the crank phase felt as the explosion sound in the embodiment is 90 degrees and 360 degrees, and as described above, the interval felt as the explosion sound only in the left exhaust system 20 is 48 m/sec. Therefore, when the interval felt as the explosion sound in the left exhaust system 20 and the interval felt as the explosion sound in the right exhaust system 19 overlap with each other, the shorter interval of the intervals felt as the explosion sound is 18 msec, and the longer interval thereof is 30 msec. These intervals are longer than 15 msec in the resolution performance. Thereby, the explosion sound from the V-shaped four-cylinder internal combustion engine 2 in the embodiment with the difference in the pipe length set to 175 mm can be recognized as the pulse sound. For this reason, in the V-shaped four-cylinder internal combustion engine, the output performance can be easily improved in comparison with the two-cylinder internal combustion engine having the same displacement, and the appealing and harmonious exhaust sound with the excellent pulse feeling relating to the two-cylinder internal combustion engine can be output.

Figure 8:
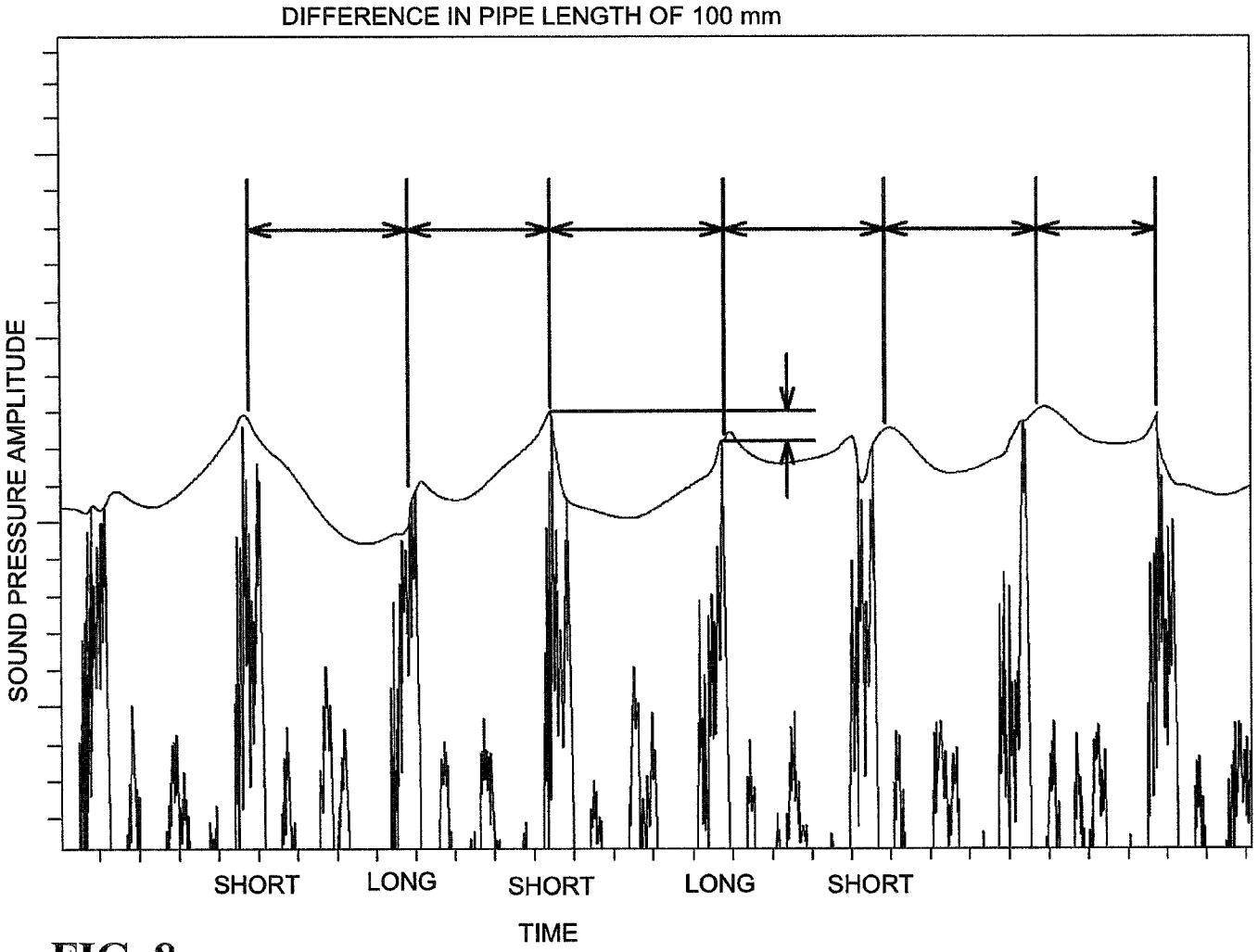
FIG. 8 is a chart showing the hourly sound pressure amplitude and the envelope for the same of the left exhaust system when the difference in the pipe length between the long exhaust pipes and the short exhaust pipes is 100 mm.

Next, the exhaust system with the difference in the pipe length between the long exhaust pipes 150 and the short exhaust pipes 151 set to 100 mm will be described based on FIG. 8. FIG. 8 shows the sound pressure amplitude of the exhaust sound and the envelope thereof of the left exhaust system 20 with the difference in the pipe length between the long exhaust pipes 150 and the short exhaust pipes 151 set to 100 mm. Since the sound pressure of the explosion sound from the fourth cylinder 14 connected with the fourth exhaust pipe 24 as the short exhaust pipe 151 is not attenuated, the large amplitude thereof is kept (a peak represented as short in the chart). On the other hand, the sound pressure of the explosion sound from the second cylinder 12 connected with the second exhaust pipe 22 as the long exhaust pipe 150 is attenuated while being transmitted through the long exhaust pipe, and the amplitude thereof is reduced in comparison with the vibration of the fourth exhaust pipe 24 (a peak represented as long in the chart). However, the difference in the sound pressure amplitude therebetween is not so great, and is 5% with respect to the sound pressure amplitude of the fourth cylinder 14 connected to the short exhaust pipe 151.

Also, when paying attention to the envelop, as described above, the sound pressure of the second cylinder 12 connected to the long exhaust pipe 150 is attenuated by 5% only. Therefore, with regard to the crest of the envelop, the sound pressure amplitude of the explosion sound from the second cylinder 12 connected to the long exhaust pipe 150 and the sound pressure amplitude of the explosion sound from the fourth cylinder 14 connected to the short exhaust pipe 151 respectively create crests, and the interval heard as the explosion sound cannot be lengthened.

Further, when overlapping the explosion sound in the right exhaust system 19, the explosion sounds from all the four cylinders are felt as the explosion sounds. Thereby, the shortest interval of the intervals heard as the explosion sounds is 6 m/see, and is the interval shorter than 15 msec in the resolution performance. As a result, someone's ear cannot feel as a pulse sound, and in the exhaust pipe structure with the difference in the pipe length between the long exhaust pipes 150 and the short exhaust pipes 151 set to 100 mm, a desired effect cannot be obtained.

Figure 9:
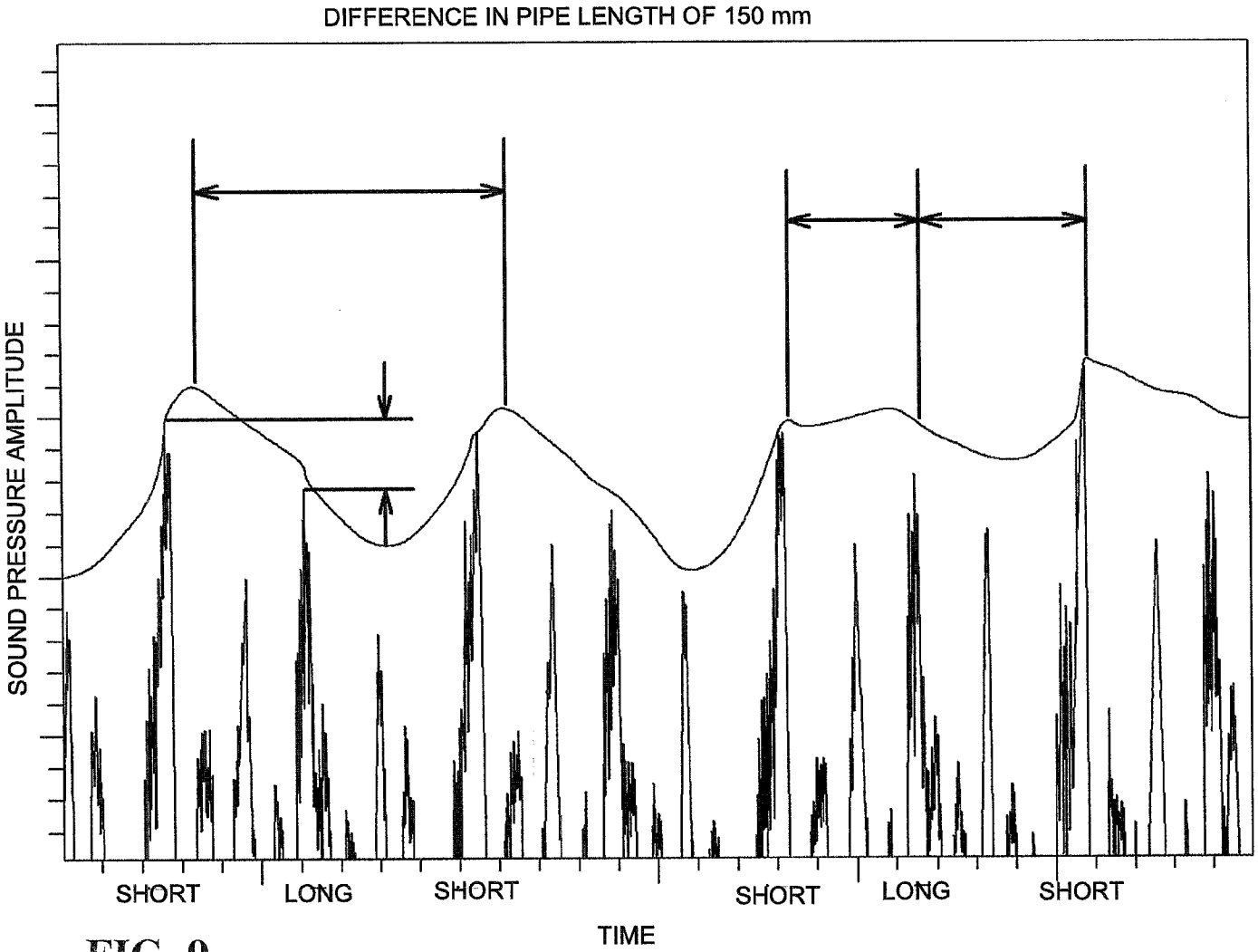
FIG. 9 is a chart showing the hourly sound pressure amplitude and the envelope for the same of the left exhaust system when the difference in the pipe length between the long exhaust pipes and the short exhaust pipes is 150 mm.

Next, the exhaust system with the difference in the pipe length between the long exhaust pipes 150 and the short exhaust pipes 151 set to 150 mm will be described based on FIG. 9. FIG. 9 shows the sound pressure amplitude of the exhaust sound and the envelope thereof in the left exhaust system 20 with the difference in the pipe length between the long exhaust pipes 150 and the short exhaust pipes 151 set to 150 mm. The sound pressure amplitude of the explosion sound from the second cylinder 12 connected with the second exhaust pipe 22 as the long exhaust pipe 150 (a peak represented as long in the chart) is reduced in comparison with the sound pressure amplitude of the explosion sound from the fourth cylinder 14 connected with the fourth exhaust pipe 24 as the short exhaust pipe 151 (a peak represented as short in the chart), and the difference in the amplitude therebetween is 13% with respect to the sound pressure amplitude of the explosion sound from the fourth cylinder 14 connected to the fourth exhaust pipe 24 as the short exhaust pipe 151.

Also, when paying attention to the envelope, in the exhaust system with the difference in the pipe length between the long exhaust pipes 150 and the short exhaust pipes 151 set to 150 mm, the difference in the sound pressure amplitude therebetween is 13%. This shows a low value in comparison with the exhaust system with the difference in the pipe length between the long exhaust pipes 150 and the short exhaust pipes 151 set to 175 mm while the difference in the sound pressure amplitude is 23%. Depending on a condition of the internal combustion engine, a case where the envelop cannot cover the explosion interval for the two cylinders as one large crest occurs. However, the cycle of the explosion sound felt as the explosion sound can be basically lengthened.

Figure 10:
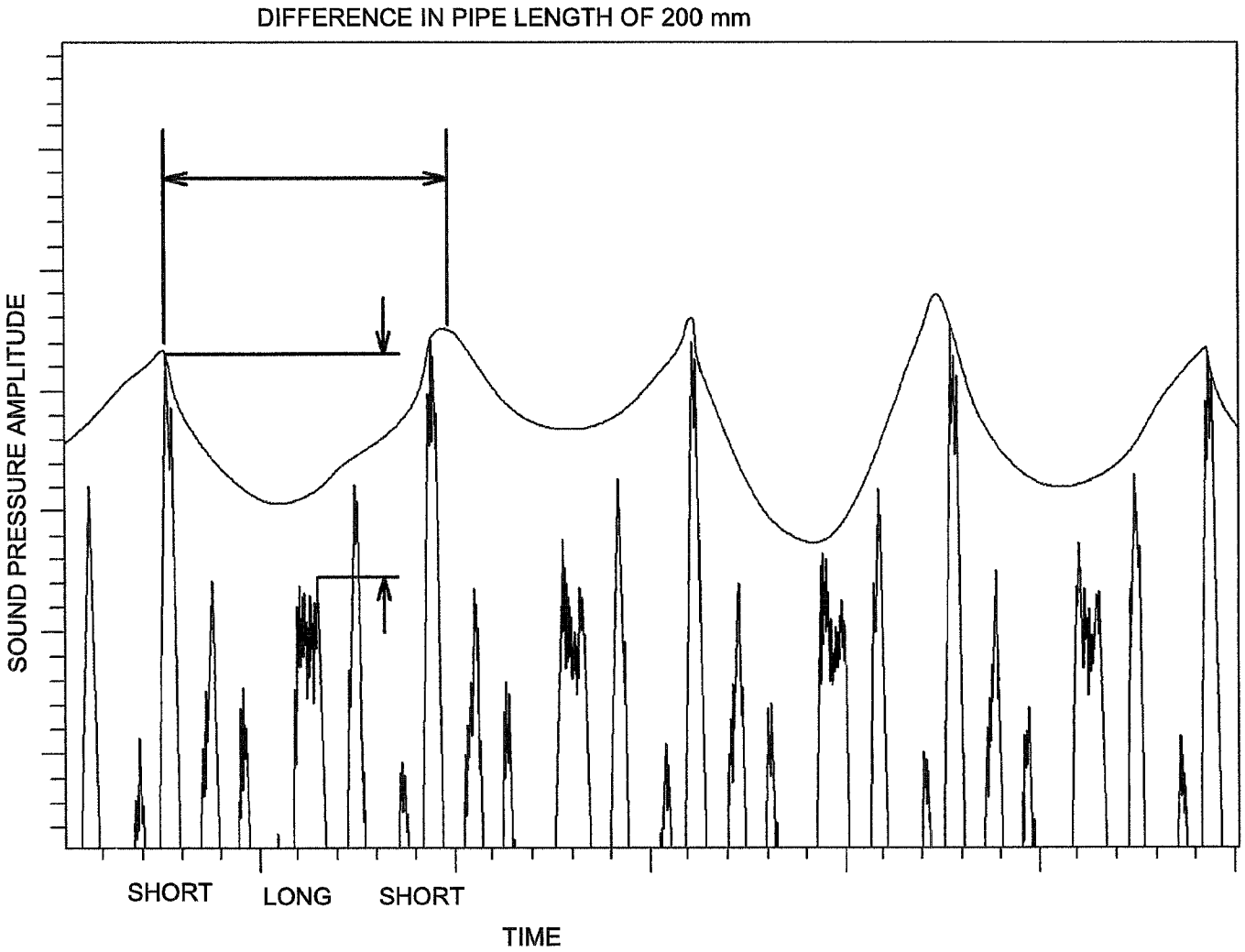
FIG. 10 is a chart showing the hourly sound pressure amplitude and the envelope for the same of the left exhaust system when the difference in the pipe length between the long exhaust pipes and the short exhaust pipes is 200 mm.

Next, the exhaust system with the difference in the pipe length between the long exhaust pipes 150 and the short exhaust pipes 151 set to 200 mm will be described based on FIG. 10. FIG. 10 shows the sound pressure amplitude of the exhaust sound and the envelope thereof in the left exhaust system 20 with the difference in the pipe length between the long exhaust pipes 150 and the short exhaust pipes 151 set to 200 mm in the embodiment. The sound pressure amplitude of the explosion sound from the second cylinder 12 connected with the second exhaust pipe 22 as the long exhaust pipe 150 (a peak represented as long in the chart) is further reduced in comparison with the sound pressure amplitude of the explosion sound from the fourth cylinder 16 connected with the fourth exhaust pipe 24 as the short exhaust pipe 151 (a peak represented as short in the chart), and the difference in the amplitude therebetween is 33% with respect to the sound pressure amplitude of the explosion sound from the fourth cylinder 14 connected to the fourth exhaust pipe 24 small in length. In the exhaust system configured such that the difference in the pipe length between the long exhaust pipes 150 and the short exhaust pipes 151 is set to 200 mm, the crest and trough of the envelop are further increased, and the cycle of the explosion sound felt as the explosion sound can be more certainly lengthened.

Figure 11:
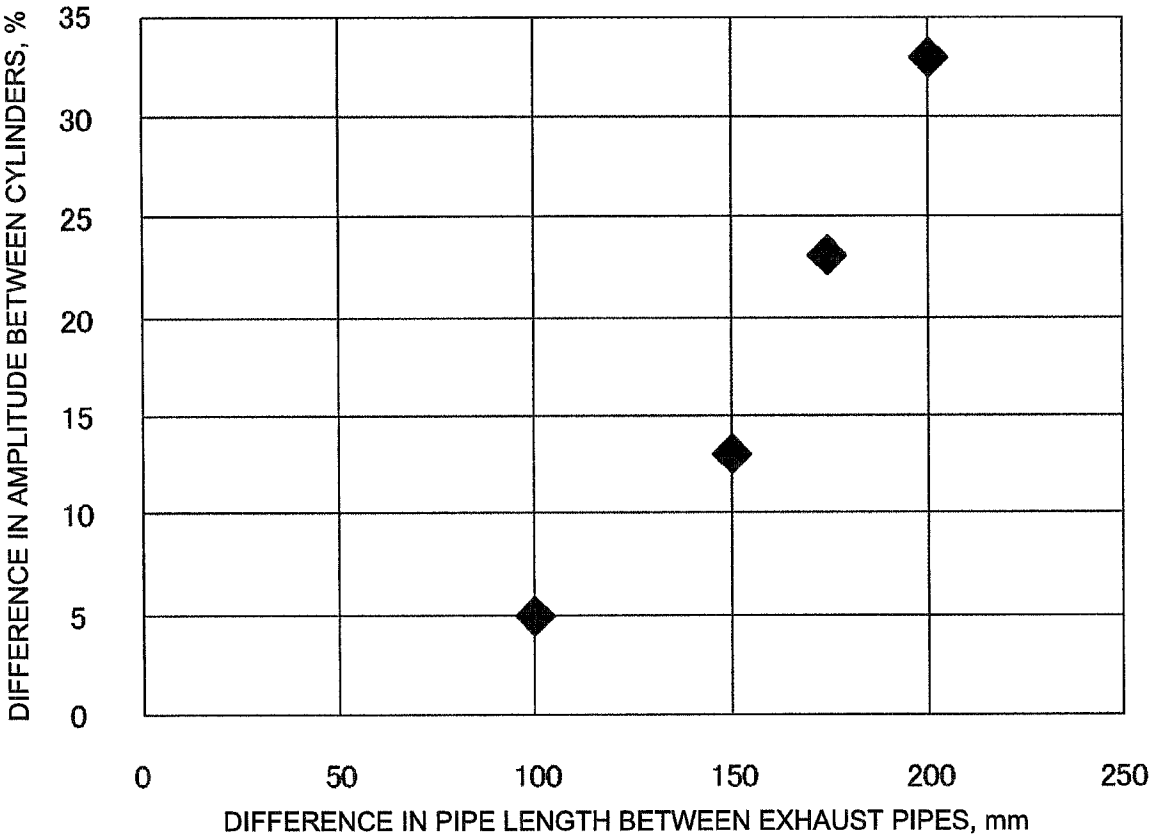
FIG. 11 is a diagram showing a ratio of a difference between a sound pressure amplitude of an explosion sound from the cylinders connected with the long exhaust pipes and a sound pressure amplitude of an explosion sound from the cylinders connected with the short exhaust pipes to a sound pressure amplitude of an explosion sound from the cylinders connected to the short exhaust pipes, in regard to a difference in each pipe length between the long exhaust pipes and the short exhaust pipes.

FIG. 11 shows a ratio of the difference between the sound pressure amplitude of the explosion sound from the second cylinder 12 connected with the second exhaust pipe 22 as the long exhaust pipe 150 and the sound pressure amplitude of the explosion sound from the fourth cylinder 14 connected with the fourth exhaust pipe 24 as the short exhaust pipe 151 to the sound pressure amplitude of the explosion sound from the fourth cylinder 14 connected with the fourth exhaust pipe 24 as the short exhaust pipe 151, in the left exhaust system 20 with the difference in the pipe length between the long exhaust pipes 150 and the short exhaust pipes 151 set to 100 mm, 150 mm, 175 mm and 200 mm, respectively. Thereby, as the difference in the pipe length between the collected exhaust pipes is large, the ratio is increased, the envelop can more certainly cover the explosion interval for the two cylinders as the one large crest, and the appealing and harmonious exhaust sound with the excellent pulse feeling can be output. As a result, in order to exhibit the effects of the present invention, the difference in the pipe length between the long exhaust pipes 150 and the short exhaust pipes 151 is favorably set to 150 mm or more, and more preferably set to 175 mm or more.

Figure 12:
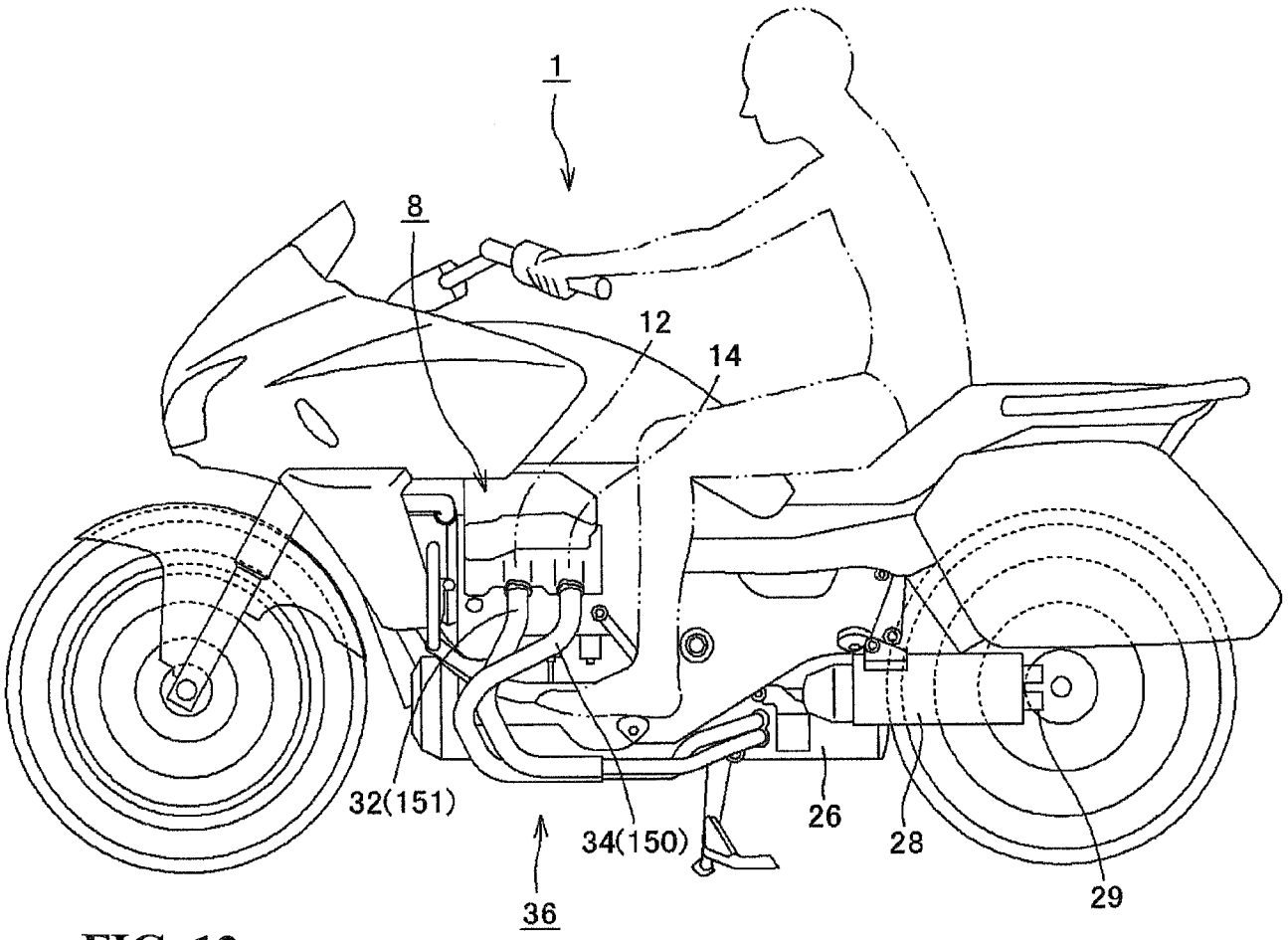
FIG. 12 is a left side view of a motorcycle with another aspect of the first embodiment shown.
Figure 13:
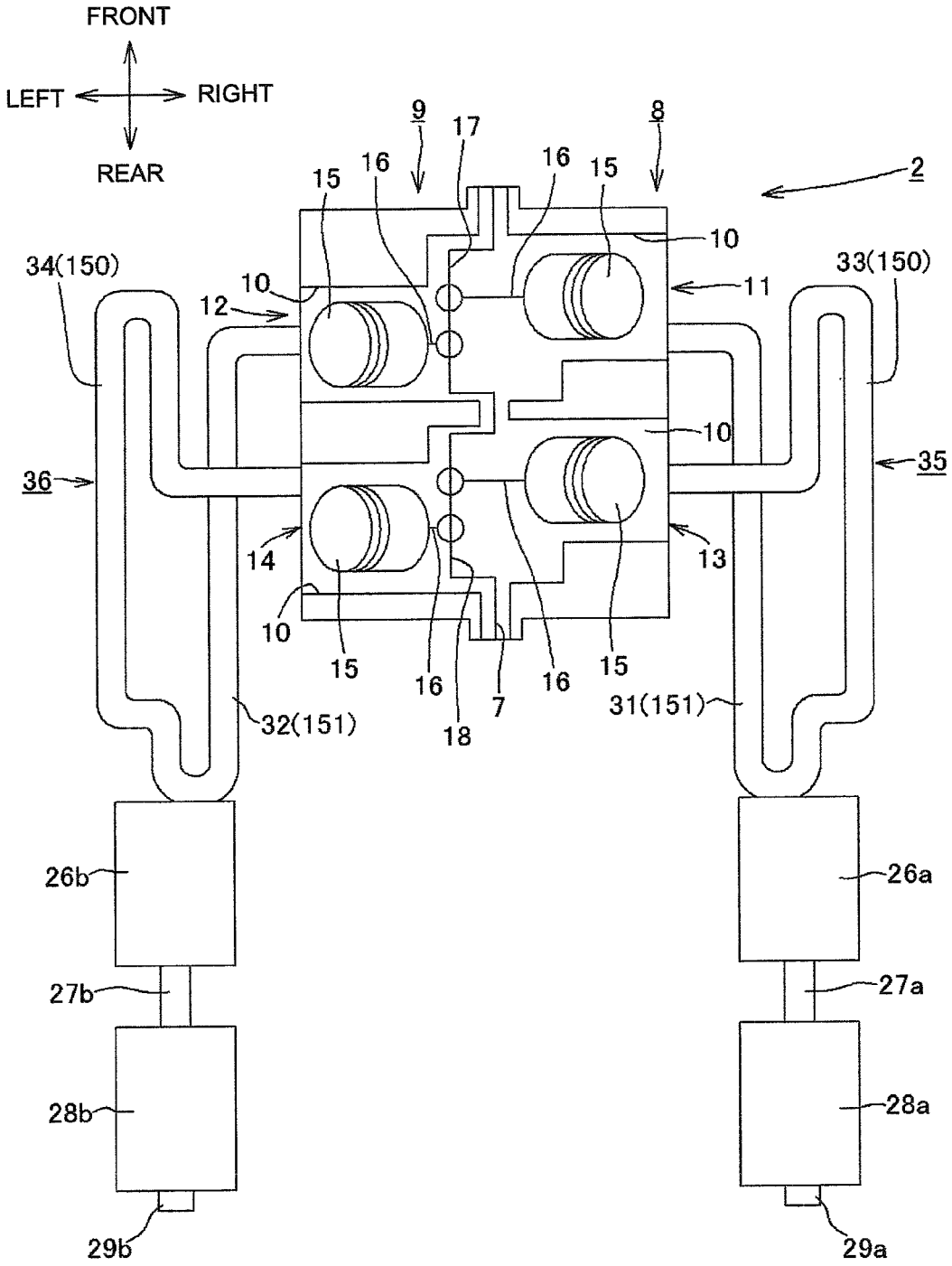
FIG. 13 is a pattern diagram showing a V-shaped four-cylinder internal combustion engine and an exhaust pipe structure for the same in FIG. 12.

FIG. 12 and FIG. 13 show an exhaust pipe structure for a V-shaped four-cylinder internal combustion engine 2 according to another aspect of the first embodiment applied with the present invention. The exhaust pipe structure for the V-shaped four-cylinder internal combustion engine 2 according to the embodiment is the exhaust pipe structure applied to the V-shaped four-cylinder internal combustion engine using the 360-degree crank at the bank angle of 90 degrees in the say way as the above-described embodiment. In the above-described embodiment, the first exhaust pipe 21 and the second exhaust pipe 22 as the long exhaust pipes 150 are configured to be connected to the first front cylinder 11 and the second front cylinder 12 and to have the bent portions 21*a*, 22*a* formed below the V-shaped four-cylinder internal combustion engine 2, and the difference in the pipe length is set to 175 mm or more. However, in the embodiment, the exhaust pipe structure for the V-shaped four-cylinder internal combustion engine 2 is configured such that a third exhaust pipe 33 and a fourth exhaust pipe 34 that are respectively connected to a third cylinder 13 and a fourth cylinder 14 as cylinders located on a rear side are extended forward of a first exhaust pipe 31 and a second exhaust pipe 32 that are respectively connected to a first cylinder 11 and a second cylinder 12 respectively located on a front side, are subsequently bent and extend rearwardly. The third exhaust pipe 33 connected to the third rear cylinder 13 and the fourth exhaust pipe 34 connected to the fourth rear cylinder 14 are formed as long exhaust pipes 150, the first exhaust pipe 31 connected to the first front cylinder 11 and the second exhaust pipe 32 connected to the second front cylinder 12 are formed as short exhaust pipes 151, and a difference in a pipe length between the long exhaust pipes 150 and the short exhaust pipes 151 is set to 175 mm or more. A right exhaust system 35 includes the first exhaust pipe 31, the third exhaust pipe 33, a chamber 26*a*, a connecting pipe 27*a*, a muffler 28*a*, and a tailpipe 29*a*, and a left exhaust system 36 includes the second exhaust pipe 32, the fourth exhaust pipe 34, a chamber 26*b*, a connecting pipe 27*b*, a muffler 28*b*, and a tailpipe 29*b*.

Figure 14:
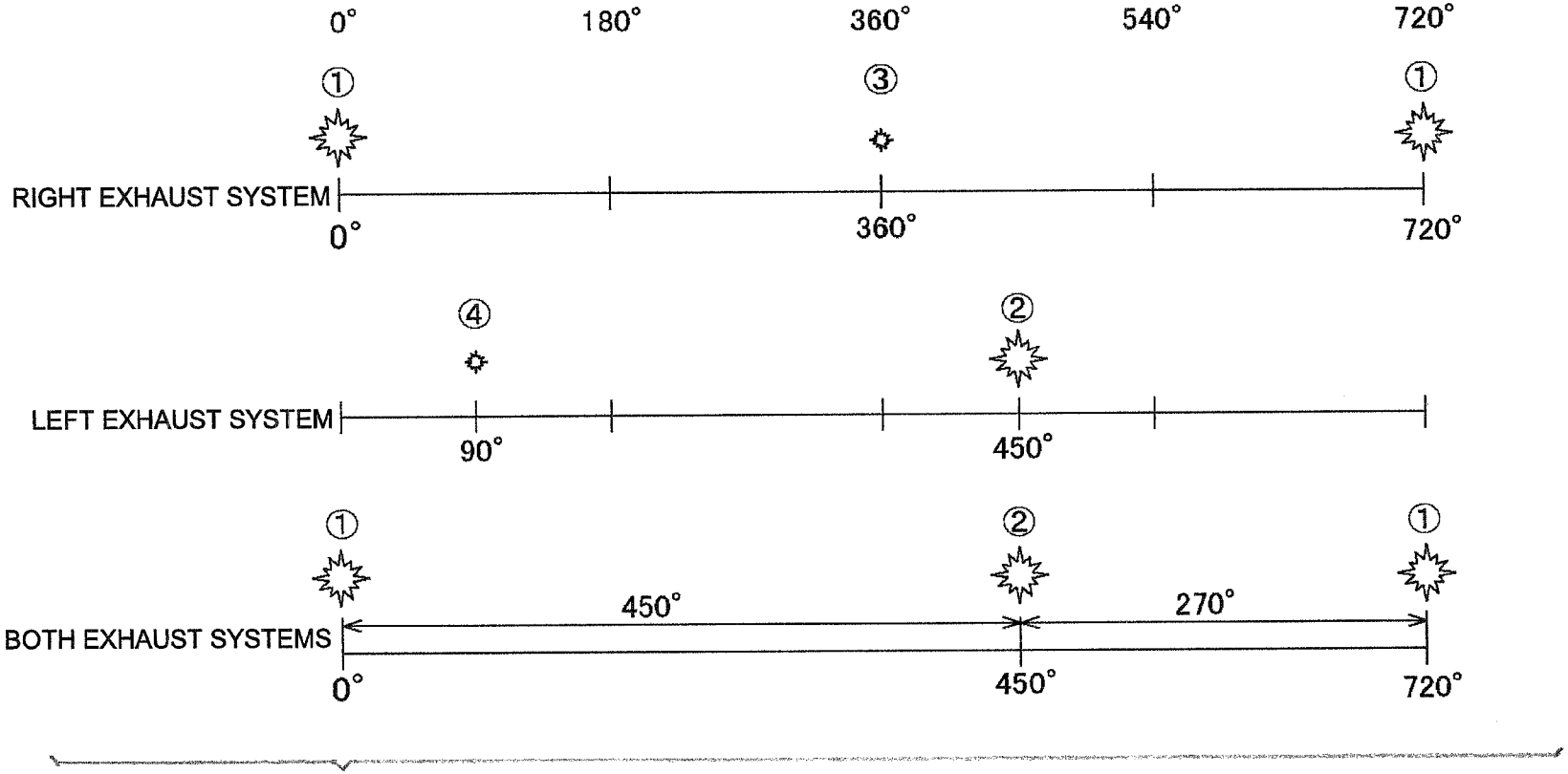
FIG. 14 is a diagram showing timing heard as an explosion sound caused by the exhaust pipe structure for the V-shaped four-cylinder internal combustion engine in FIG. 12.

FIG. 14 shows explosion timing in respective cylinders in the right exhaust system 35, the left exhaust system 36, and both the exhaust systems when the difference in the pipe length between the long exhaust pipes 150 and the short exhaust pipes 151 is set to 175 mm. Since the first exhaust pipe 31 and the second exhaust pipe 32 are the short exhaust pipes 151, the explosion sounds from the first cylinder 11 connected to the first exhaust pipe 31 and the second cylinder 12 connected to the second exhaust pipe 32 are felt as the explosion sounds. Since the third exhaust pipe 33 and the fourth exhaust pipe 34 are the long exhaust pipes 150, the explosion sounds from the third cylinder 13 and the fourth cylinder 14 cannot be felt as the explosion sounds. Since the explosion sounds can be felt only in the crank angle phases of 0 degrees and 450 degrees and the intervals of the crank angle phases that can be felt as the explosion sounds are 450 degree, 270 degree, 450 degrees, and the like, the explosion is heard as if the explosions occur at irregular intervals, a cycle of the explosion sound becomes the same cycle as the explosion sound cycle at explosion timing for a V-shaped two-cylinder internal combustion engine at a bank angle of 90 degrees, and also in the exhaust pipe structure according to the embodiment, the same effects as those in the above-described embodiment can be obtained. Further, since the third exhaust pipe 33 connected to the third rear cylinder 13 and the fourth exhaust pipe 34 connected to the fourth rear cylinder 14 are bent forward, they do not interfere with feet of a passenger.

Figure 15:
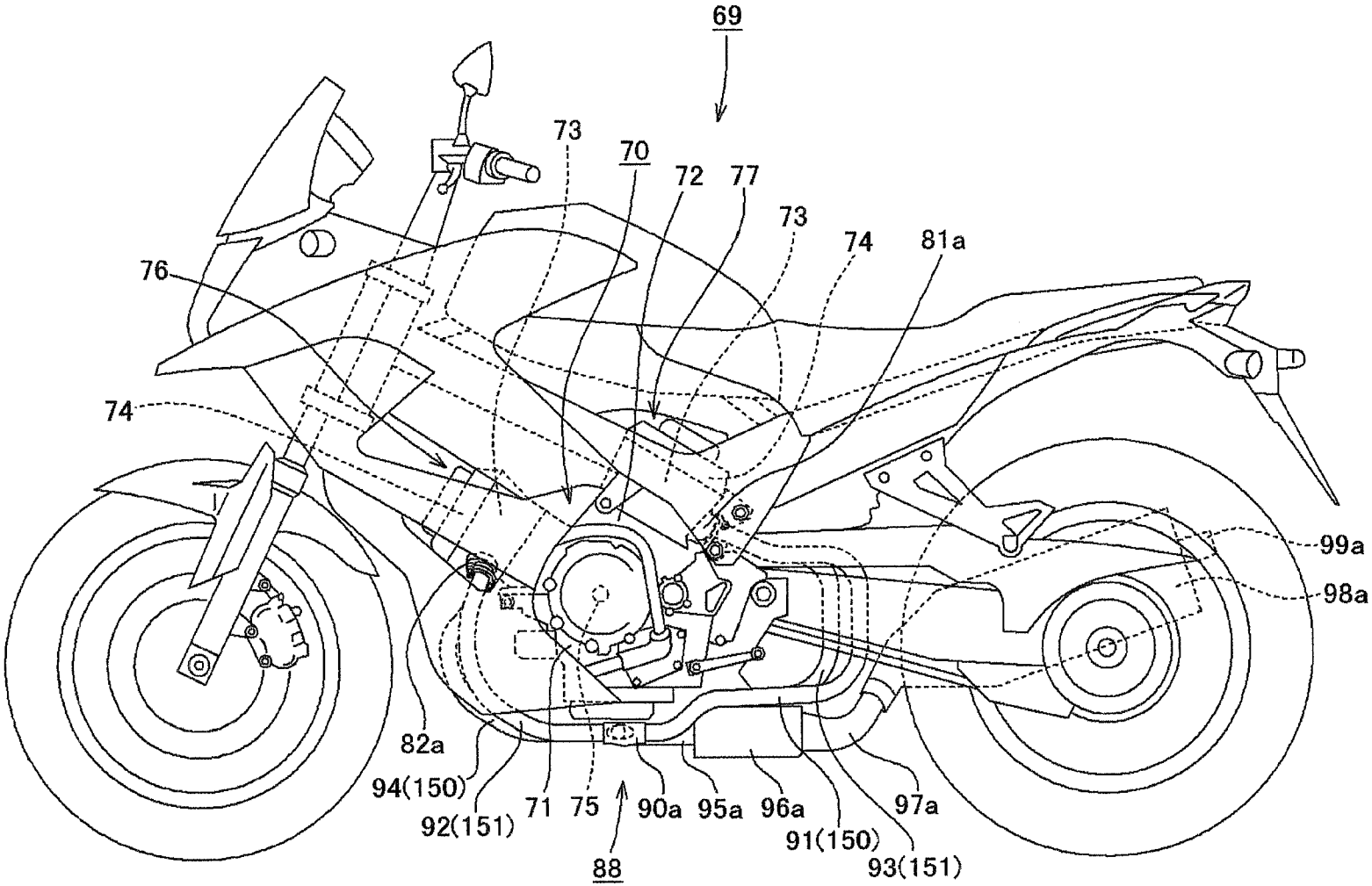
FIG. 15 is a left side view of a motorcycle including an exhaust pipe structure for a V-shaped four-cylinder internal combustion engine using a 180-degree crank at a bank angle of 90 degrees according to a second embodiment applied with the present invention.
Figure 16:
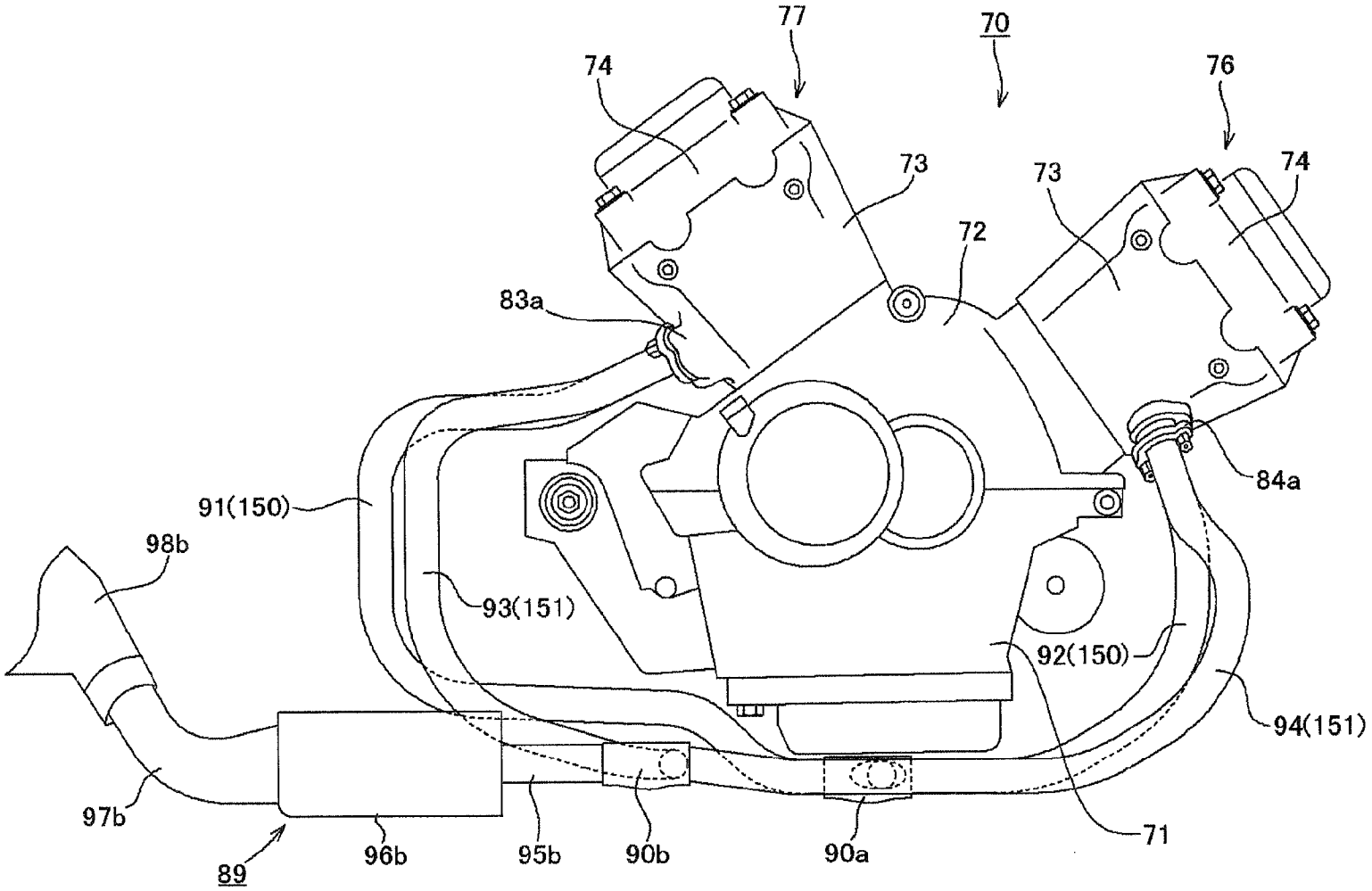
FIG. 16 is a right side view of the V-shaped four-cylinder internal combustion engine mounted in the motorcycle in FIG. 15.

Next, an exhaust pipe structure for a V-shaped four-cylinder internal combustion engine 70 using a 180-degree crank at a bank angle of 90 degrees according to a second embodiment applied with the present invention will be described with reference to FIG. 15 to FIG. 20. FIG. 15 shows a left side view of a motorcycle 69 applied with the embodiment, and the V-shaped four-cylinder internal combustion engine 70 using the 180-degree crank at the bank angle of 90 degrees is mounted such that a crankshaft 75 is directed to a horizontal direction of a vehicle. FIG. 16 shows a right side view of the V-shaped four-cylinder internal combustion engine 70. In the V-shaped four-cylinder internal combustion engine 70, a crankcase 71, a cylinder block 72, and a cylinder head 73 are sequentially piled up and integrally fastened to each other, and a head cover 74 is attached to cover the cylinder head 73 from above.

Figure 17:
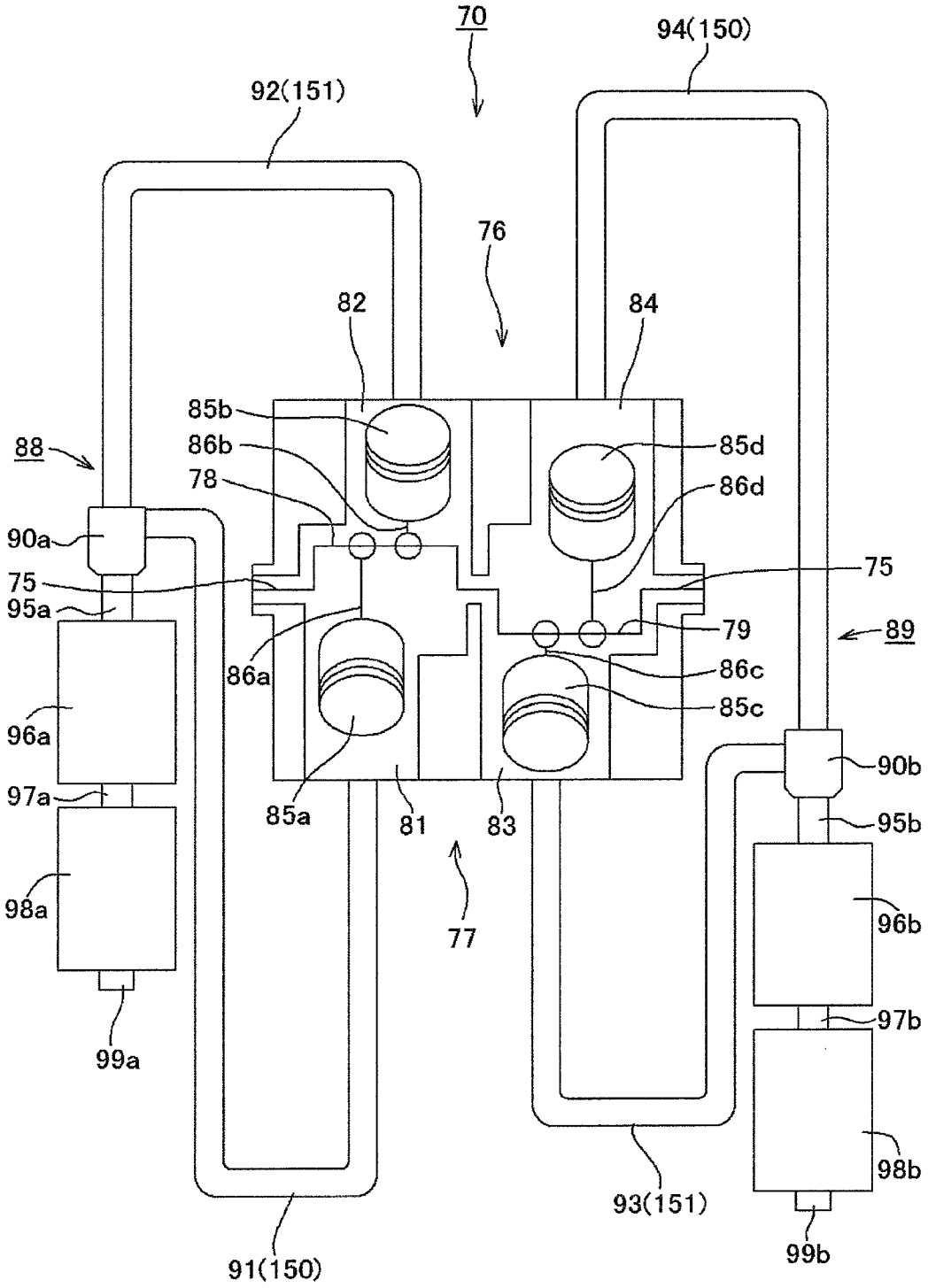
FIG. 17 is a pattern diagram showing the V-shaped four-cylinder internal combustion engine and the exhaust pipe structure for the same in FIG. 16.

FIG. 17 shows a pattern diagram of the V-shaped four-cylinder internal combustion engine 70 and the exhaust pipe structure for the same according to the embodiment. The V-shaped four-cylinder internal combustion engine 70 includes a front bank 76 and a rear bank 77 at a bank angle of 90 degrees in a longitudinal direction, and respective two cylinders are provided in the front bank 76 and the rear bank 77. A first cylinder 81 is arranged on a left side of the rear bank 77, and a third cylinder 83 is arranged on a right side of the rear bank 77. A second cylinder 82 is arranged on a left side of the front bank 76, and a fourth cylinder 84 is arranged on a right side of the front bank 76. A connecting rod 86*a* coupled to a piston 85*a* of the first cylinder 81 positioned on the left side and a connecting rod 86*b* coupled to a piston 85*b* of the second cylinder 82 located on the left side are coupled to a first crankpin 78. A connecting rod 86*c* coupled to a piton 85*c* of the third cylinder 83 positioned on the right side and a connecting rod 86*d* coupled to a piston 85*d* of the fourth cylinder 84 positioned on the right side are coupled to a second crankpin 79. A crank angle between the first crankpin 78 and the second crankpin 79 is set to 180 degrees. The first exhaust pipe 91, the second exhaust pipe 92, the third exhaust pipe 93, and the fourth exhaust pipe 94 are respectively connected to the first cylinder 81, the second cylinder 82, the third cylinder 83, and the fourth cylinder 84.

As shown in FIG. 15 to FIG. 17, the first exhaust pipe 91 connected to an exhaust port 81*a* formed in the first cylinder 81 extends rearwardly of the vehicle, directed downward, subsequently extends in a forward direction, curved from an inner side of the vehicle below the internal combustion engine toward the outside, and connected from an inward direction of the vehicle to a collecting part 90*a* provided below the vehicle. The second exhaust pipe 92 connected to an exhaust port 82*a* formed in the second cylinder 82 extends downwardly of the vehicle, is directed rearwardly and is connected to a front side of the collecting part 90*a*. A pipe length of the first exhaust pipe 91 is longer than that of the second exhaust pipe 92, so that the first exhaust pipe 91 is formed as the long exhaust pipe 150 and the second exhaust pipe 92 is formed as the short exhaust pipe 151.

The first exhaust pipe 91 and the second exhaust pipe 92 are merged at the collecting part 90*a*, and a connecting pipe 95*a*, a chamber 96*a*, a connecting pipe 97*a*, and a muffler 98*a* are connected in this order from the collecting part 90*a*. A rear portion of the muffler 98*a* is provided with a tailpipe 99*a* from which exhaust gas in the muffler 98*a* is released into the atmosphere. A left exhaust system 88 includes the first exhaust pipe 91, the second exhaust pipe 92, the collecting part 90*a*, the connecting pipe 95*a*, the chamber 96*a*, the connecting pipe 97*a*, the muffler 98*a*, and the tailpipe 99*a*.

FIG. 16 shows a right side view of the V-shaped four-cylinder internal combustion engine 70. As shown in FIG. 16 and FIG. 17, the third exhaust pipe 93 connected to an exhaust port 83*a* formed in the third cylinder 83 extends rearwardly of the vehicle, is directed downwardly, subsequently extends in a forward direction, curved from the inner side of the vehicle below the internal combustion engine toward the outside, and is connected from the inward direction of the vehicle to a collecting part 90*b* provided below the vehicle. The fourth exhaust pipe 94 connected to an exhaust port 84*a* formed in the fourth cylinder 84 extends downwardly of the vehicle, is directed rearwardly and is connected to a front side of the collecting part 90*b*. A pipe length of the fourth exhaust pipe 94 is longer than that of the third exhaust pipe 93, so that the fourth exhaust pipe 94 is formed as the long exhaust pipe 150 and the third exhaust pipe 93 is formed as the short exhaust pipe 151.

The third exhaust pipe 93 and the fourth exhaust pipe 94 are merged at the collecting part 90*b*, and a connecting pipe 95*b*, a chamber 96*b*, a connecting pipe 97*b*, and a muffler 98*b* are connected in this order from the collecting part 90*b*. A rear portion of the muffler 98*b* is provided with a tailpipe 99*b* from which exhaust gas in the muffler 98*b* is released into the atmosphere. A right exhaust system 98 includes the third exhaust pipe 93, the fourth exhaust pipe 94, the collecting part 90*b*, the connecting pipe 95*b*, the chamber 96*b*, the connecting pipe 97*b*, the muffler 98*b*, and the tailpipe 99*b*.

In the left exhaust system 88, the first exhaust pipe 91 positioned on the rear side is formed as the long exhaust pipe 150, and in the right exhaust system 89, the fourth exhaust pipe 94 positioned on the front side is formed as the long exhaust pipe 150. Therefore, as shown in FIG. 16, the fourth exhaust pipe 94 of the second exhaust pipe 92 and the fourth exhaust pipe 94 that are positioned on the front side, is formed into a shape projecting forward of the second exhaust pipe 92, and the first exhaust pipe 91 of the first exhaust pipe 91 and the third exhaust pipe 93 that are positioned on the rear side, is formed into a shape projecting rearward of the third exhaust pipe 93. Further, the collecting part 90*a* in the left exhaust system 88 is arranged forward of the collecting part 90*b* in the right exhaust system 89.

The first exhaust pipe 91 and the fourth exhaust pipe 94 are the long exhaust pipes 150 having the pipe length longer than that of each of the second exhaust pipe 92 and the third exhaust pipe 93, the second exhaust pipe 92 and the third exhaust pipe 93 are the short exhaust pipes 151, and the difference in the pipe length between the long exhaust pipes 150 and the short exhaust pipes 151 is set to 175 mm. In the embodiment, the difference in the pipe length between the long exhaust pipes 150 and the short exhaust pipes 151 is set to 175 mm. However, the difference in the pipe length may be set to 150 mm or more, and more preferably set to 175 mm or more.

Figure 18:
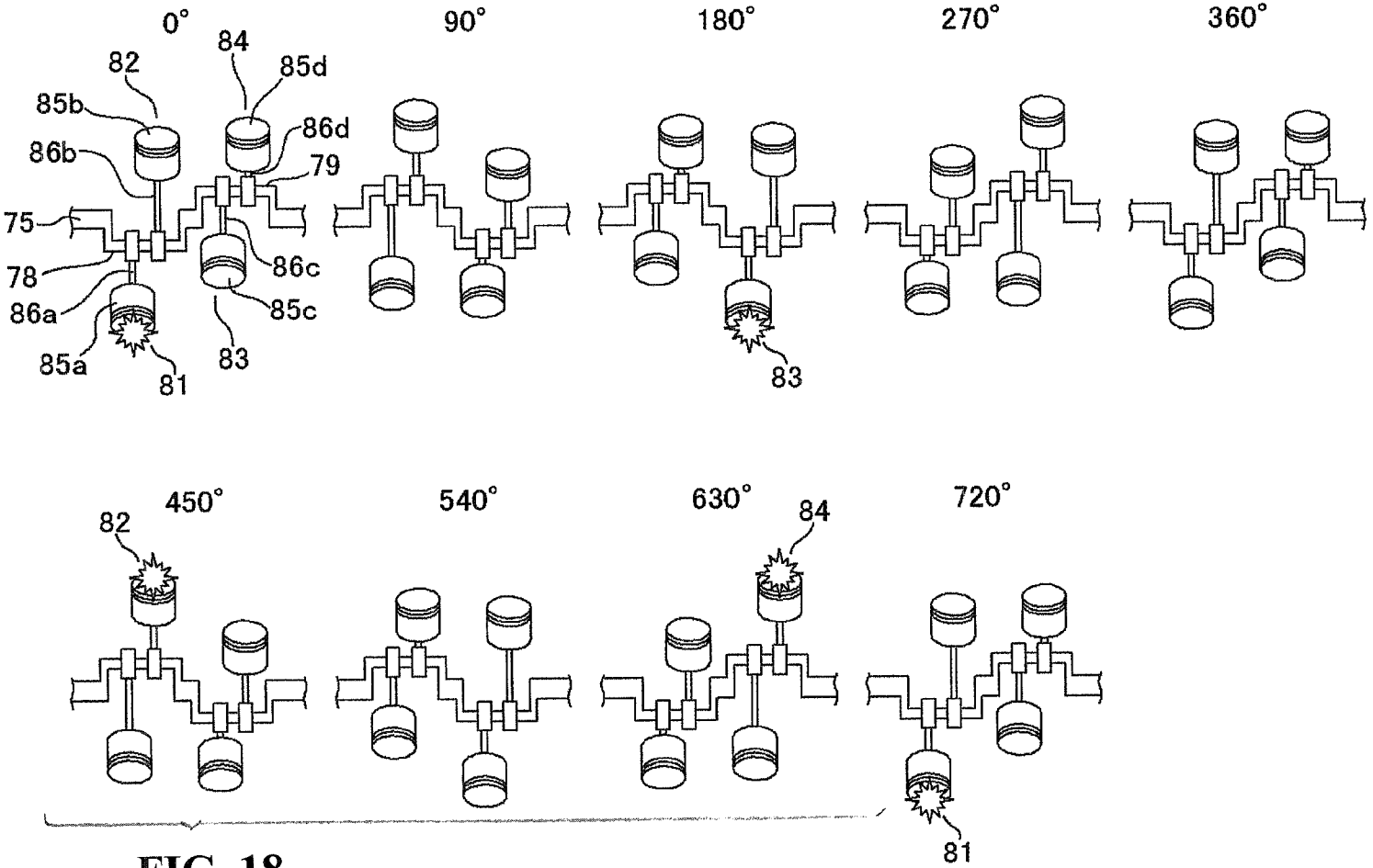
FIG. 18 is a schematic view showing explosion timing in respective cylinders with respect to rotation of the crank of the V-shaped four-cylinder internal combustion engine using the 180-degree crank at the bank angle of 90 degrees.

Next, FIG. 18 illustrates explosion timing in each cylinder with respect to rotation of the crank of the V-shaped four-cylinder internal combustion engine 70 using the 180-degree crank at the bank angle of 90 degrees according to the embodiment. When the crank angle phase during explosion in the first cylinder 81 is set to 0 degrees, in the V-shaped four-cylinder internal combustion engine 70, the explosion occurs in each of the crank phases of 0 degrees, 180 degrees, 450 degrees, and 630 degrees while the crankshaft 75 is rotated by 720 degrees, and when there is no difference in the pipe length, the explosion is felt at each of the intervals of 180 degrees, 270 degrees, 180 degrees, and 90 degrees.

Figure 19:
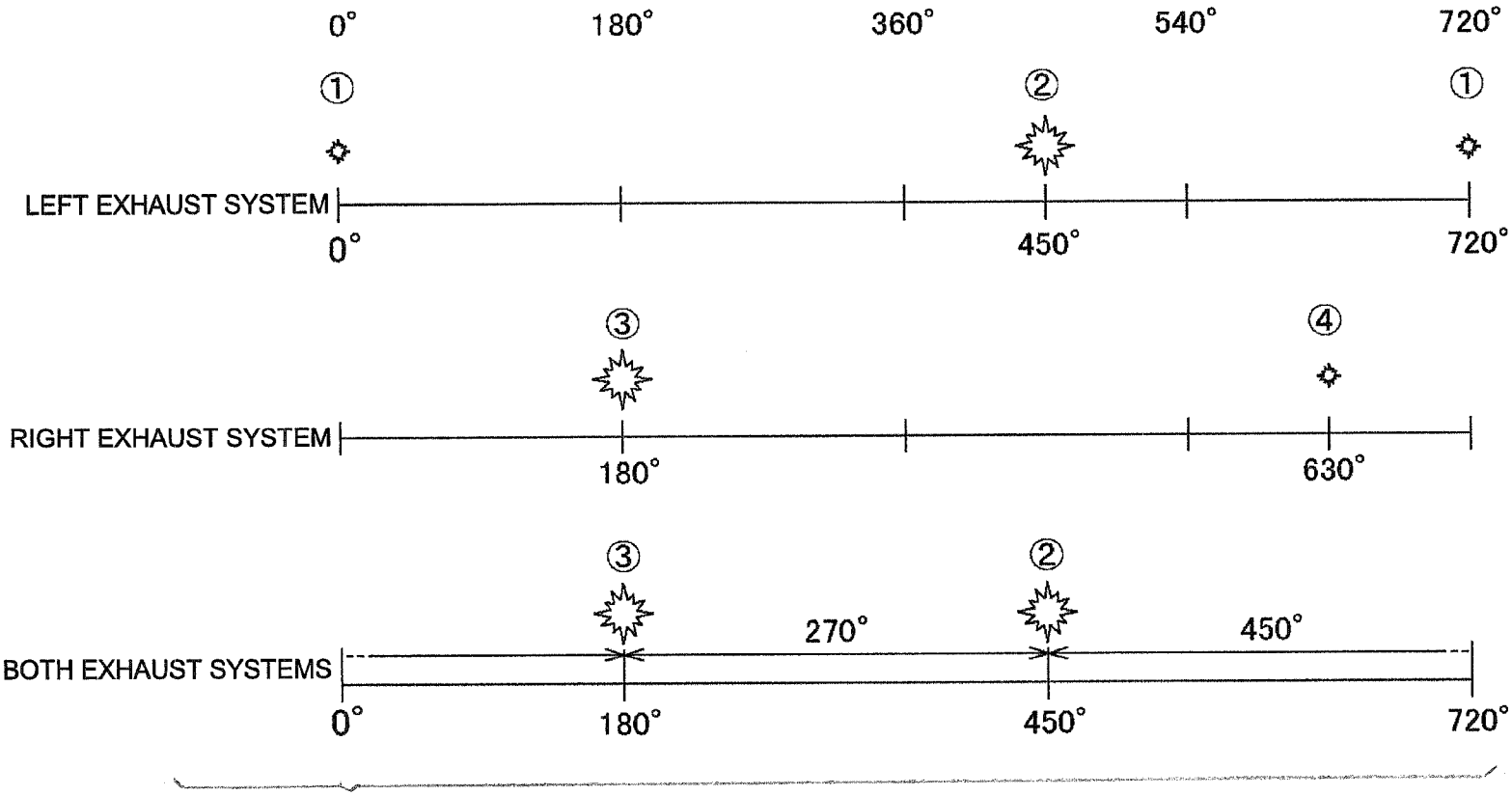
FIG. 19 is a diagram showing timing heard as an explosion sound caused by the exhaust pipe structure for the V-shaped four-cylinder internal combustion engine using the 180-degree crank at the bank angle of 90 degrees.

FIG. 19 shows the explosion timing when the explosion timing in the first cylinder 81 is set to the crank angle phase of 0 degrees, in the left exhaust system 88, the right exhaust system 89 and both the exhaust systems in the case where the difference in the pipe length between the long exhaust pipes 150 and the short exhaust pipes 151 set to 175 mm. In the embodiment, the first exhaust pipe 91 and the fourth exhaust pipe 94 are formed as the long exhaust pipes 150, and the second exhaust pipe 92 and the third exhaust pipe 93 are formed as the short exhaust pipes 151. Therefore, in the left exhaust system 88, the explosion in the first cylinder 81 is not felt as the explosion sound (although the explosion therein is heard as a simple sound, the explosion therein is not heard as the crest (peak) of the exhaust sound having peaks and dips), and the explosion in the second cylinder 82 is felt as the explosion sound, while in the right exhaust system 89, the explosion in the third cylinder 83 is felt as the explosion sound, and the explosion in the fourth cylinder 84 is not felt as the explosion sound. Since in both the exhaust systems 88, 89, only the explosions in the third cylinder 83 and the second cylinder 82 are felt as the explosion sounds, during the rotation of the crankshaft 75 at 720 degrees, the explosions are felt as the explosion sounds only when the crank angle phases are 180 degrees and 450 degrees, and the intervals felt as the explosion sounds are 270 degrees and 450 degrees and are lengthened in comparison with the exhaust pipe structure including the exhaust pipes having the equal pipe length.

Further, since the intervals of the crank angle phases felt as the explosion sounds are set to 270 degrees, 450 degrees, 270 degrees, and the like, the cycle of the sound recognized as the explosion sound is lengthened, the explosion sounds are heard as if the explosion sounds are generated at irregular intervals, and the cycle of the explosion sound becomes the same cycle as the cycle of 270 degrees, 450 degrees, 270 degrees, and the like as the cycle of the interval of the explosion sound at the explosion timing in the V-shaped two-cylinder internal combustion engine at the bank angle of 90 degrees. For this reason, in the V-shaped four-cylinder internal combustion engine using the 180-degree crank at the hank angle of 90 degrees, the output performance can be easily improved in comparison with the two-cylinder internal combustion engine having the same displacement, and the appealing and harmonious exhaust sound with the excellent pulse feeling relating to the V-shaped two-cylinder internal combustion engine can be output.

Figure 20:
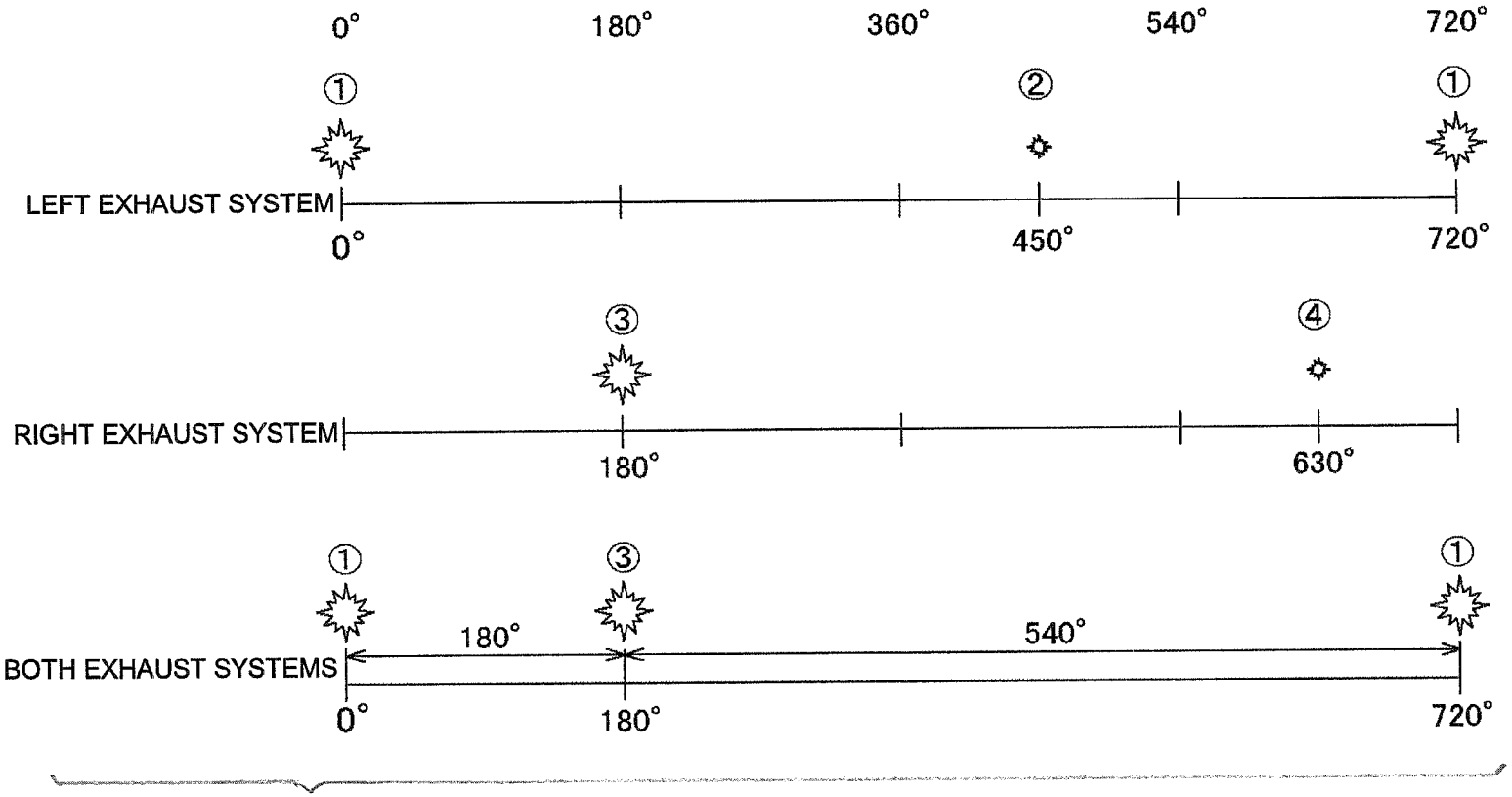
FIG. 20 is a diagram showing timing heard as the explosion sound caused by the exhaust pipe structure for the V-shaped four-cylinder internal combustion engine using the 180-degree crank at the bank angle of 90 degrees.

In the above-described embodiment, the second exhaust pipe 92 and the third exhaust pipe 93 are formed as the short exhaust pipes 151, so that the explosion in each of the second cylinder 82 and the third cylinder 83 is felt as the explosion sound. On the other hand, when the second exhaust pipe 92 and the fourth exhaust pipe 94 are formed as the long exhaust pipes 150, the first exhaust pipe 91 and the third exhaust pipe 93 are formed as the short exhaust pipes 151, and the difference in the pipe length between the long exhaust pipes 150 and the short exhaust pipes 151 is set to 175 mm, as shown in FIG. 20, only the explosion in each of the first cylinder 81 and the third cylinder 83 is felt as the explosion sound, and the intervals of the crank angle phases felt as the explosion sounds are set to the cycle of 180 degrees, 540 degrees, 180 degrees, and the like and becomes the same as a cycle of the explosion intervals of 180 degrees, 540 degrees, 180 degrees as the explosion cycle in the inline two-cylinder internal combustion engine using the 180-degree crank. For this reason, in the V-shaped four-cylinder internal combustion engine using the 180-degree crank at the bank angle of 90 degrees, the exhaust sound with the excellent pulse feeling relating to the inline two-cylinder internal combustion engine using the 180-degree crank can be created.

As described above, when the two exhaust pipes respectively connected to the two cylinders with the difference between the crank angle phases at the explosion timing set to 270 degrees, of the four cylinders in the four-cylinder internal combustion engine, are formed as the short exhaust pipes 151, and the other two exhaust pipes are formed as the long exhaust pipes 150, the intervals of the explosions heard as the explosion sound are irregular and become the same as the intervals of the explosions in the V-shaped two-cylinder internal combustion engine at the bank angle of 90 degrees. As a result, the exhaust sound can closely resemble the exhaust sound with the pulse feeling relating to the V-shaped two-cylinder internal combustion engine.

Further, when the two exhaust pipes respectively connected to the two cylinders of the four cylinders, with the difference between the crank angle phases at the explosion timing set to 180 degrees, are formed as the short exhaust pipes 151, and the other two exhaust pipes are formed as the long exhaust pipes 150, the intervals of the explosions heard as the explosion sounds are irregular and become the same as the intervals of the explosions in the inline two-cylinder internal combustion engine using the 180-degree crank. As a result, the exhaust sound can be created as if it is similar to the exhaust sound with the pulse feeling relating to the inline two-cylinder internal combustion engine using the 180-degree crank.

Figure 21:
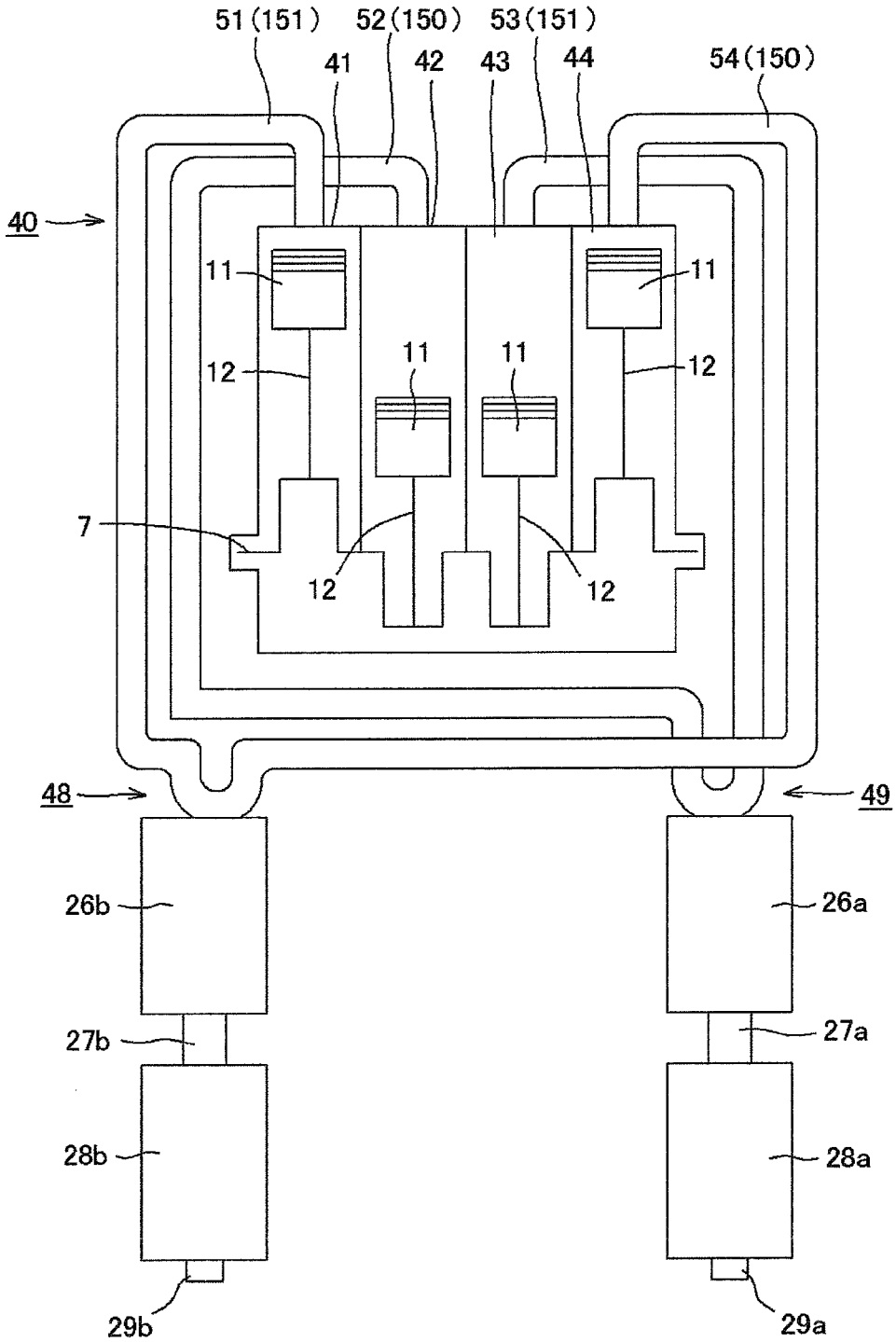
FIG. 21 is a pattern diagram showing an inline four-cylinder internal combustion engine using a 180-degree crank and an exhaust pipe structure for the same applied with a third embodiment of the present invention.

Next, an exhaust pipe structure for an inline four-cylinder internal combustion engine 40 using a 180-degree crank according to a third embodiment applied with the present invention will be described based on FIG. 21 to FIG. 23. FIG. 21 shows a pattern diagram of the exhaust pipe structure for the inline four-cylinder internal combustion engine 40 according to the embodiment. The inline four-cylinder internal combustion engine 40 is mounted in a vehicle such that a crankshaft 7 is directed to a horizontal direction, a first cylinder 41, a second cylinder 42, a third cylinder 43, and a fourth cylinder 44 are provided in series from the left, and a first exhaust pipe 51, a second exhaust pipe 52, a third exhaust pipe 53 and a fourth exhaust pipe 54 are respectively connected to the first cylinder 41, the second cylinder 42, the third cylinder 43 and the fourth cylinder 44.

The first exhaust pipe 51 and the fourth exhaust pipe 54 extend in a forward direction of the vehicle, subsequently bent and extend rearwardly, are connected to each other so that the first exhaust pipe 51 and the fourth exhaust pipe 54 are collected to a chamber 26*b* provided on a left side of a lower back portion of the vehicle, and are connected from the chamber 26*b* to a muffler 28*b* through a connecting pipe 27*b*. A rear portion of the muffler 28*b* is provided with a tailpipe 29*b*. An external exhaust system 48 includes the first exhaust pipe 51, the fourth exhaust pipe 54, the chamber 26*b*, the connecting pipe 27*b*, the muffler 28*b*, and the tailpipe 29*b*.

Further, the second exhaust pipe 52 and the third exhaust pipe 53 extending in a forward direction of the vehicle, subsequently bent and extend rearwardly, are connected to each other so that the second exhaust pipe 52 and the third exhaust pipe 53 are collected to a chamber 26*a* provided on a right side of the lower back portion of the vehicle, and are connected from the chamber 26*a* to a muffler 28*a* through a connecting pipe 27*a*. A rear portion of the muffler 28*a* is provided with a tailpipe 29*a*. An internal exhaust system 49 includes the second exhaust pipe 52, the third exhaust pipe 53, the chamber 26*a*, the connecting pipe 27*a*, the muffler 28*a* and the tailpipe 29*a*.

The fourth exhaust pipe 54 in the external exhaust system 48 is formed as a long exhaust pipe 150, and the first exhaust pipe 51 therein is formed as a short exhaust pipe 151. The second exhaust pipe 52 in the internal exhaust system 49 is formed as a long exhaust pipe 150, and the third exhaust pipe 53 is formed as a short exhaust pipe 151. The long exhaust pipes 150 are longer than the short exhaust pipes 151 by 175 mm. In the embodiment, a difference in a pipe length between the long exhaust pipes 150 and the short exhaust pipes 151 is set to 175 mm. However, the difference in the pipe length may be set to 150 mm or more, and preferably set to 175 mm or more.

Figure 22:
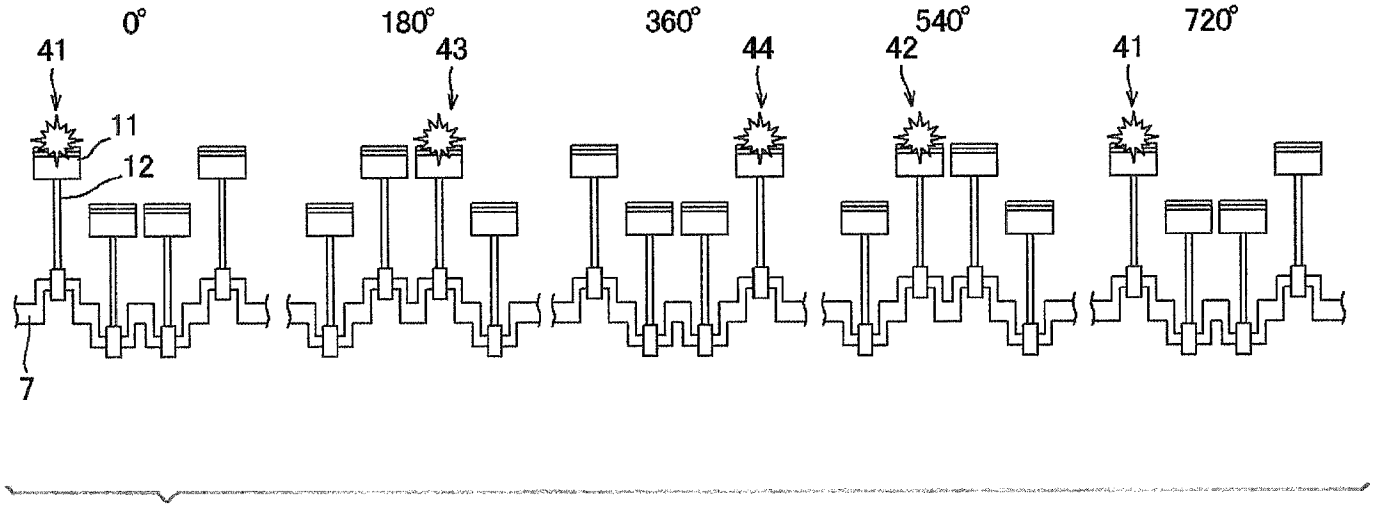
FIG. 22 is a schematic view showing explosion timing in respective cylinders with respect to rotation of the crank of the inline four-cylinder internal combustion engine using the 180-degree crank.

FIG. 22 shows explosion timing in each cylinder with respect to rotation of the crank of the inline four-cylinder internal combustion engine 40 using the 180-degree crank according to the embodiment. When a crank angle for allowing explosion in the first cylinder 41 is set to 0 degrees, during the rotation of the crank at 720 degrees, the explosion occurs in each of crank phases of 0 degrees, 180 degrees, 360 degrees, and 540 degrees. If there is no difference in the pipe length, the explosion sound can be felt at every 180 degrees.

Figure 23:
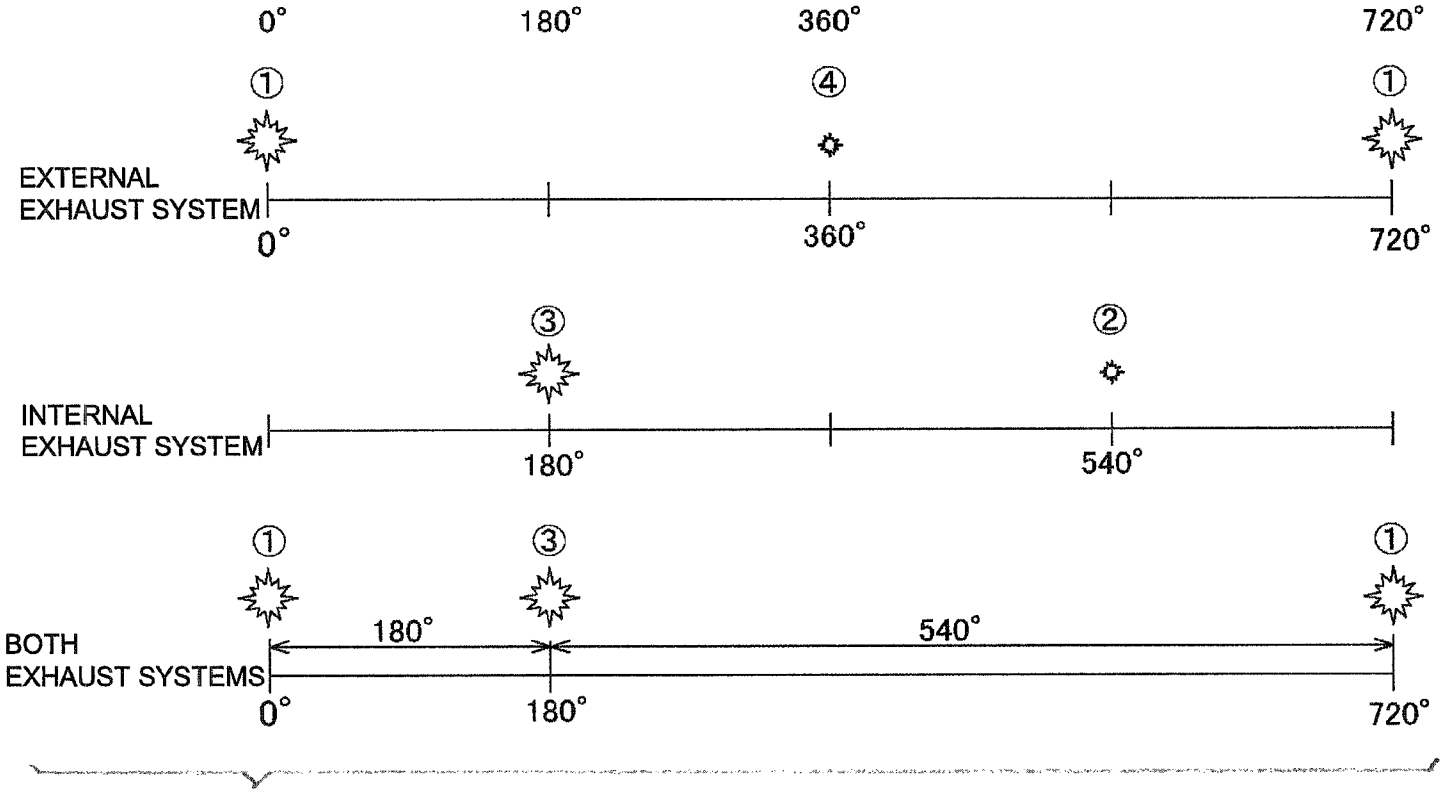
FIG. 23 is a diagram showing timing heard as an explosion sound caused by the exhaust pipe structure for the inline four-cylinder internal combustion engine in FIG. 21.

FIG. 23 shows the explosion timing when the explosion timing in the first cylinder 41 is set to the crank angle phase of 0 degrees, in the external exhaust system 48, the internal exhaust system 49 and both the exhaust systems in the case where the difference in the pipe length between the long exhaust pipes 150 and the short exhaust pipes 151 set to 175 mm. When the difference in the pipe length between the long exhaust pipes 150 and the short exhaust pipes 151 is set to 175 mm, the explosion in each of the second cylinder 42 and the fourth cylinder 44 that are respectively connected with the second exhaust pipe 52 and the fourth exhaust pipe 54 as the long exhaust pipes 150 is not felt as the explosion sound (although the explosion therein is heard as a simple sound, the explosion therein is not heard as the crest (peak) of the exhaust sound having peaks and dips), and the explosion in each of the first cylinder 41 and the third cylinder 43 that are respectively connected with the first exhaust pipe 51 and the third exhaust pipe 53 as the short exhaust pipes 151 is felt as the explosion sound. Therefore, during the rotation of the crank at 720 degrees, the explosion is felt as the explosion sound only in the crank phases of 0 degrees and 180 degrees, and the cycle felt as the explosion sound is set to 180 degrees, 540 degrees, 180 degrees and the like, lengthened in comparison with the exhaust system including the exhaust pipes having the equal pipe length, and becomes the same cycle as the cycle of the interval of the explosion sound at the explosion timing in the inline two-cylinder internal combustion engine using the 180-degree crank. For this reason, in the inline four-cylinder internal combustion engine, output performance can be easily improved in comparison with the two-cylinder internal combustion engine having the same displacement, and an appealing and harmonious exhaust sound with the excellent pulse feeling relating to the inline two-cylinder internal combustion engine using the 180-degree crank can be output.

Figure 24:
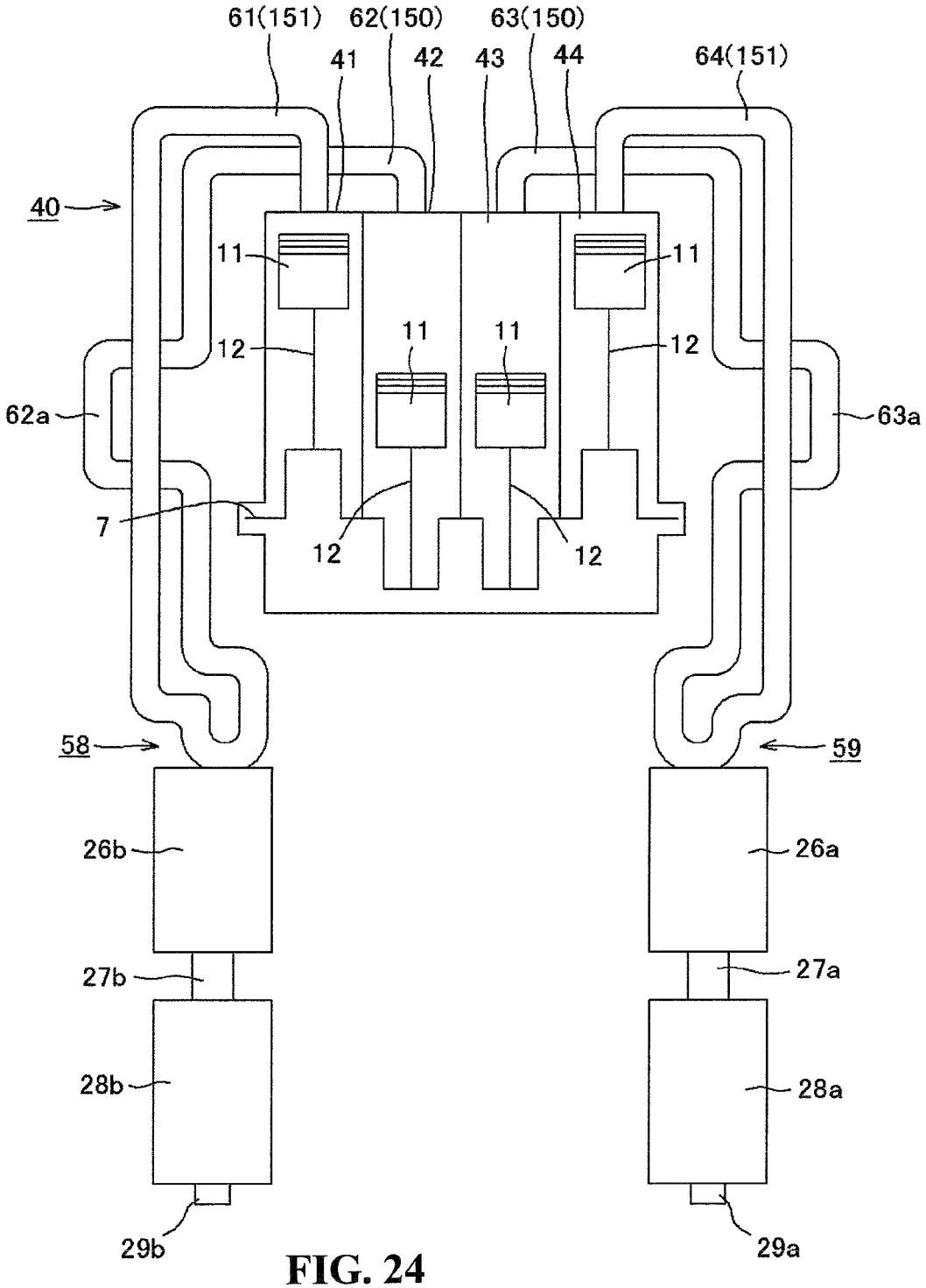
FIG. 24 is a schematic view showing the inline four-cylinder internal combustion engine using the 180-degree crank and the exhaust pipe structure for the same according to another aspect of the third embodiment applied with the present invention.

Next, another aspect of the third embodiment with the present invention applied to the inline four-cylinder internal combustion engine 40 using the 180-degree crank will be described based on FIG. 24 and FIG. 25. FIG. 24 shows a schematic view the exhaust pipe structure for the inline four-cylinder internal combustion engine 40 according to the embodiment. The inline four-cylinder internal combustion engine 40 is mounted in a vehicle such that a crankshaft 7 is directed to a horizontal direction, a first cylinder 41, a second cylinder 42, a third cylinder 43, and a fourth cylinder 44 are provided in series from the left, and a first exhaust pipe 61, a second exhaust pipe 62, a third exhaust pipe 63 and a fourth exhaust pipe 64 are respectively connected to the first cylinder 41, the second cylinder 42, the third cylinder 43, and the fourth cylinder 44.

The first exhaust pipe 61 and the second exhaust pipe 62 extending in a forward direction of the vehicle, are subsequently bent and extend rearwardly, are connected to each other so that the first exhaust pipe 61 and the second exhaust pipe 62 are collected to a chamber 26*b* provided on a left side of a lower back portion of the vehicle, and are connected from the chamber 26*b* to a muffler 28*b* through a connecting pipe 27*b*. A rear portion of the muffler 28*b* is provided with a tailpipe 29*b*. A left exhaust system 58 includes the first exhaust pipe 61, the second exhaust pipe 62, the chamber 26*b*, the connecting pipe 27*b*, the muffler 28*b*, and the tailpipe 29*b*.

Further, the third exhaust pipe 63 and the fourth exhaust pipe 64 extending in a forward direction of the vehicle, are subsequently bent, and extend rearwardly, are connected to each other so that the third exhaust pipe 63 and the fourth exhaust pipe 64 are collected to a chamber 26*a* provided on a right side of the lower back portion of the vehicle, and connected from the chamber 26*a* to a muffler 28*a* through a connecting pipe 27*a*. A rear portion of the muffler 28*a* is provided with a tailpipe 29*a*. A right exhaust system 59 includes the third exhaust pipe 63, the fourth exhaust pipe 64, the chamber 26*a*, the connecting pipe 27*a*, the muffler 28*a*, and the tailpipe 29*a*.

The second exhaust pipe 62 and the third exhaust pipe 63 are formed with bent portions 62*a*, 63*a* in order to form long exhaust pipes 150 with a pipe length longer than that of each of the first exhaust pipe 61 and the fourth exhaust pipe 64 as short exhaust pipes 151. The length of each of the long exhaust pipes 150 is formed longer than that of each of the short exhaust pipes 151 by 175 mm. In the embodiment, a difference in a pipe length between the long exhaust pipes 150 and the short exhaust pipes 151 is set to 175 mm. However, the difference in the pipe length may be set to 150 mm or more, and preferably set to 175 mm or more.

As described in the third embodiment, FIG. 22 shows the explosion timing in each cylinder with respect to the rotation of the crank of the inline four-cylinder internal combustion engine 40 in a crank phase of 180 degrees according to the embodiment. During rotation of the crank at 720 degrees, the explosion occurs in each of crank phases of 0 degrees, 180 degrees, 360 degrees, and 540 degrees. If there is no difference in the pipe length, the explosion sound can be felt at every 180 degrees.

Figure 25:
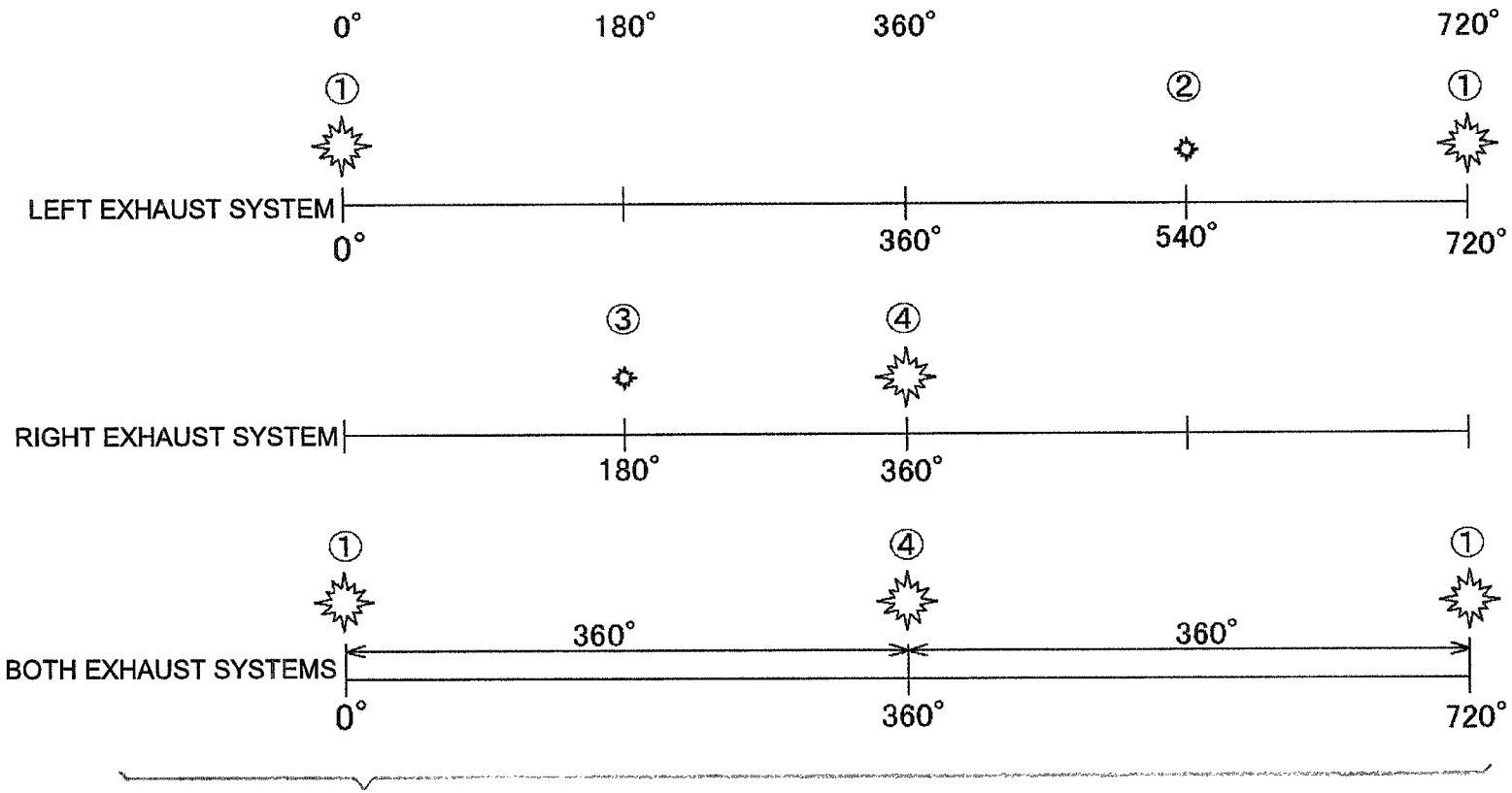
FIG. 25 is a diagram showing timing heard as an explosion sound caused by the exhaust pipe structure for the inline four-cylinder internal combustion engine in FIG. 24.

FIG. 25 shows the explosion timing in the external exhaust system 48, the internal exhaust system 49 and both the exhaust systems in the case where the difference in the pipe length between the long exhaust pipes 150 and the short exhaust pipes 151 set to 175 mm. When the difference in the pipe length between the long exhaust pipes 150 and the short exhaust pipes 151 is set to 175 mm, the explosion in each of the second cylinder 42 and the third cylinder 43 connected with the second exhaust pipe 62 and the third exhaust pipe 63 as the long exhaust pipes 150 is not felt as the explosion sound, and the explosion in each of the first cylinder 41 and the fourth cylinder 44 connected with the first exhaust pipe 61 and the fourth exhaust pipe 64 as the short exhaust pipes 151 is felt as the explosion sound. Therefore, during the rotation of the crank at 720 degrees, the explosion is felt as the explosion sound only at the crank angles of 0 degrees and the 360 degrees, and the interval felt as the explosion sound is set every 360 degrees and lengthened in comparison with the exhaust system including the exhaust pipes having the equal pipe length.

As described in the first embodiment, when the difference in the pipe length is 175 mm, the interval felt as the explosion sound in the external exhaust system 48 only is 48 m/sec. Therefore, when the sound pressure amplitude of the external exhaust system 48 and the sound pressure amplitude of the internal exhaust system 49 overlap with each other, the interval felt as the explosion sound is 24 m/sec. This interval is longer than 15 m/sec in the resolution performance, and the explosion sound in the inline four-cylinder internal combustion engine 40 with the difference in the pipe length set to 175 mm according to the embodiment can be recognized as the pulse sound. For this reason, in the inline four-cylinder internal combustion engine in the crank phase of 180 degrees, the output performance can be easily improved in comparison with the two-cylinder internal combustion engine having the same displacement, and the appealing and harmonious exhaust sound with the excellent pulse feeling relating to the two-cylinder internal combustion engine can be output.

Figure 26:
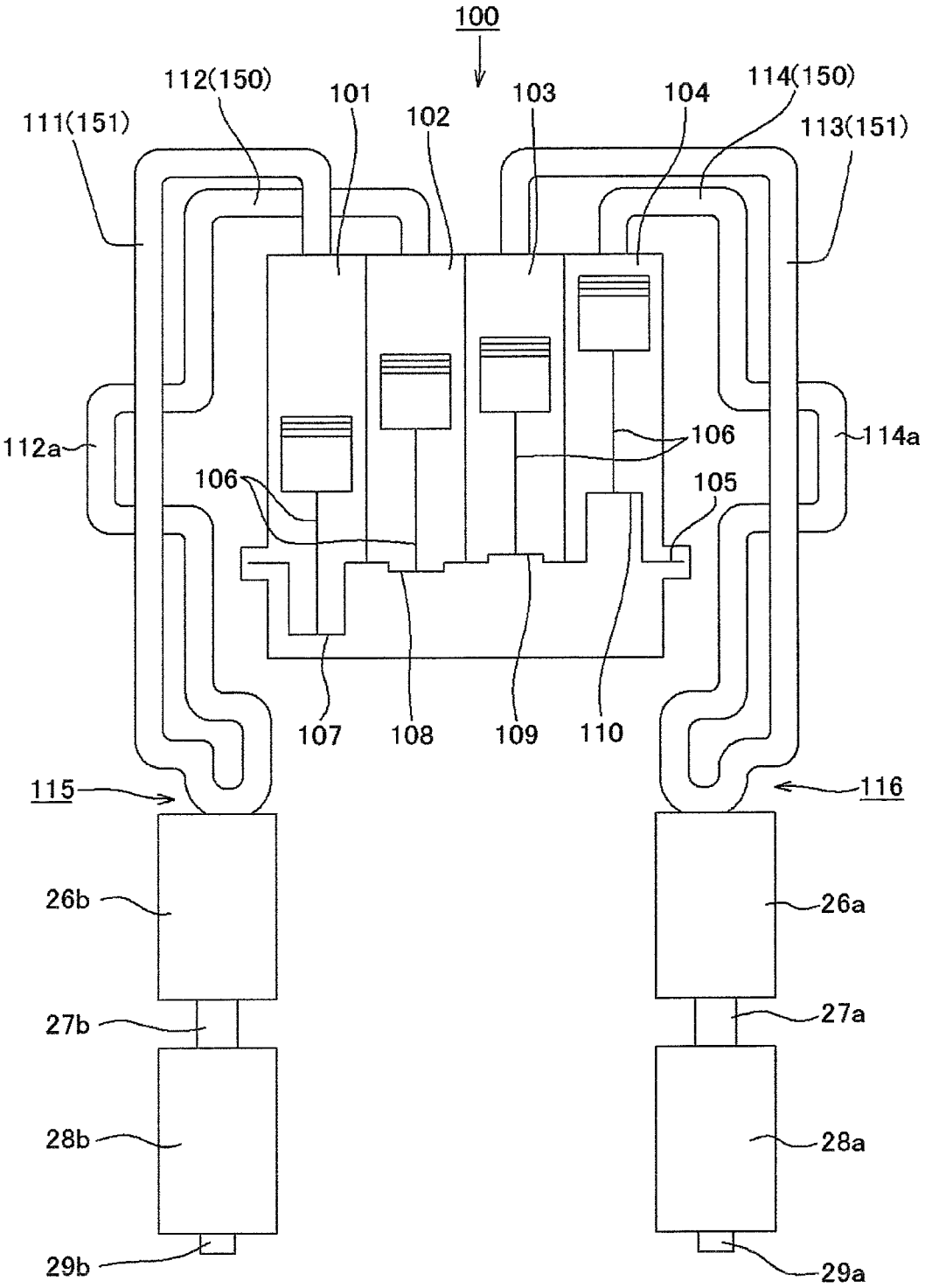
FIG. 26 is a pattern diagram showing an inline four-cylinder internal combustion engine using a 90-degree crank and an exhaust pipe structure for the same according to a fourth embodiment applied with the present invention.

Next, an inline four-cylinder internal combustion engine 100 and an exhaust pipe structure for the same according to a fourth embodiment applied with the present invention will be described based on FIG. 26 to FIG. 28. FIG. 26 shows a pattern diagram of the inline four-cylinder internal combustion engine 100 and the exhaust pipe structure for the same according to the embodiment. The inline four-cylinder internal combustion engine 100 as an inline four-cylinder internal combustion engine using a 90-degree crank is mounted in a vehicle such that a crankshaft 105 is directed to a horizontal direction. A first cylinder 101, a second cylinder 102, a third cylinder 103, and a fourth cylinder 104 are provided in series from the left. Respective connecting rods 106 of the first cylinder 101 to the fourth cylinder 104 are coupled to a first crankpin 107, a second crankpin 108, a third crankpin 109, and a fourth crankpin 110. Crank angles formed between the adjacent crankpins of the first crankpin 107 to the fourth crankpin 110 are respectively set to 90 degrees. Respective exhaust pipes are connected to the respective cylinders, that is, a first exhaust pipe 111, a second exhaust pipe 112, a third exhaust pipe 113, and a fourth exhaust pipe 114 are respectively connected to the first cylinder 101, the second cylinder 102, the third cylinder 103, and the fourth cylinder 104.

The first exhaust pipe 111 and the second exhaust pipe 112 that are positioned on a left side extend in a forward direction of a vehicle, subsequently bent, extend rearwardly, and are connected to each other so that the first exhaust pipe 111 and the second exhaust pipe 112 are collected to a chamber 26*b* provided on a left side of a lower back portion of the vehicle, and connected from the chamber 26*b* to a muffler 28*b* through a connecting pipe 27*b*. A rear portion of the muffler 28*b* is provided with a tailpipe 29*b*. A left exhaust system 115 includes the first exhaust pipe 111, the second exhaust pipe 112, the chamber 26*b*, the connecting pipe 27*b*, the muffler 28*b*, and the tailpipe 29*b*.

The third exhaust pipe 113 and the fourth exhaust pipe 114 that are positioned on a right side extend in a forward direction of the vehicle, subsequently bent, extend rearwardly, and are connected to each other so that the third exhaust pipe 113 and the fourth exhaust pipe 114 are collected to a chamber 26*a* provided on a right side of the lower back portion of the vehicle, and connected from the chamber 26*a* to a muffler 28*a* through a connecting pipe 27*a*. A rear portion of the muffler 28*a* is provided with a tailpipe 29*a*. A right exhaust system 116 includes the third exhaust pipe 113, the fourth exhaust pipe 114, the chamber 26*a*, the connecting pipe 27*a*, the muffler 28*a*, and the tailpipe 29*a*.

The second exhaust pipe 112 and the fourth exhaust pipe 114 are formed with bent portions 112*a*, 114*a* to form long exhaust pipes 150 with pipe length longer than that of each of the first exhaust pipe 111 and the third exhaust pipe 113 as short exhaust pipes 151. The long exhaust pipes 150 are set to be longer than the pipe length of each of the short exhaust pipes 151 by 175 mm. In the embodiment, a difference in the pipe length between the long exhaust pipes 150 and the short exhaust pipes 151 is set to 175 mm; however, the difference in the pipe length may be set to 150 mm, and preferably set to 175 mm or more.

Figure 27:
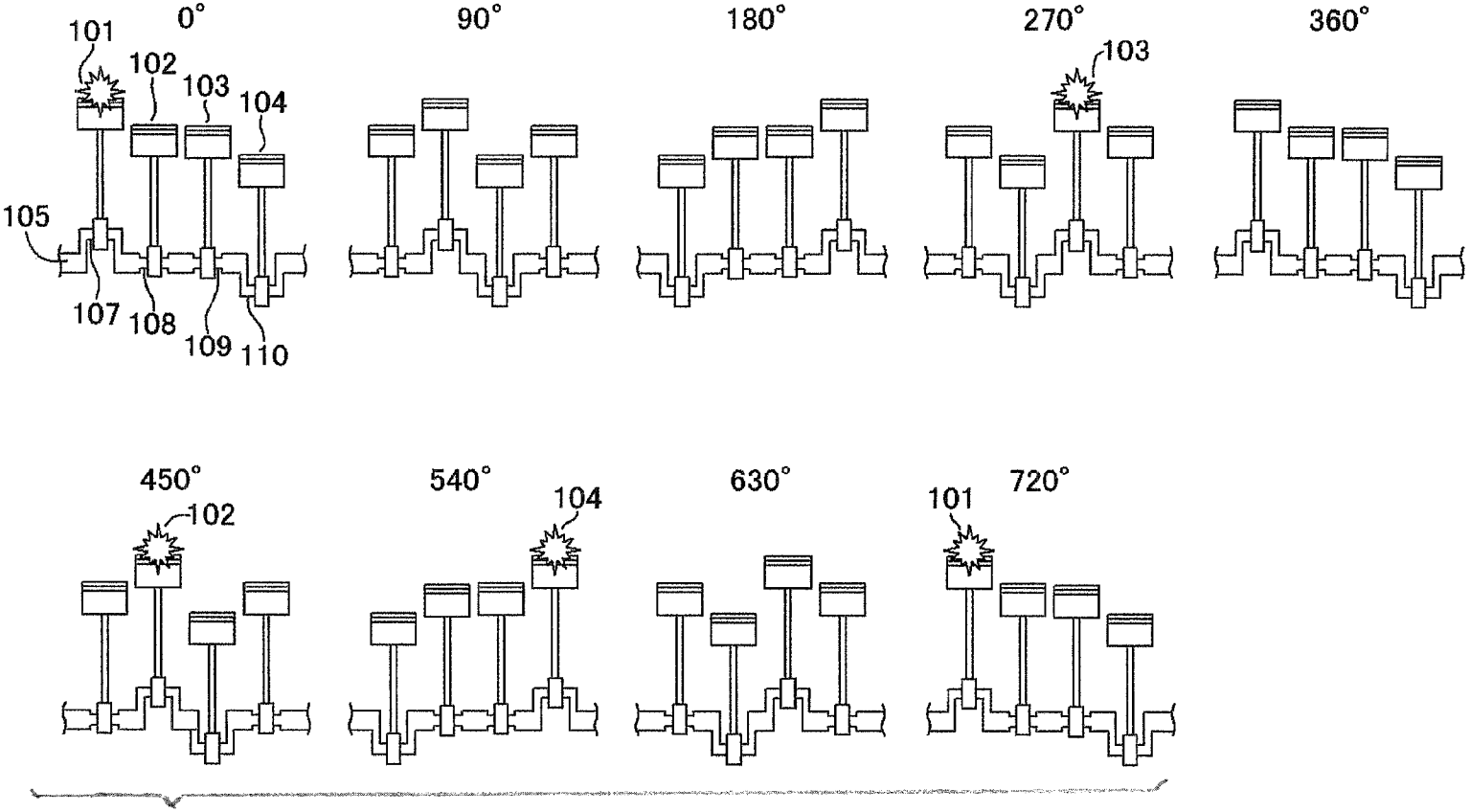
FIG. 27 is a schematic view showing explosion timing in each cylinder with respect to rotation of the crank of the inline four-cylinder internal combustion engine using the 90-degree crank.

FIG. 27 shows explosion timing in each cylinder with respect to the rotation of the crank of the inline four-cylinder internal combustion engine 100 using the 90-degree crank according to the embodiment. During rotation of the crank at 720 degrees, explosion occurs in each of crank phases of 0 degrees, 270 degrees, 450 degrees, and 540 degrees. When there is no difference in the length of the pipe, the explosion sound is felt in each of crank phases of 270 degrees, 180 degrees, 90 degrees, and 180 degrees.

Figure 28:
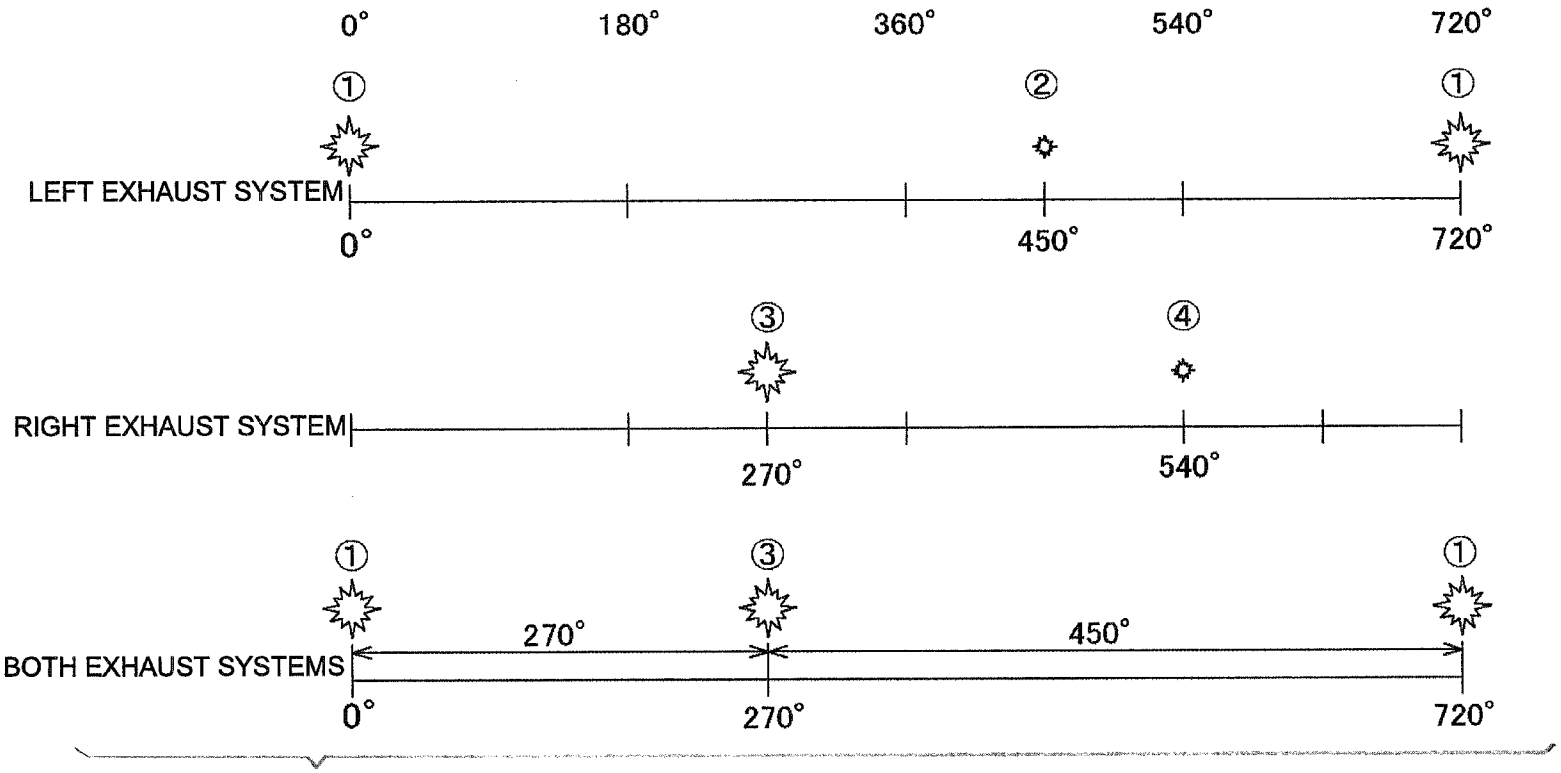
FIG. 28 is a diagram showing timing heard as the explosion sound caused by the exhaust pipe structure for the inline four-cylinder internal combustion engine using the 90-degree crank in FIG. 26.

FIG. 28 shows explosion timing when the explosion timing in the first cylinder 101 is set to the crank angle phase of 0 degrees, in the left exhaust system 115, the right exhaust system 116 and both the exhaust systems in the case where the difference in the pipe length between the long exhaust pipes 150 and the short exhaust pipes 151 set to 175 mm. When the difference in the pipe length between the long exhaust pipes 150 and the short exhaust pipes 151 is set to 175 mm, the explosion in each of the second cylinder 102 and the fourth cylinder 104 connected with the second exhaust pipe 112 and the fourth exhaust pipe 114 as the long exhaust pipes 150 is not felt as the explosion sound (although the explosion therein is heard as a simple sound, the explosion therein is not heard as the crest (peak) of the exhaust sound having peaks and dips), and the explosion in each of the first cylinder 101 and the third cylinder 103 connected with the first exhaust pipe 111 and the third exhaust pipe 113 as the short exhaust pipes 151 is felt as the explosion sound. Therefore, during the rotation of the crank at 720 degrees, the explosion is felt as the explosion sound only in the crank phases of 0 degrees and 270 degrees, and the intervals felt as the explosion sounds become 270 degrees and 450 degrees and lengthened in comparison with the exhaust system including the exhaust pipes with the equal pipe length.

Further, since the intervals of the crank angle phases felt as the explosion sounds are set to 270 degrees, 450 degrees, 270 degrees, and the like, a cycle of sound recognized as the explosion sound is lengthened, the explosion sound is allowed to be heard as if explosion sounds are generated at irregular intervals, and the cycle becomes the same cycle as the intervals of 270 degrees, 450 degrees, 270 degrees and the like as the explosion sound cycle at the explosion timing in the V-shaped two-cylinder internal combustion engine at the bank angle of 90 degrees. For this reason, in inline four-cylinder internal combustion engine, the output performance can be easily improved in comparison with the two-cylinder internal combustion engine having the same displacement, and the appealing and harmonious exhaust sound with the excellent pulse feeling relating to the V-shaped two-cylinder internal combustion engine can be output.

Figure 29:
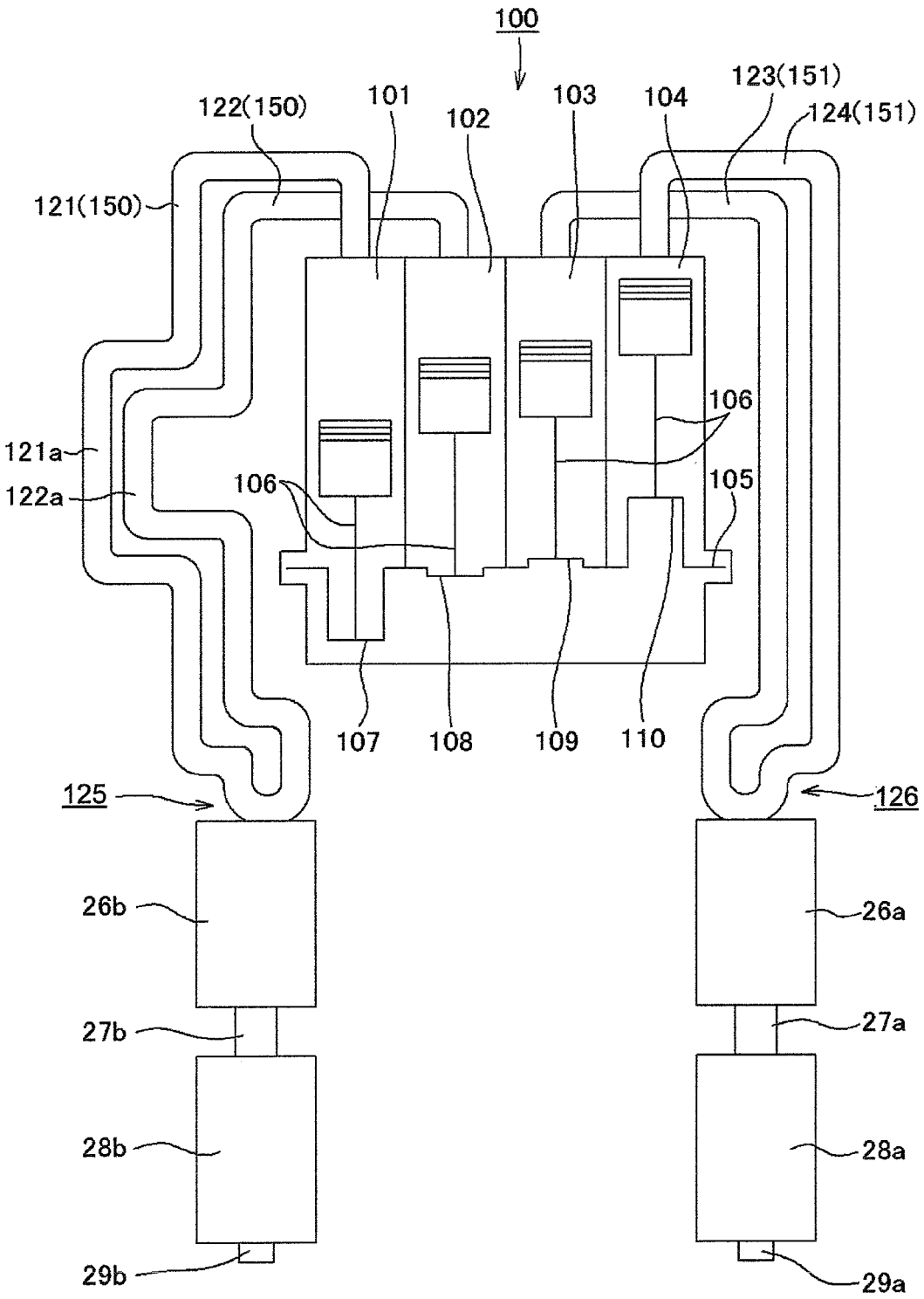
FIG. 29 is a pattern diagram showing the inline four-cylinder internal combustion engine using the 90-degree crank and the exhaust pipe structure for the same according to a fourth embodiment applied with the present invention.

Next, another aspect of the fourth embodiment with the present invention applied to the inline four-cylinder internal combustion engine 100 will be described based on FIG. 29 and FIG. 30. FIG. 29 shows a pattern diagram of the inline four-cylinder internal combustion engine 100 and the exhaust pipe structure for the same according to the embodiment. As the inline four-cylinder internal combustion engine 100 used for the embodiment, the inline four-cylinder internal combustion engine 100 using the 90-degree crank is used which is the same as the internal combustion engine used for the above-described embodiment. Exhaust pipes are respectively connected to respective cylinders, that is, a first exhaust pipe 121, a second exhaust pipe 122, a third exhaust pipe 123, and a fourth exhaust pipe 124 are respectively connected to a first cylinder 101, a second cylinder 102, a third cylinder 103, and a fourth cylinder 104.

The first exhaust pipe 121 and the second exhaust pipe 122 that are positioned on a left side extend in a forward direction of a vehicle, are subsequently bent, extend rearwardly, and are connected to each other so that the first exhaust pipe 121 and the second exhaust pipe 122 are collected to a chamber 26*b* provided on a left side of a lower back portion of the vehicle, and connected from the chamber 26*b* to a muffler 28*b* through a connecting pipe 27*b*. A rear portion of the muffler 28*b* is provided with a tailpipe 29*b*. A left exhaust system 125 includes the first exhaust pipe 121, the second exhaust pipe 122, the chamber 26*b*, the connecting pipe 27*b*, the muffler 29*b*, and the tailpipe 29*b*.

The third exhaust pipe 123 and the fourth exhaust pipe 124 that are positioned on a right side extend in a forward direction of the vehicle, are subsequently bent, extend rearwardly, and are connected to each other so that the third exhaust pipe 123 and the fourth exhaust pipe 124 are collected to a chamber 26*a* provided on a right side of the lower back portion of the vehicle, and connected from the chamber 26*a* to a muffler 28*a* through a connecting pipe 27*a*. A rear portion of the muffler 28*a* is provided with a tailpipe 29*a*. A right exhaust system 126 includes the third exhaust pipe 123, the fourth exhaust pipe 124, the chamber 26*a*, the connecting pipe 27*a*, the muffler 28*a*, and the tailpipe 29*a*.

The first exhaust pipe 121 and the second exhaust pipe 122 are formed with bent portions 121*a*, 122*a* to form long exhaust pipes 150 with pipe length longer than that of each of the third exhaust pipe 123 and the fourth exhaust pipe 124 as short exhaust pipes 151. The pipe length of each of the long exhaust pipes 150 is set to be longer than that of each of the short exhaust pipes 151 by 175 mm. In the embodiment, the difference in the pipe length between the long exhaust pipes 150 and the short exhaust pipes 151 is set to 175 mm. However, the difference in the pipe length may be set to 150 mm or more, and preferably set to 175 mm or more.

As described in the first embodiment, FIG. 28 shows explosion timing in each cylinder with respect to rotation of the crank of the inline four-cylinder internal combustion engine 100 using the 90-degree crank according to the embodiment. During rotation of the crank at 720 degrees, explosion occurs in each of crank phases of 0 degrees, 270 degrees, 450 degrees, and 540 degrees. When there is no difference in pipe length, the explosion sound is felt in each of crank phases of 270 degrees, 180 degrees, 90 degrees, and 180 degrees.

Figure 30:
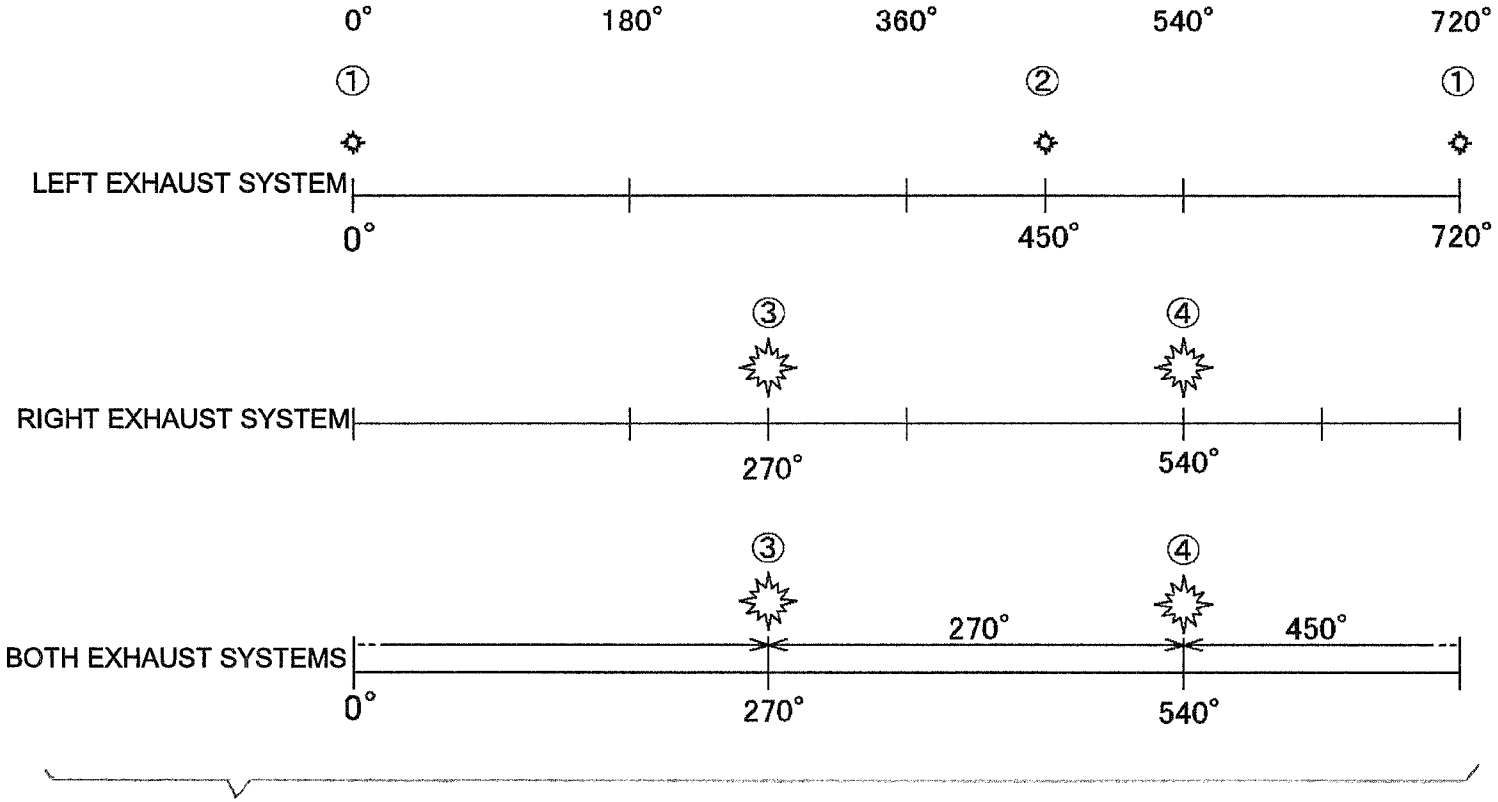
FIG. 30 is a diagram showing timing heard as an explosion sound caused by the exhaust pipe structure for the inline four-cylinder internal combustion engine using the 90-degree crank in FIG. 29.

FIG. 30 shows explosion timing in the left exhaust system 125, the right exhaust system 126, and both the exhaust systems in the case where the difference in the pipe length between the long exhaust pipes 150 and the short exhaust pipes 151 is set to 175 mm. When the difference in the pipe length between the long exhaust pipes 150 and the short exhaust pipes 151 is set to 175 mm, the explosion in each of the first cylinder 101 and the second cylinder 102 connected with the first exhaust pipe 121 and the second exhaust pipe 122 as the long exhaust pipes 150 is not felt as the explosion sound, and the explosion in each of the third cylinder 103 and the fourth cylinder 104 connected with the third exhaust pipe 123 and the fourth exhaust pipe 124 as the short exhaust pipes 151 is felt as the explosion sound. Therefore, during the rotation of the crank at 720 degrees, the explosion is felt as the explosion sound only in the crank phases of 0 degrees and 270 degrees, and the intervals felt as the explosion sounds become a cycle of 270 degrees and 450 degrees and lengthened in comparison with the exhaust system including the exhaust pipes with the equal pipe length.

Further, since the intervals of the crank angle phases felt as the explosion sounds are set to 270 degrees, 450 degrees, 270 degrees, and the like, a cycle of sound recognized as the explosion sound is lengthened, the explosion sound is allowed to hear as if the explosion sounds are generated at irregular intervals, and the cycle becomes the same cycle as the cycle of 270 degrees, 450 degrees, 270 degrees and the like as the explosion sound cycle at the explosion timing in the V-shaped two-cylinder internal combustion engine at the bank angle of 90 degrees. For this reason, in the inline four-cylinder internal combustion engine, the output performance can be easily improved in comparison with the two-cylinder internal combustion engine having the same displacement, and the appealing and harmonious exhaust sound with the excellent pulse feeling relating to the V-shaped two-cylinder internal combustion engine can be output.

Figure 31:
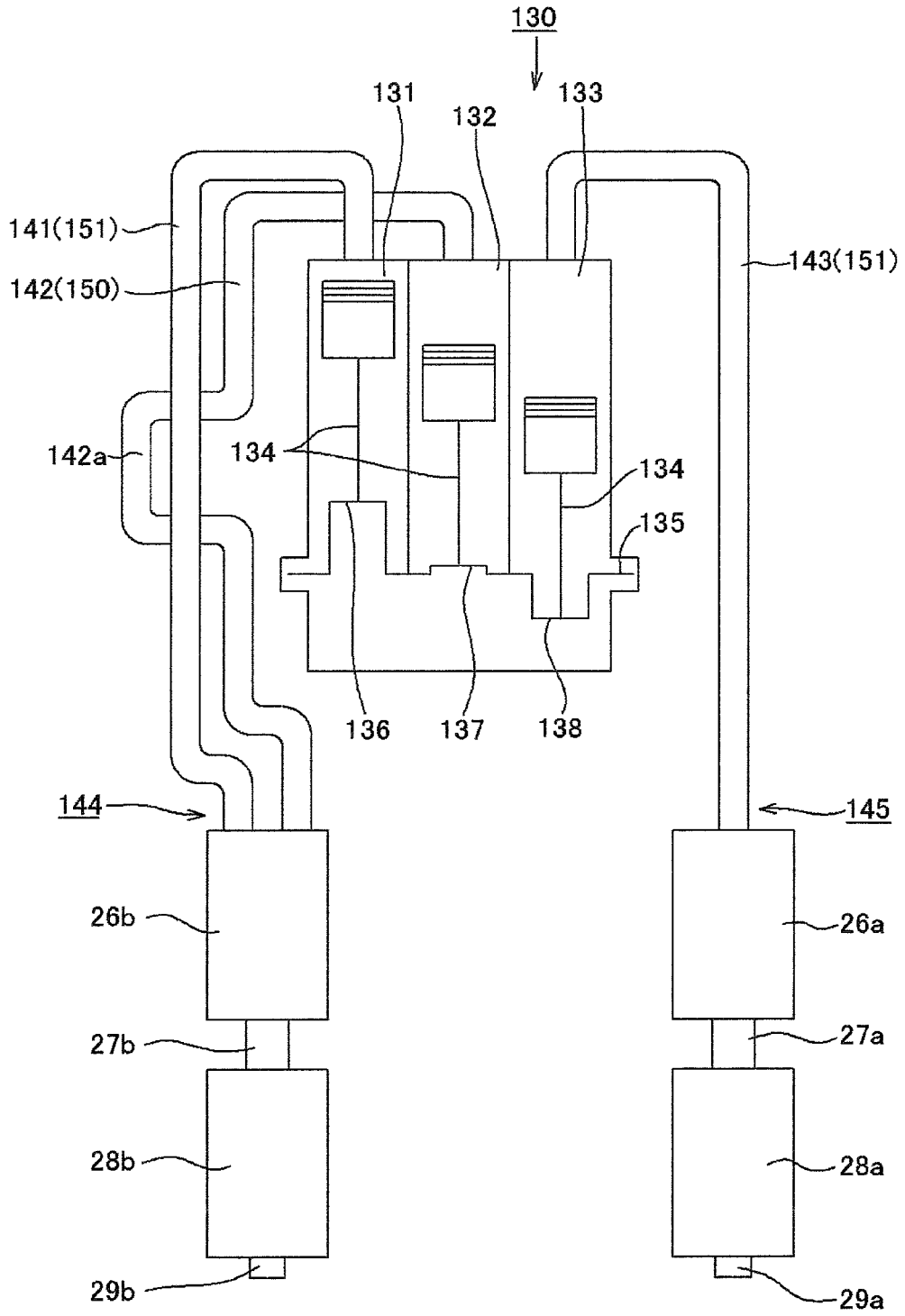
FIG. 31 is a pattern diagram showing an inline three-cylinder internal combustion engine using a 240-degree crank and an exhaust pipe structure for the same according to a fifth embodiment applied with the present invention.

Next, an inline three-cylinder internal combustion engine 130 and an exhaust pipe structure for the same according to a fifth embodiment applied with the present invention will be described based on FIG. 31 and FIG. 32. FIG. 31 shows a pattern diagram of the exhaust pipe structure for the inline three-cylinder internal combustion engine 130 according to the embodiment. The inline three-cylinder internal combustion engine 130 is mounted in a vehicle with a crankshaft 135 directed to a horizontal direction. A first cylinder 131, a second cylinder 132, a third cylinder 133 are provided in series from the left. Respective connecting rods 134 of the first cylinder 131 to the third cylinder 133 are coupled to a first crankpin 136, a second crankpin 137, and a third crankpin 138. Crank angles formed between the adjacent crankpins of the first crankpin 136 to the third crankpin 138 are respectively set to 120 degrees.

A first exhaust pipe 141 positioned on a left side and a second exhaust pipe 142 positioned in the center extend in a forward direction of a vehicle, are subsequently bent, extend rearwardly, and are connected to each other so that the first exhaust pipe 141 and the second exhaust pipe 142 are collected to a chamber 26*b* provided on the left side of a lower back portion of the vehicle, and connected from the chamber 26*b* to a muffler 28*b* through a connecting pipe 27*b*. A rear portion of the muffler 28*b* is provided with a tailpipe 29*b*. A left exhaust system 144 includes the first exhaust pipe 141, the second exhaust pipe 142, the chamber 26*b*, the connecting pipe 27*b*, the muffler 28*b*, and the tailpipe 29*b*.

A third exhaust pipe 143 positioned on a right side extends in a forward direction of the vehicle, is subsequently bent, extends rearwardly, and is connected to a chamber 26*b* provided on the right side of the lower lack portion of the vehicle, and connected from the chamber 26*a* to a muffler 28*a* through a connecting pipe 27*a*. A rear portion of the muffler 28*a* is provided with a tailpipe 29*a*. A right exhaust system 145 includes the third exhaust pipe 143, the chamber 26*a*, the connecting pipe 27*a*, the muffler 28*a*, and the tailpipe 29*a*.

The second exhaust pipe 142 is formed with a bent portion 142*a* to form a long exhaust pipe 150 with a pipe length longer than those of the first exhaust pipe 141 and the third exhaust pipe 143 as short exhaust pipes 151. The long exhaust pipe 150 is longer than the short exhaust pipes 151 by 175 mm. In the embodiment, a difference in a pipe length between the long exhaust pipe 150 and the short exhaust pipes 151 is set to 175 mm. However, the difference in the pipe length may be set to 150 mm or more, and preferably set to 175 mm or more.

Figure 32:
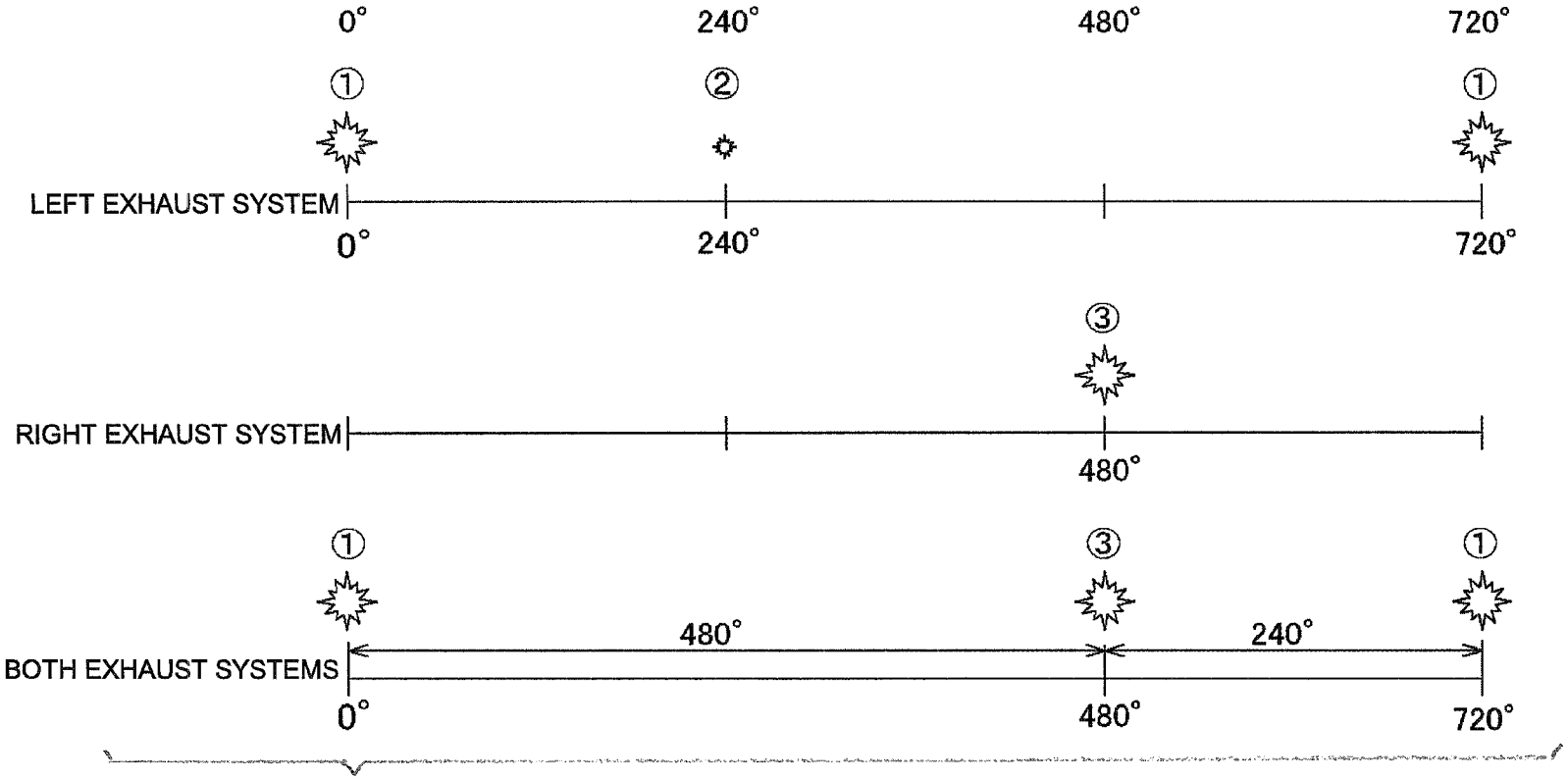
FIG. 32 is a diagram showing timing heard as an explosion sound caused by the exhaust pipe structure for the inline three-cylinder internal combustion engine in FIG. 30.

FIG. 32 shows explosion timing in respective cylinders with respect to rotation of a crank in the left exhaust system 144, the right exhaust system 145, and both the exhaust systems with the difference in the pipe length between the long exhaust pipe 150 and the short exhaust pipes 151 set to 175 mm, in the inline three-cylinder internal combustion engine 130 according to the embodiment. When a crank angle for allowing explosion in the first cylinder 131 is set to 0 degrees, during rotation of the crank at 720 degrees, the explosion occurs in each of crank phases of 0 degrees, 240 degrees, and 480 degrees. If there is no difference in the pipe length, the explosion sound can be felt at every 240-degree interval.

When the difference in the pipe length between the long exhaust pipe 150 and the short exhaust pipes 151 is set to 175 mm, the explosion in the second cylinder 132 connected with the second exhaust pipe 142 as the long exhaust pipe 150 is not felt as the explosion sound, and the explosion in each of the first cylinder 131 and the third cylinder 133 that are connected with the first exhaust pipe 141 and the third exhaust pipe 143 as the short exhaust pipes 151 is felt as the explosion sound. Therefore, during the rotation of the crank at 720 degrees, the explosion is felt as the explosion sound only in the crank phases of 0 degrees and 480 degrees, the cycles felt as the explosion sound become 480 degrees, 240 degrees, 480 degrees, and the like and lengthened in comparison with the exhaust system including the exhaust pipes with the equal pipe length, and the intervals felt as the explosion sounds become irregular intervals and are brought close to the explosion cycle at the explosion timing of the V-shaped two-cylinder internal combustion engine at the bank angle of 90 degrees. For this reason, in the inline three-cylinder internal combustion engine, the output performance can be easily improved in comparison with the two-cylinder internal combustion engine having the same displacement, and the appealing and harmonious exhaust sound with the excellent pulse feeling relating to the two-cylinder internal combustion engine can be output.

As described above, the exhaust pipe structure for the internal combustion engine according to the embodiments of the present invention has been described. The aspects of the present invention are not limited to the embodiments, and various design modifications may be made within the scope not departing from the gist of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. An exhaust pipe structure for an internal combustion engine wherein exhaust pipes are respectively connected to four cylinders of a four-cylinder internal combustion engine, comprising:

two long exhaust pipes that are each individually, operatively connected to a first two of the cylinders of the four-cylinder internal combustion engine;

two short exhaust pipes that are each individually, operatively connected to a second two of the cylinders of the four-cylinder internal combustion engine, the two short exhaust pipes are formed as short exhaust pipes having a short pipe length relative to a long pipe length of the two long exhaust pipes;

a difference in a pipe length between the long exhaust pipes and the short exhaust pipes is set to be between 150 mm and 300 mm for outputting an appealing and harmonious exhaust sound;

wherein the four-cylinder internal combustion engine is a V-shaped four-cylinder internal combustion engine with two cylinders being arranged side by side in two respective banks;

the exhaust pipes from the cylinders in the two respective banks are collected in order to independently provide exhaust systems for each of the two respective banks; and one short exhaust pipe and one long exhaust pipe are collected in the exhaust systems for each of the two respective banks.

2. The exhaust pipe structure for an internal combustion engine according to claim 1, wherein the V-shaped four-cylinder internal combustion engine is mounted in a saddle-ride vehicle wherein a crankshaft of the V-shaped four-cylinder internal combustion engine is arranged along a longitudinal direction of a vehicle; and each of the respective long exhaust pipes operatively connected to one cylinder of one of the respective banks is configured to be arranged on a front side of the V-shaped four-cylinder internal combustion engine and to have bent portions formed below the V-shaped four-cylinder internal combustion engine.

3. The exhaust pipe structure for the four-cylinder internal combustion engine according to claim 1, wherein:

the V-shaped four-cylinder internal combustion engine is mounted in the saddle-ride vehicle wherein the crankshaft of the V-shaped four-cylinder internal combustion engine is arranged along the longitudinal direction of the vehicle;

each of the respective long exhaust pipes operatively connected to one cylinder of one of the respective banks is arranged on a rear side of the V-shaped four-cylinder internal combustion engine; and each of the long exhaust pipes operatively connected to one of the cylinders of one of the respective banks arranged on the rear side is configured to extend in a forward direction is subsequently bent, and extends rearwardly.

4. The exhaust pipe structure for the four-cylinder internal combustion engine according to claim 1, wherein:

the V-shaped four-cylinder internal combustion engine is the V-shaped four-cylinder internal combustion engine using a 360-degree crank;

each of the short exhaust pipes operatively connected to the second two cylinders of each of the respective banks is connected to different exhaust systems and being configured such that a difference between crank angle phases during explosion is set to 270 degrees; and each of the long exhaust pipes is respectively connected to the first two cylinders of each of the respective banks.

5. The exhaust pipe structure for an internal combustion engine according to claim 1, wherein:

a first exhaust system is configured such that exhaust pipes from two of the cylinders coupled to one crankpin are collected; and a second exhaust system is configured such that exhaust pipes from the other two cylinders coupled to another crankpin are collected.

6. The exhaust pipe structure for the four-cylinder internal combustion engine according to claim 5, wherein:

the V-shaped four-cylinder internal combustion engine is the V-shaped four-cylinder internal combustion engine using a 180-degree crank;

the short exhaust pipes are respectively connected to the second two cylinders with a difference between crank angle phases at explosion timing being set to 270 degrees.

7. The exhaust pipe structure for the four-cylinder internal combustion engine according to claim 5, wherein:

the V-shaped four-cylinder internal combustion engine is the V-shaped four-cylinder internal combustion engine using the 180-degree crank;

the short two exhaust pipes are respectively connected to the second two cylinders with a difference between the crank angle phases at the explosion timing is set to 180 degrees.

8. The exhaust pipe structure for the internal combustion engine according to claim 1, wherein the difference in the pipe length between the long exhaust pipes and the short exhaust pipes is set to 175 mm.

* * * * *